US008758088B2

(12) United States Patent
Duescher

(10) Patent No.: US 8,758,088 B2
(45) Date of Patent: Jun. 24, 2014

(54) FLOATING ABRADING PLATEN CONFIGURATION

(76) Inventor: Wayne O. Duescher, Roseville, MN (US)

( * ) Notice: Subject to any disclaimer, the term of this patent is extended or adjusted under 35 U.S.C. 154(b) by 355 days.

(21) Appl. No.: 13/280,983

(22) Filed: Oct. 25, 2011

(65) Prior Publication Data

US 2013/0090040 A1 Apr. 11, 2013

Related U.S. Application Data

(63) Continuation-in-part of application No. 13/267,305, filed on Oct. 6, 2011.

(51) Int. Cl.
*B24B 7/22* (2006.01)
*B24B 53/00* (2006.01)

(52) U.S. Cl.
USPC ..... 451/11; 451/5; 451/288

(58) Field of Classification Search
USPC ..... 451/5, 11, 28, 36, 37, 41, 59, 64, 259, 451/260, 270, 271, 280, 283, 285, 288, 287, 451/443, 444, 56
See application file for complete search history.

(56) References Cited

U.S. PATENT DOCUMENTS 4,593,495 A 6/1986 Kawakami et al.
4,918,870 A 4/1990 Torbert et al.
5,014,468 A 5/1991 Ravipati et al.
5,205,082 A 4/1993 Shendon et al.
5,314,513 A 5/1994 Miller et al.
5,364,655 A 11/1994 Nakamura et al.
5,569,062 A 10/1996 Karlsrud
5,643,067 A 7/1997 Katsuoka et al.
5,769,697 A 6/1998 Nishio
5,800,254 A 9/1998 Motley et al.
5,863,306 A 1/1999 Wei et al.
5,910,041 A 6/1999 Duescher
5,916,009 A 6/1999 Izumi et al.
5,964,651 A 10/1999 Hose
5,967,882 A 10/1999 Duescher
5,975,997 A 11/1999 Minami
5,989,104 A 11/1999 Kim et al.
5,993,298 A 11/1999 Duescher
6,001,008 A 12/1999 Fujimori et al.
6,048,254 A 4/2000 Duescher
6,077,153 A * 6/2000 Fujita et al. ..... 451/259
6,089,959 A 7/2000 Nagahashi
6,102,777 A 8/2000 Duescher et al.
6,120,352 A 9/2000 Duescher (Continued)

*Primary Examiner* — Robert Rose
(74) *Attorney, Agent, or Firm* — Mark A. Litman & Associates, P.A.

(57) ABSTRACT

The rotary platens used here for high speed lapping are light in weight and low in mass inertia to allow fast acceleration and deceleration of the platens. The use of cast aluminum materials that are adhesively bonded together provides very rigid platens that have precision-flat surfaces that are dimensionally stable over long periods of time. Use of hardened spherical bead coatings on the surfaces of the platens provides wear-resistant coatings that are easy to apply and to maintain. The platens are constructed using ribs that provide very substantial stiffness and yet are light in weight which allows relatively small motors to be used to drive the platens. Platens are also constructed where the platen mass center is offset a very small distance from the center of rotation of the spherical-action bearings that support the platens to prevent dynamic distortion of the platen abrasive surface due to platen out-of-balance forces.

20 Claims, 24 Drawing Sheets

(56) References Cited

U.S. PATENT DOCUMENTS

| | | | | |
|---|---|---|---|---|
| 6,149,506 | A | 11/2000 | Duescher | |
| 6,165,056 | A | 12/2000 | Hayashi et al. | |
| 6,168,506 | B1 | 1/2001 | McJunken | |
| 6,217,433 | B1 | 4/2001 | Herrman et al. | |
| 6,371,838 | B1 | 4/2002 | Holzapfel | |
| 6,398,906 | B1 | 6/2002 | Kobayashi et al. | |
| 6,425,809 | B1 * | 7/2002 | Ichimura | 451/287 |
| 6,439,965 | B1 | 8/2002 | Ichino et al. | |
| 6,506,105 | B1 | 1/2003 | Kajiwara et al. | |
| 6,607,157 | B1 | 8/2003 | Duescher | |
| 6,752,700 | B2 | 6/2004 | Duescher | |
| 6,769,969 | B1 * | 8/2004 | Duescher | 451/59 |
| 6,786,810 | B2 | 9/2004 | Muilenburg et al. | |
| 6,893,332 | B2 | 5/2005 | Castor | |
| 6,896,584 | B2 | 5/2005 | Perlov et al. | |
| 6,899,603 | B2 | 5/2005 | Homma et al. | |
| 6,935,013 | B1 | 8/2005 | Markevitch et al. | |
| 7,001,251 | B2 | 2/2006 | Doan et al. | |
| 7,008,303 | B2 | 3/2006 | White et al. | |
| 7,014,535 | B2 | 3/2006 | Custer et al. | |
| 7,029,380 | B2 | 4/2006 | Horiguchi et al. | |
| 7,033,251 | B2 | 4/2006 | Elledge | |
| 7,044,838 | B2 | 5/2006 | Maloney et al. | |
| 7,125,313 | B2 | 10/2006 | Zelenski et al. | |
| 7,144,304 | B2 | 12/2006 | Moore | |
| 7,147,541 | B2 | 12/2006 | Nagayama et al. | |
| 7,166,016 | B1 | 1/2007 | Chen | |
| 7,250,368 | B2 | 7/2007 | Kida et al. | |
| 7,276,446 | B2 | 10/2007 | Robinson et al. | |
| 7,357,699 | B2 | 4/2008 | Togawa et al. | |
| 7,367,867 | B2 | 5/2008 | Boller | |
| 7,393,790 | B2 | 7/2008 | Britt et al. | |
| 7,422,634 | B2 | 9/2008 | Powell et al. | |
| 7,446,018 | B2 | 11/2008 | Brogan et al. | |
| 7,456,106 | B2 | 11/2008 | Koyata et al. | |
| 7,470,169 | B2 | 12/2008 | Taniguchi et al. | |
| 7,491,342 | B2 | 2/2009 | Kamiyama et al. | |
| 7,507,148 | B2 | 3/2009 | Kitahashi et al. | |
| 7,520,800 | B2 | 4/2009 | Duescher | |
| 7,527,722 | B2 | 5/2009 | Sharan | |
| 7,582,221 | B2 | 9/2009 | Netsu et al. | |
| 7,614,939 | B2 | 11/2009 | Tolles et al. | |
| 7,632,434 | B2 | 12/2009 | Duescher | |
| 8,062,098 | B2 | 11/2011 | Duescher | |
| 2005/0118939 | A1 | 6/2005 | Duescher | |
| 2008/0299875 | A1 | 12/2008 | Duescher | |
| 2010/0003904 | A1 | 1/2010 | Duescher | |
| 2011/0223835 | A1 | 9/2011 | Duescher | |
| 2011/0223836 | A1 | 9/2011 | Duescher | |
| 2011/0223838 | A1 | 9/2011 | Duescher | |

* cited by examiner

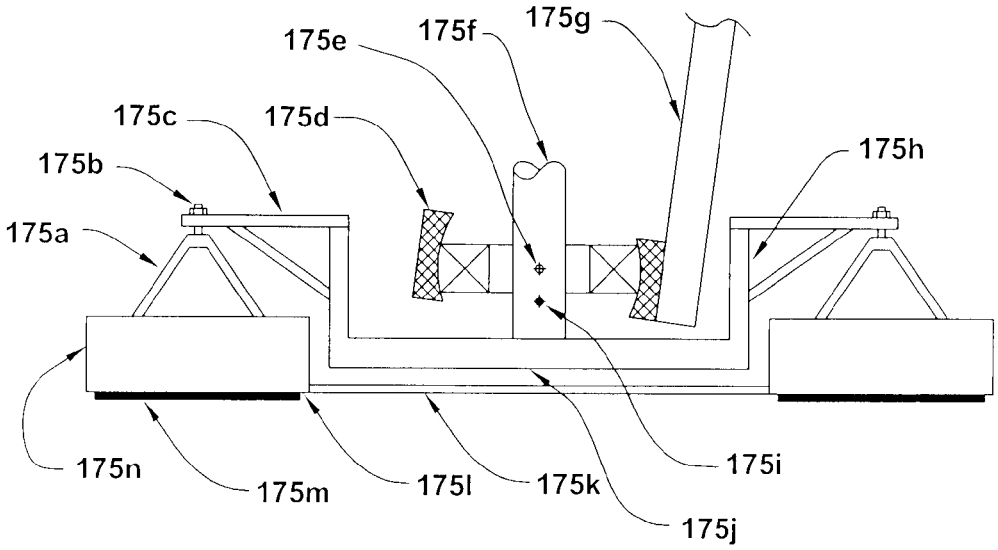
*Fig. 6.1*
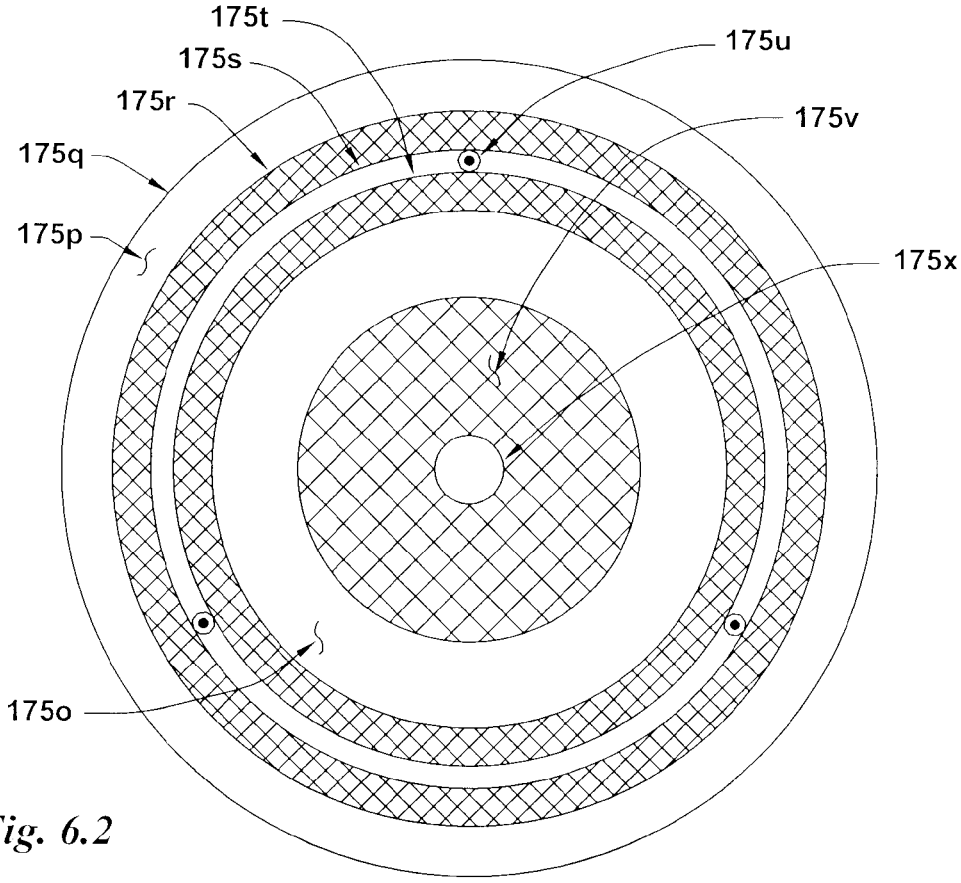
*Fig. 6.2*

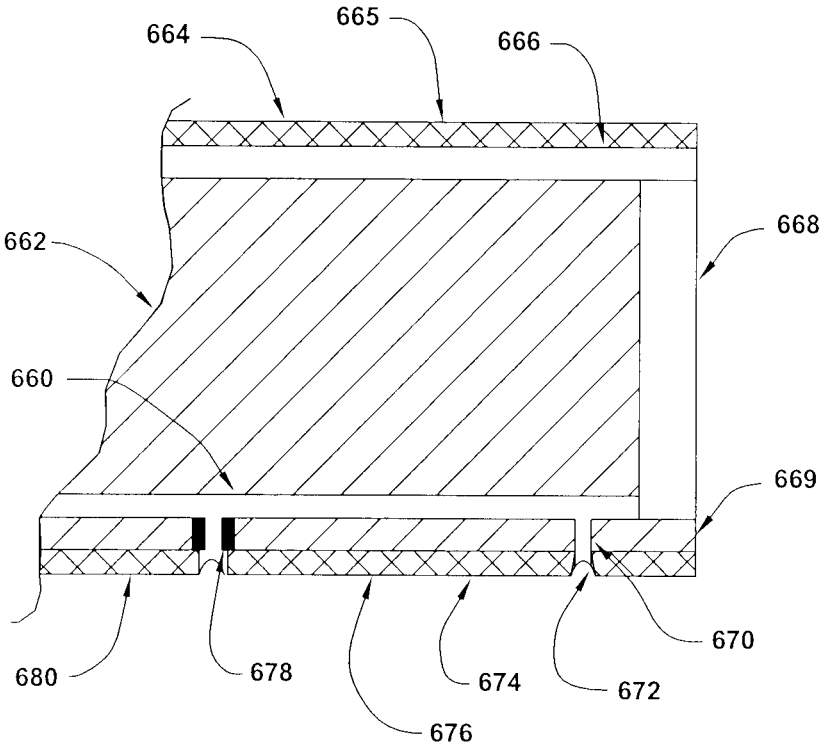
*Fig. 28.1*
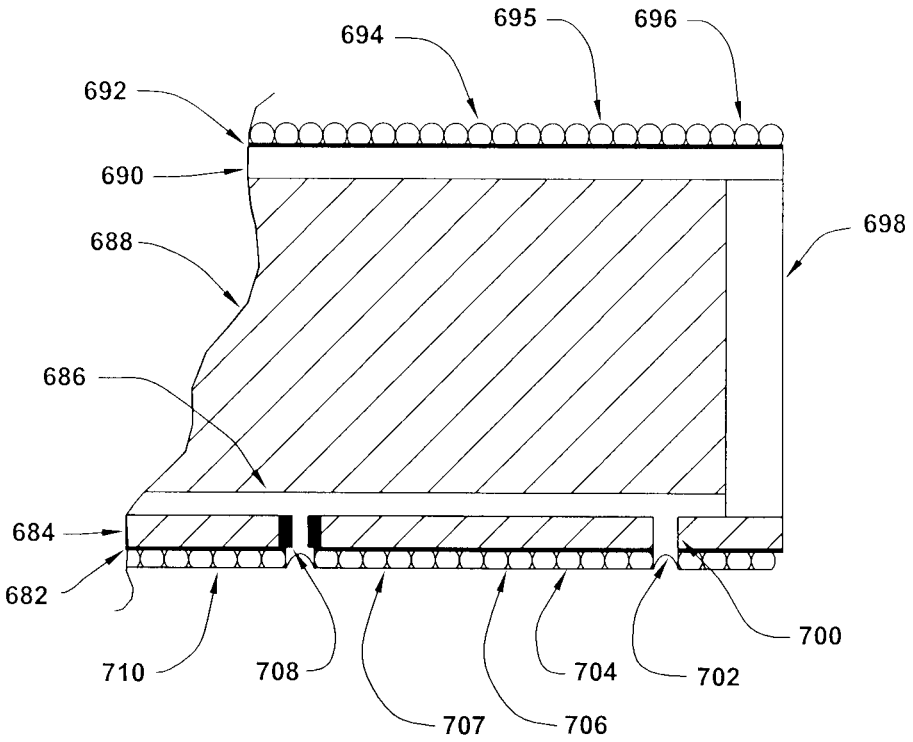
*Fig. 28.2*

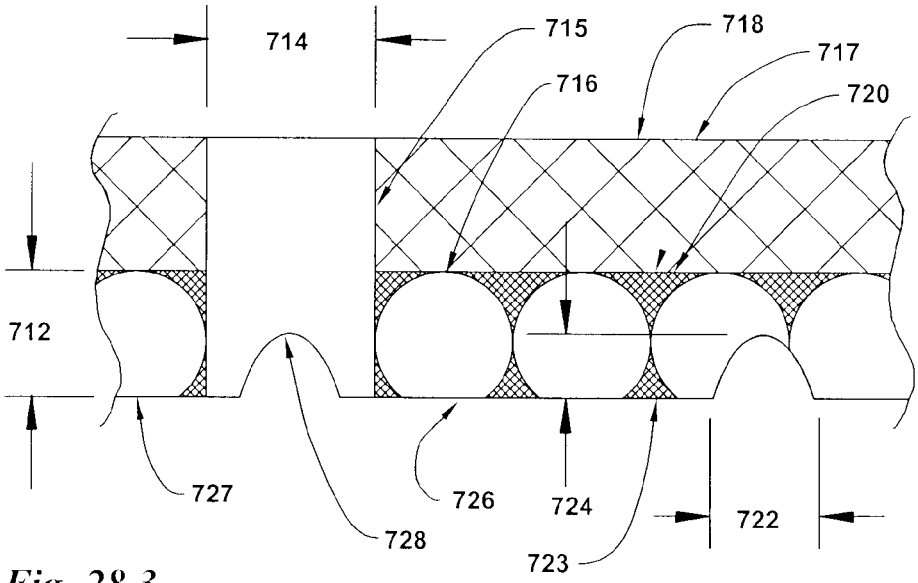
*Fig. 28.3*
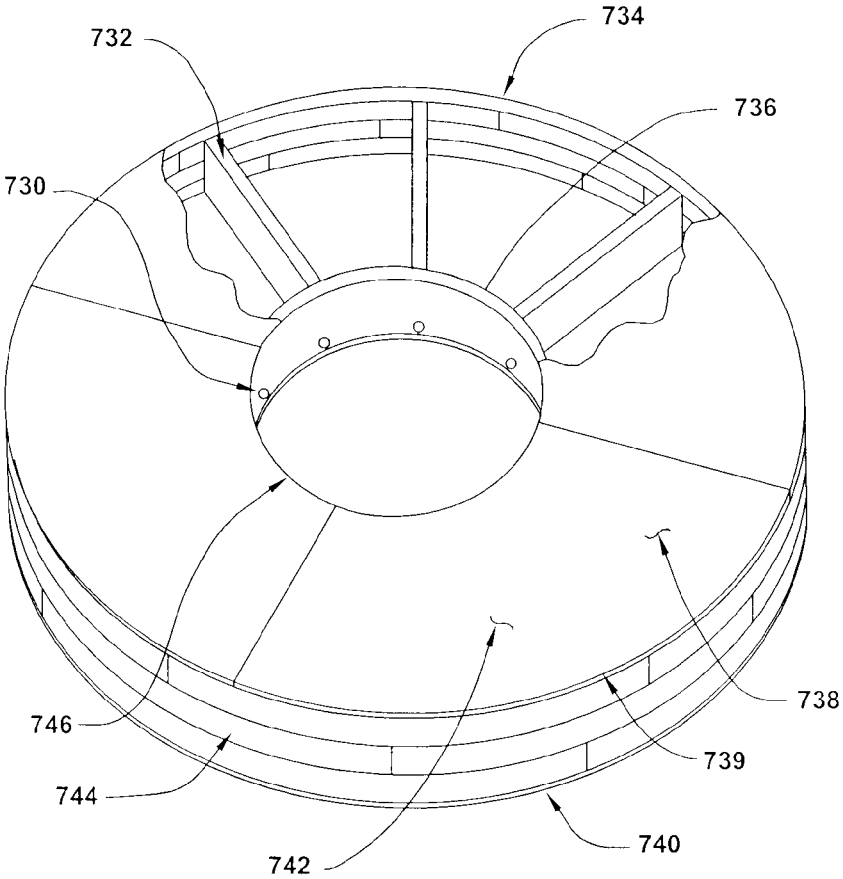
*Fig. 28.4*

FLOATING ABRADING PLATEN CONFIGURATION

CROSS REFERENCE TO RELATED APPLICATION

This invention is a continuation-in-part of U.S. patent application Ser. No. 13/267,305 filed Oct. 6, 2011 that discloses subject matter that is novel and unobvious over the technical field-related technology disclosed in U.S. patent application Ser. No. 13/207,871 filed Aug. 11, 2011 that is a continuation-in-part of U.S. patent application Ser. No. 12/807,802 filed Sep. 14, 2010 that is a continuation-in-part of U.S. patent application Ser. No. 12/799,841 filed May 3, 2010, which is in turn a continuation-in-part of the U.S. patent application Ser. No. 12/661,212 filed Mar. 12, 2010. These are each incorporated herein by reference in their entirety.

BACKGROUND OF THE INVENTION

Field of the Invention

The present invention relates to the field of abrasive treatment of surfaces such as grinding, polishing and lapping. In particular, the present invention relates to a high speed lapping system that provides simplicity, quality and efficiency to existing lapping technology using multiple floating platens.

Flat lapping of workpiece surfaces used to produce precision-flat and mirror smooth polished surfaces is required for many high-value parts such as semiconductor wafer and rotary seals. The accuracy of the lapping or abrading process is constantly increased as the workpiece performance, or process requirements, become more demanding. Workpiece feature tolerances for flatness accuracy, the amount of material removed, the absolute part-thickness and the smoothness of the polish become more progressively more difficult to achieve with existing abrading machines and abrading processes. In addition, it is necessary to reduce the processing costs without sacrificing performance. Also, it is highly desirable to eliminate the use of messy liquid abrasive slurries. Changing the abrading process set-up of most of the present abrading systems to accommodate different sized abrasive particles, different abrasive materials or to match abrasive disk features or the size of the abrasive disks to the workpiece sizes is typically tedious and difficult.

Fixed-Spindle-Floating-Platen System

The present invention relates to methods and devices for a single-sided lapping machine that is capable of producing ultra-thin semiconductor wafer workpieces at high abrading speeds. This is done by providing a flat surfaced granite machine base that is used for mounting three individual rigid flat-surfaced rotatable workpiece spindles. Flexible abrasive disks having annular bands of fixed-abrasive coated raised islands are attached to a rigid flat-surfaced rotary platen. The platen annular abrading surface floats in three-point abrading contact with flat surfaced workpieces that are mounted on the three equal-spaced flat-surfaced rotatable workpiece spindles. Water coolant is used with these raised island abrasive disks.

Presently, floating abrasive platens are used in double-sided lapping and double-sided micro-grinding (flat-honing) but the abrading speeds of both of these systems are very low. The upper floating platen used with these systems are positioned in conformal contact with multiple equal-thickness workpieces that are in flat contact with the flat abrading surface of a lower rotary platen. Both the upper and lower abrasive coated platens are typically concentric with each other and they are rotated independent of each other. Often the platens are rotated in opposite directions to minimize the net abrading forces that are applied to the workpieces that are sandwiched between the flat annular abrading surfaces of the two platens.

In order to compensate for the different abrading speeds that exist at the inner and outer radii of the annular band of abrasive that is present on the rotating platens, the workpieces are rotated. The speed of the rotated workpiece reduces the too-fast platen speed at the outer periphery of the platen and increases the too-slow speed at the inner periphery when the platen and the workpiece are both rotated in the same direction. However, if the upper abrasive platen and the lower abrasive platen are rotated in opposite directions, then rotation of the workpieces is favorable to the platen that is rotated in the same direction as the workpiece rotation and is unfavorable for the other platen that rotates in a direction that opposes the workpiece rotation direction. Here, the speed differential provided by the rotated workpiece acts against the abrading speed of the opposed rotation direction platen. Because the localized abrading speed represents the net speed difference between the workpieces and the platen, rotating them in opposite directions increases the localized abrading speeds to where it is too fast. Providing double-sided abrading where the upper and lower platens are rotated in opposed directions results over-speeding of the abrasive on one surface of a workpiece compared to an optimum abrading speed on the opposed workpiece surface.

In double-sided abrading, rotation of the workpieces is typically done with thin gear-driven planetary workholder disks that carry the individual workpieces while they are sandwiched between the two platens. Workpieces comprising semiconductor wafers are very thin so the planetary workholders must be even thinner to allow unimpeded abrading contact with both surfaces of the workpieces. The gear teeth on these thin workholder disks that are used to rotate the disks are very fragile, which prevents fast rotation of the workpieces. The resultant slow-rotation workpieces prevent fast abrading speeds of the abrasive platens. Also, because the workholder disks are fragile, the upper and lower platens are often rotated in opposite directions to minimize the net abrading forces on individual workpieces because a portion of this net workpiece abrading force is applied to the fragile disk-type workholders. It is not practical to abrade very thin workpieces with double-sided platen abrasive systems because the required very thin planetary workholder disks are so fragile.

Multiple workpieces are often abrasive slurry lapped using flat-surfaced single-sided platens that are coated with a layer of loose abrasive particles that are in a liquid mixture. Slurry lapping is very slow, and also, very messy.

The platen slurry abrasive surfaces also wear continually during the workpiece abrading action with the result that the platen abrasive surfaces become non-flat. Non-flat platen abrasive surfaces result in non-flat workpiece surfaces. These platen abrasive surfaces must be periodically reconditioned to provide flat workpieces. Conditioning rings are typically placed in abrading contact with the moving annular abrasive surface to re-establish the planar flatness of the platen annular band of abrasive.

In single-sided slurry lapping, a rigid rotating platen has a coating of abrasive in an annular band on its planar surface. Floating-type spherical-action workholder spindles hold individual workpieces in flat-surfaced abrading contact with the moving platen slurry abrasive with controlled abrading pressure.

The fixed-spindle-floating-platen abrading system has many unique features that allow it to provide flat-lapped precision-flat and smoothly-polished thin workpieces at very high abrading speeds. Here, the top flat surfaces of the individual spindles are aligned in a common plane where the flat surface of each spindle top is co-planar with each other. Each of the three rigid spindles is positioned with approximately equal spacing between them to form a triangle of spindles that provide three-point support of the rotary abrading platen. The rotational-centers of each of the spindles are positioned on the granite so that they are located at the radial center of the annular width of the precision-flat abrading platen surface. Equal-thickness flat-surfaced workpieces are attached to the flat-surfaced tops of each of the spindles. The rigid rotating floating-platen abrasive surface contacts all three rotating workpieces to perform single-sided abrading on the exposed surfaces of the workpieces. The fixed-spindle-floating platen system can be used at high abrading speeds with water cooling to produce precision-flat and mirror-smooth workpieces at very high production rates. There is no abrasive wear of the platen surface because it is protected by the attached flexible abrasive disks. Use of abrasive disks that have annular bands of abrasive coated raised islands prevents the common problem of hydroplaning of workpieces when contacting coolant water-wetted continuous-abrasive coatings. Hydroplaning of workpieces causes non-flat workpiece surfaces.

This abrading system can also be used to recondition the flat surface of the abrasive that is on the abrasive disk that is attached to the platen. A platen annular abrasive surface tends to experience uneven wear across the radial surface of the annular abrasive band after continued abrading contact with the flat surfaced workpieces. When the non-even wear of the abrasive surface becomes excessive and the abrasive can no longer provide precision-flat workpiece surfaces it must be reconditioned to re-establish its precision planar flatness. Reconditioning the platen abrasive surface can be easily accomplished with this fixed-spindle floating-platen system by attaching equal-thickness abrasive disks, or other abrasive devices such as abrasive coated conditioning rings, to the flat surfaces of the rotary spindle tops in place of the workpieces. Here, the platen annular abrasive surface reconditioning takes place by rotating the spindle abrasive disks, or conditioning rings, while they are in flat-surfaced abrading contact with the rotating platen abrasive annular band.

Also, the bare platen (no abrasive coating) annular abrading surface can be reconditioned with this fixed-spindle floating-platen system by attaching equal-thickness abrasive disks, or other abrasive devices such as abrasive coated conditioning rings, to the flat surfaces of the rotary spindle tops in place of the workpieces. Here, the platen annular abrading surface reconditioning takes place by rotating the spindle abrasive disks, or conditioning rings, while they are in flat-surfaced abrading contact with the rotating platen annular abrading surface. Most conventional platen abrading surfaces have original-condition flatness tolerances of 0.0001 inches (3 microns) that typically wear down into a non-flat condition during abrading operations to approximately 0.0006 inches (15 microns) before they are reconditioned to re-establish the original flatness variation of 0.0001 inches (3 microns).

Furthermore, the system can be used to recondition the flat surfaces of the spindles or the surfaces of workpiece carrier devices that are attached to the spindle tops by bringing an abrasive coated floating platen into abrading contact with the bare spindle tops, or into contact with the workpiece carrier devices that are attached to the spindle tops, while both the spindles and the platen are rotated.

This fixed-spindle-floating-platen system is particularly suited for flat-lapping large diameter semiconductor wafers. High-value large-sized workpieces such as 12 inch diameter (300 mm) semiconductor wafers can be attached with vacuum or by other means to ultra-precise flat-surfaced air bearing spindles for precision lapping of the wafers. Commercially available abrading machine components can be easily assembled to construct these lapper machines. Ultra-precise 12 inch diameter air bearing spindles can provide flat rotary mounting surfaces for flat wafer workpieces. These spindles typically provide spindle top flatness accuracy of 5 millionths of an inch (0.13 micron) (or less, if desired) during rotation. They are also very stiff for resisting abrading load deflections and can support loads of 900 lbs. A typical air bearing spindle having a stiffness of 4,000,000 lbs/inch is more resistant to deflections from abrading forces than a mechanical spindle having steel roller bearings.

The thicknesses of the workpieces can be measured during the abrading or lapping procedure by the use of laser, or other, measurement devices that can measure the workpiece thicknesses. These workpiece thickness measurements can be made by direct workpiece exposed-edge side measurements. They also can be made indirectly by measuring the location of the bottom position of the moving abrasive surface that makes contact with the workpiece surfaces as the abrasive surface location measurement is related to an established reference position.

Air bearing workpiece spindles can be replaced or extra units added as needed. These air bearing spindles are preferred because of their precision flatness of the spindle surfaces at all abrading speeds and their friction-free rotation. Commercial 12 inch (300 mm) diameter air bearing spindles that are suitable for high speed flat lapping are available from Nelson Air Corp, Milford, N.H. Air bearing spindles are preferred for high speed flat lapping but suitable rotary flat-surfaced spindles having conventional roller bearings can also be used.

Thick-section granite bases that have the required surface flatness accuracy, structural stiffness and dimensional stability to support these heavy air bearing spindles without distortion are also commercially available from numerous sources. Fluid passageways can be provided within the granite bases to allow the circulation of heat transfer fluids that thermally stabilize the bases. This machine base temperature control system provides long-term dimensional stability of the precision-flat granite bases and isolates them from changes in the ambient temperature changes in a production facility. Floating platens having precision-flat planar annular abrading surfaces can also be fabricated or readily purchased.

The flexible abrasive disks that are attached to the platen annular abrading surfaces typically have annular bands of fixed-abrasive coated rigid raised-island structures. There is insignificant elastic distortion of the individual raised islands through the thickness of the raised island structures or elastic distortion of the complete thickness of the raised island abrasive disks when they are subjected to typical abrading pressures. These abrasive disks must also be precisely uniform in thickness across the full annular abrading surface of the disk. This is necessary to assure that uniform abrading takes place over the full flat surface of the workpieces that are attached onto the top surfaces of each of the three spindles. The term "precisely" as used herein refers to within ±5 wavelengths planarity and within ±0.01 degrees of perpendicular or parallel, and precisely coplanar means within ±0.01 degrees of parallel, thickness or flatness variations of less than 0.0001 inches (3 microns) and with a standard deviation between planes that does not exceed ±20 microns.

During an abrading or lapping procedure, both the workpieces and the abrasive platens are rotated simultaneously. Once a floating platen "assumes" a position as it rests conformably upon workpieces attached to the spindle tops and the platen is supported by the three spindles, the planar abrasive surface of the platen retains this nominal platen alignment even as the floating platen is rotated. The three-point spindles are located with approximately equal spacing between them circumferentially around the platen and their rotational centers are in alignment with the radial centerline of the platen annular abrading surface. A controlled abrading pressure is applied by the abrasive platen to the equal-thickness workpieces that are attached to the three rotary workpiece spindles. Due to the evenly-spaced three-point support of the floating platen, the equal-sized workpieces attached to the spindle tops experience the same shared platen-imposed abrading forces and abrading pressures. Here, precision-flat and smoothly polished semiconductor wafer surfaces can be simultaneously produced at all three spindle stations by the fixed-spindle-floating platen abrading system.

Because the floating-platen and fixed-spindle abrading system is a single-sided process, very thin workpieces such as semiconductor wafers or flat-surfaced solar panels can be attached to the rotatable spindle tops by vacuum or other attachment means. To provide abrading of the opposite side of a workpiece, it is removed from the spindle, flipped over and abraded with the floating platen. This is a simple two-step procedure. Here, the rotating spindles provide a workpiece surface that is precisely co-planar with the opposed workpiece surface.

The spindles and the platens can be rotated at very high speeds, particularly with the use of precision-thickness raised-island abrasive disks. These abrading speeds can exceed 10,000 surface feet per minute (SFPM) or 3,048 surface meters per minute. The abrading pressures used here for flat lapping are very low because of the extraordinary high material removal rates of superabrasives (including diamond or cubic boron nitride (CBN)) when operated at very high abrading speeds. The abrading pressures are often less than 1 pound per square inch (0.07 kilogram per square cm) which is a small fraction of the abrading pressures commonly used in abrading. Flat honing (micro-grinding) uses extremely high abrading pressures which can result in substantial sub-surface damage of high value workpieces. The low abrading pressures used here result in highly desired low subsurface damage. In addition, low abrading pressures result in lapper machines that have considerably less weight and bulk than conventional abrading machines.

Use of a platen vacuum disk attachment system allows quick set-up changes where abrasive disks having different sizes of abrasive particles and different types of abrasive material can be quickly attached to the flat platen annular abrading surfaces. Changing the sized of the abrasive particles on all of the other abrading systems is slow and tedious. Also, the use of messy loose-abrasive slurries is avoided by using the fixed-abrasive disks.

A minimum of three evenly-spaced spindles are used to obtain the three-point support of the upper floating platen by contacting the spaced workpieces. However, additional spindles can be mounted between any two of the three spindles that form three-point support of the floating platen. Here all of the workpieces attached to the spindle-tops are in mutual flat abrading contact with the rotating platen abrasive.

Semiconductor wafers or other workpieces can be processed with a fully automated easy-to-operate process that is especially easy to incorporate into the fixed-spindle floating-platen lapping or abrading system. Here, individual semiconductor wafers, workpieces or workpiece carriers can be changed on all three spindles with a robotic arm extending through a convenient gap-opening between two adjacent stand-alone workpiece rotary spindles. Flexible abrasive disks can be changed on the platen by using a robotic arm extending through a convenient gap-opening between two adjacent stand-alone workpiece rotary spindles.

This three-point fixed-spindle-floating-platen abrading system can also be used for chemical mechanical planarization (CMP) abrading of semiconductor wafers that are attached to the spindle-tops by using liquid abrasive slurry and chemical mixtures with resilient backed pads that are attached to the floating platen. The system can also be used with CMP-type fixed-abrasive shallow-island abrasive disks that are backed with resilient support pads. These abrasive shallow-islands can either be mold-formed on the surface of flexible backings or the abrasive shallow-islands can be coated on the backings using gravure-type coating techniques.

This three-point fixed-spindle-floating-platen abrading system can also be used for slurry lapping of the workpieces that are attached to the rotary spindle-tops by applying a coating of liquid abrasive slurry to the abrading surface of the platen. Also, a flat-surfaced annular metal or other material disk can be attached to the platen abrading surface and a coating of liquid abrasive slurry can be applied to the flat abrading surface of the attached annular disk.

The system has the capability to resist large mechanical abrading forces that can be present with abrading processes while maintaining unprecedented rotatable workpiece spindle tops flatness accuracies and minimum mechanical flatness out-of-planar variations, even at very high abrading speeds. There is no abrasive wear of the flat surfaces of the spindle tops because the workpieces are firmly attached to the spindle tops and there is no motion of the workpieces relative to the spindle tops. Rotary abrading platens are inherently robust, structurally stiff and resistant to deflections and surface flatness distortions when they are subjected to substantial abrading forces. Because the system is comprised of robust components, it has a long production usage lifetime with little maintenance even in the harsh abrading environment present with most abrading processes. Air bearing spindles are not prone to failure or degradation and provide a flexible system that is quickly adapted to different polishing processes. Drip shields can be attached to the air bearing spindles to prevent abrasive debris from contaminating the spindle.

All of the precision-flat abrading processes presently in commercial lapping use typically have very slow abrading speeds of about 5 mph (8 kph). By comparison, the high speed flat lapping system operates at or above 100 mph (160 kph). This is a speed difference ratio of 20 to 1. Increasing abrading speeds increase the material removal rates. High abrading speeds result in high workpiece production rates and large cost savings.

To provide precision-flat workpiece surfaces, it is important to maintain the required flatness of annular band of fixed-abrasive coated raised islands during the full abrading life of an abrasive disk. This is done by selecting abrasive disks where the full surface of the abrasive is contacted by the workpiece surface. This results in uniform wear-down of the abrasive.

The many techniques already developed to maintain the abrasive surface flatness are also very effective for the fixed-spindle floating-platen lapping system. The primary technique is to use the abraded workpieces themselves to keep the abrasive flat during the lapping process. Here large workpieces (or small workpieces grouped together) are also rotated as they span the radial width of the rotating annular abrasive band. Another technique uses driven planetary workholders that move workpieces in constant orbital spiral path motions across the abrasive band width. Other techniques include the periodic use of annular abrasive coated conditioning rings to abrade the non-flat surfaces of the platen abrasive or the platen body abrading surface. These conditioning rings can be rotated while remaining at stationary positions. They also can be moved around the circumference of the platen while they are rotated by planetary circulation mechanism devices. Conditioning rings have been used for years to maintain the flatness of slurry platens that utilize loose abrasive particles. These same types of conditioning rings are also used to periodically re-flatten the fixed-abrasive continuous coated platens used in micro-grinding (flat-honing).

Workpieces are often rotated at rotational speeds that are approximately equal to the rotational speeds of the platens to provide approximately equal localized abrading speeds across the full radial width of the platen abrasive when the workpiece spindles are rotated in the same rotation direction as the platens.

Unlike slurry lapping, there is no abrasive wear of raised island abrasive disk platens because only the non-abrasive flexible disk backing surface contacts the platen surface. Here, the abrasive disk is firmly attached to the platen flat annular abrading surface. Also, the precision flatness of the high speed flat lapper abrasive surfaces can be completely re-established by simply and quickly replacing an abrasive disk having a non-flat abrasive surface with another abrasive disk that has a precision-flat abrasive surface.

Vacuum is used to quickly attach flexible abrasive disks, having different sized particles, different abrasive materials and different array patterns and styles of raised islands. Each flexible disk conforms to the precision-flat platen surface provide precision-flat planar abrading surfaces. Quick lapping process set-up changes can be made to process a wide variety of workpieces having different materials and shapes with application-selected raised island abrasive disks that are optimized for them individually. Small and medium diameter disks are very light in weight and have very little bulk thickness. They can be stored or shipped flat where individual disks lay in layers in flat contact with other companion disks. Large and very large raised island fixed-abrasive disks can be rolled and stored or shipped in polymer protective tubes. Abrasive disk and floating platens can have a wide range of abrading surface diameters that range from 2 inches (5 cm) to 72 inches (183 cm) or even much greater diameters. Abrasive disks that have non-island continuous coatings of abrasive material can also be used on the fixed-spindle floating-platen abrading system The abrasive disk quick change capability is especially desirable for laboratory lapping machines but it is also very useful for prototype lapping and for full-scale production lapping machines. This abrasive disk quick-change capability also provides a large advantage over micro-grinding (flat-honing) where it is necessary to change-out a worn heavy rigid platen or to replace it with one having different sized particles. Changing the non-flat fixed abrasive surface of a micro-grinding (flat-honing) thick abrasive wheel can not be done quickly because it is a bolted-on integral part of the rotating platen that supports it. Often, the abrasive particle sizes are sequentially changed from coarse to medium to fine during a flat lapping or abrading operation.

Hydroplaning of workpieces occurs when smooth abrasive surfaces, having a continuous thin-coated abrasive, are in fast-moving contact with a flat workpiece surface in the presence of surface water. However, hydroplaning does not occur when interrupted-surfaces, such as abrasive coated raised islands, contact a flat water-wetted workpiece surface. An analogy to the use of raised islands in the presence of coolant water films is the use of tread lugs on auto tires which are used on rain slicked roads. Tires with lugs grip the road at high speeds while bald smooth-surfaced tires hydroplane. In the same way, the abrasive coatings of the flat-surface tops of the raised islands remain in abrading contact with water-wetted flat-surfaced workpieces, even at very high abrading speeds.

A uniform thermal expansion and contraction of air bearing spindles occurs on all of the air bearing spindles mounted on the granite or other material machine bases when each of individual spindles are mounted with the same methods on the bases. The spindles can be mounted on spindle legs attached to the bottom of the spindles or the spindles can be mounted to legs that are attached to the upper portion of the spindle bodies and the length expansion or shrinkage of all of the spindles will be the same. This insures that precision abrading can be achieved with these fixed-spindle floating-platen abrading systems.

This invention references commonly assigned U.S. Pat. Nos. 5,910,041; 5,967,882; 5,993,298; 6,048,254; 6,102,777; 6,120,352; 6,149,506; 6,607,157; 6,752,700; 6,769,969; 7,632,434 and 7,520,800, commonly assigned U.S. patent application published numbers 20100003904; 20080299875 and 20050118939 and U.S. patent application Ser. Nos. 12/661,212, 12/799,841 and 12/807,802 and all contents of which are incorporated herein by reference.

U.S. Pat. No. 7,614,939 (Tolles et al) describes a CMP polishing machine that uses flexible pads where a conditioner device is used to maintain the abrading characteristic of the pad. Multiple CMP pad stations are used where each station has different sized abrasive particles. U.S. Pat. No. 4,593,495 (Kawakami et al) describes an abrading apparatus that uses planetary workholders. U.S. Pat. No. 4,918,870 (Torbert et al) describes a CMP wafer polishing apparatus where wafers are attached to wafer carriers using vacuum, wax and surface tension using wafer. U.S. Pat. No. 5,205,082 (Shendon et al) describes a CMP wafer polishing apparatus that uses a floating retainer ring. U.S. Pat. No. 6,506,105 (Kajiwara et al) describes a CMP wafer polishing apparatus that uses a CMP with a separate retaining ring and wafer pressure control to minimize over-polishing of wafer peripheral edges. U.S. Pat. No. 6,371,838 (Holzapfel) describes a CMP wafer polishing apparatus that has multiple wafer heads and pad conditioners where the wafers contact a pad attached to a rotating platen. U.S. Pat. No. 6,398,906 (Kobayashi et al) describes a wafer transfer and wafer polishing apparatus. U.S. Pat. No. 7,357,699 (Togawa et al) describes a wafer holding and polishing apparatus and where excessive rounding and polishing of the peripheral edge of wafers occurs. U.S. Pat. No. 7,276,446 (Robinson et al) describes a web-type fixed-abrasive CMP wafer polishing apparatus.

U.S. Pat. No. 6,786,810 (Muilenberg et al) describes a web-type fixed-abrasive CMP article. U.S. Pat. No. 5,014,486 (Ravipati et al) and U.S. Pat. No. 5,863,306 (Wei et al) describe a web-type fixed-abrasive article having shallow-islands of abrasive coated on a web backing using a rotogravure roll to deposit the abrasive islands on the web backing. U.S. Pat. No. 5,314,513 (Milleret al) describes the use of ceria for abrading.

U.S. Pat. No. 6,001,801 (Fujimori et al) describes an abrasive dressing tool that is used for abrading a rotatable CMP polishing pad that is attached to a rigidly mounted lower rotatable platen.

U.S. Pat. No. 6,077,153 (Fujita et al) describes a semiconductor wafer polishing machine where a polishing pad is attached to a rigid platen that rotates. The polishing pad is positioned to contact wafer-type workpieces that are attached to rotary workpiece spindles. These rotary workpiece spindles are mounted on a rigidly-mounted rotary platen. The rotatable abrasive polishing pad platen is rigidly mounted and travels along its rotation axis. However, it does not have a floating-platen action that allows the platen to have a spherical-action motion as it rotates. Because the workpiece spindles are mounted on a rotary platen they are not attached to a stationary machine base such as a granite base. Because of the configuration of the Fujita machine, it can not be used to provide a floating abrasive coated platen that allows the flat surface of the platen abrasive to be in floating conformal abrading contact with multiple workpieces that are attached to rotary workpiece spindles that are mounted on a rigid machine base.

U.S. Pat. No. 6,425,809 (Ichimura et al) describes a semiconductor wafer polishing machine where a polishing pad is attached to a rigid rotary platen. The polishing pad is in abrading contact with flat-surfaced wafer-type workpieces that are attached to rotary workpiece holders. These workpiece holders have a spherical-action universal joint. The universal joint allows the workpieces to conform to the surface of the platen-mounted abrasive polishing pad as the platen rotates. However, the spherical-action device is the workpiece holder and is not the rotary platen that holds the fixed abrasive disk.

U.S. Pat. No. 6,769,969 (Duescher) describes flexible abrasive disks that have annular bands of abrasive coated raised islands. These disks use fixed-abrasive particles for high speed flat lapping as compared with other lapping systems that use loose-abrasive liquid slurries. The flexible raised island abrasive disks are attached to the surface of a rotary platen to abrasively lap the surfaces of workpieces.

Various abrading machines and abrading processes are described in U.S. Pat. No. 5,364,655 (Nakamura et al). U.S. Pat. No. 5,569,062 (Karlsrud), U.S. Pat. No. 5,643,067 (Katsuoka et al), U.S. Pat. No. 5,769,697 (Nisho), U.S. Pat. No. 5,800,254 (Motley et al), U.S. Pat. No. 5,916,009 (Izumi et al), U.S. Pat. No. 5,964,651 (hose), U.S. Pat. No. 5,975,997 (Minami, U.S. Pat. No. 5,989,104 (Kim et al), U.S. Pat. No. 6,089,959 (Nagahashi, U.S. Pat. No. 6,165,056 (Hayashi et al), U.S. Pat. No. 6,168,506 (McJunken), U.S. Pat. No. 6,217,433 (Herrman et al), U.S. Pat. No. 6,439,965 (Ichino), U.S. Pat. No. 6,893,332 (Castor), U.S. Pat. No. 6,896,584 (Perlov et al), U.S. Pat. No. 6,899,603 (Homma et al), U.S. Pat. No. 6,935,013 (Markevitch et al), U.S. Pat. No. 7,001,251 (Doan et al), U.S. Pat. No. 7,008,303 (White et al), U.S. Pat. No. 7,014,535 (Custer et al), U.S. Pat. No. 7,029,380 (Horiguchi et al), U.S. Pat. No. 7,033,251 (Elledge), U.S. Pat. No. 7,044,838 (Maloney et al), U.S. Pat. No. 7,125,313 (Zelenski et al), U.S. Pat. No. 7,144,304 (Moore), U.S. Pat. No. 7,147,541 (Nagayama et al), U.S. Pat. No. 7,166,016 (Chen), U.S. Pat. No. 7,250,368 (Kida et al), U.S. Pat. No. 7,367,867 (Boller), U.S. Pat. No. 7,393,790 (Britt et al), U.S. Pat. No. 7,422,634 (Powell et al), U.S. Pat. No. 7,446,018 (Brogan et al), U.S. Pat. No. 7,456,106 (Koyata et al), U.S. Pat. No. 7,470,169 (Taniguchi et al), U.S. Pat. No. 7,491,342 (Kamiyama et al), U.S. Pat. No. 7,507,148 (Kitahashi et al), U.S. Pat. No. 7,527,722 (Sharan) and U.S. Pat. No. 7,582,221 (Netsu et al). All of the references cited herein are incorporated in their entirety herein.

SUMMARY OF THE INVENTION

The presently disclosed technology includes a fixed-spindle, floating-platen system which is a new configuration of a single-sided lapping machine system. This system is capable of producing ultra-flat thin semiconductor wafer workpieces at high abrading speeds. This can be done by providing a precision-flat, rigid (e.g., synthetic, composite or granite) machine base that is used as the planar mounting surface for at least three rigid flat-surfaced rotatable workpiece spindles. Precision-thickness flexible abrasive disks are attached to a rigid flat-surfaced rotary platen that floats in three-point abrading contact with the three equal-spaced flat-surfaced rotatable workpiece spindles. These abrasive coated raised island disks have disk thickness variations of less than 0.0001 inches (3 microns) across the full annular bands of abrasive-coated raised islands to allow flat-surfaced contact with workpieces at very high abrading speeds and to assure that all of the expensive diamond abrasive particles that are coated on the island are fully utilized during the abrading process. Use of a platen vacuum disk attachment system allows quick set-up changes where different sizes of abrasive particles and different types of abrasive material can be quickly attached to the flat platen surfaces.

Water coolant is used with these raised island abrasive disks, which allows them to be used at very high abrading speeds, often in excess of 10,000 SFPM (160 km per minute). The coolant water is typically applied directly to the top surfaces of the workpieces. The applied coolant water results in abrading debris being continually flushed from the abraded surface of the workpieces. Here, when the water-carried debris falls off the spindle top surfaces it is not carried along by the platen to contaminate and scratch the adjacent high-value workpieces, a process condition that occurs in double-sided abrading and with continuous-coated abrasive disks.

The fixed-spindle floating-platen flat lapping system has two primary planar references. One planar reference is the precision-flat annular abrading surface of the rotatable floating platen. The other planar reference is the precision co-planar alignment of the flat surfaces of the rotary spindle tops of the three workpiece spindles that provide three-point support of the floating platen.

Flat surfaced workpieces are attached to the spindle tops and are contacted by the abrasive coating on the platen abrading surface. Both the workpiece spindles and the abrasive coated platens are simultaneously rotated while the platen abrasive is in controlled abrading pressure contact with the exposed surfaces of the workpieces. Workpieces are sandwiched between the spindle tops and the floating platen. This lapping process is a single-sided workpiece abrading process. The opposite surfaces of the workpieces can be lapped by removing the workpieces from the spindle tops, flipping them over, attaching them to the spindle tops and abrading the second opposed workpiece surfaces with the platen abrasive.

A granite machine base provides a dimensionally stable platform upon which the three (or more) workpiece spindles are mounted. The spindles must be mounted where their spindle tops are precisely co-planar within 0.0001 inches (3 microns) in order to successfully perform high speed flat lapping. The rotary workpiece spindles must provide rotary spindle tops that remain precisely flat at all operating speeds. Also, the spindles must be structurally stiff to avoid deflections in reaction to static or dynamic abrading forces.

Air bearing spindles are the preferred choice over roller bearing spindles for high speed flat lapping. They are extremely stiff, can be operated at very high rotational speeds and are frictionless. Because the air bearing spindles have no friction, torque feedback signal data from the internal or external spindle drive motors can be used to determine the state-of-finish of lapped workpieces. Here, as workpieces become flatter and smoother, the water wetted adhesive bonding stiction between the flat surfaced workpieces and the flat-type abrasive media increase. The relationship between the state-of-finish of the workpieces and the adhesive stiction is a very predictable characteristic and can be readily used to control or terminate the flat lapping process.

Air bearing or mechanical roller bearing workpiece spindles having equal precision heights can be mounted on precisely flat granite bases to provide a system where the flat spindle tops are precisely co-planar with each other. These precision height spindles and precision flat granite bases are more expensive than commodity type spindles and granite bases. Commodity type air bearing spindles and non-precision flat granite bases can be utilized with the use of adjustable height legs that are attached to the bodies of the spindles. The flat surfaces of the spindle tops can be aligned to be precisely co-planar within the required 0.0001 inches (3 microns) with the use of a rotating leaser beam measurement device supplied by Hamar Laser Inc. of Danbury, Conn.

An alternative method that can be used to attach spindles to granite bases is to provide spherical-action mounts for each spindle. These spherical mounts allow each spindle top to be aligned to be co-planar with the other attached spindles. Workpiece spindles are attached to the rotor portion of the spherical mount that has a spherical-action rotation within a spherical base that has a matching spherical shaped contacting area. The spherical-action base is attached to the flat surface of a granite machine base. After the spindle tops are precisely aligned to be co-planar with each other, a mechanical or adhesive-based fastener device is used to fixture or lock the spherical mount rotor to the spherical mount base. Using these spherical-action mounts, the precision aligned workpiece spindles are structurally attached to the granite base.

Another very simple technique that can be used for co-planar alignment of the spindle-tops is to use the precision-flat surface of a floating platen annular abrading surface as a physical planar reference datum for the spindle tops. Platens must have precision flat surfaces where the flatness variation is less than 0.0001 inches (3 microns) in order to successfully perform high speed flat lapping. Here, the precision-flat platen is brought into flat surfaced contact with the spindle-tops where pressurized air or a liquid can be applied through fluid passageways to form a spherical-action fluid bearing that allows the spherical rotor to freely float without friction within the spherical base. This platen surface contacting action aligns the spindle-tops with the flat platen surface. By this platen-to-spindles contacting action, the spindle tops are also aligned to be co-planar with each other. After co-planar alignment of the spindle tops, vacuum can be applied through the fluid passageways to temporarily lock the spherical rotors to the spherical bases. Then, a mechanical fastener or an adhesive-based fastener device is used to fixture or lock the spherical mount rotor to the spherical mount base. When using an adhesive rotor locking system, an adhesive can be applied in a small gap between a removable bracket that is attached to the spherical rotor and a removable bracket that is attached to the spherical base to rigidly bond the spherical rotor to the spherical base after the adhesive is solidified. If it is desired to re-align the spindle top, the removable spherical mount rotor and spherical base adhesive brackets can be discarded and replaced with new individual brackets that can be adhesively bonded together to again lock the spherical mount rotors to the respective spherical bases.

The fixed-platen floating-spindle lapping system has the capability to resist large mechanical abrading forces present with abrading processes with unprecedented flatness accuracies and minimum mechanical planar flatness variations. Because the system is comprised of robust components it has a long lifetime with little maintenance even in the harsh abrading environment present with most abrading processes. Air bearing spindles are not prone to failure or degradation and provide a flexible system that is quickly adapted to different polishing processes.

Platen surfaces have patterns of vacuum port holes that extend under the abrasive annular portion of an abrasive disk to assure that the disk is firmly attached to the platen surface. When an abrasive disk is attached to a flat platen surface with vacuum, the vacuum applies in excess of 10 pound per square inch (0.7 kg per square cm) hold-down clamping forces to bond the flexible abrasive disk to the platen. Because the typical abrasive disks have such a large surface area, the total vacuum clamping forces can easily exceed thousands of pounds of force which results in the flexible abrasive disk becoming an integral part of the structurally stiff and heavy platen. Use of the vacuum disk attachment system assures that each disk is in full conformal contact with the platen flat surface. Also, each individual disk can be marked so that it can be remounted in the exact same tangential position on the platen by using the vacuum attachment system. Here, a disk that is "worn-in" to compensate for the flatness variation of a given platen will recapture the unique flatness characteristics of that platen position by orienting the disk and attaching it to the platen at its original platen circumference position. This abrasive disk will not have to be "worn-in" again upon reinstallation. Expensive diamond abrasive particles are sacrificed each time it is necessary to wear-in an abrasive disk to establish a precision flatness of the disk abrasive surface. The original surface-flatness of the abrasive disk is re-established by simply mounting the previously removed abrasive disk in the same circumferential location on the platen that it had before it was removed from that same platen The rotary platens that are used for this high speed lapping must be light in weight and low in mass inertia to allow fast acceleration and deceleration of the platens. Also, the platens must have a precision-flat abrading surface for the attachment of the flexible abrasive disks. Further, the platens must be rigid enough to maintain a precision flat surface when the platen is subjected to abrading forces. In addition, the platens must be dimensionally stable over long periods of time. The abrasive disk mounting surfaces on the platen must be wear resistant when subjected to the abrasive debris that is generated by the high speed lapping operations. Also, the platen vacuum port holes that are used to vacuum-attach the abrasive disks must be resistant to wear from the abrasive debris that is draw into these port holes when mounting the flexible abrasive disks on the platen by use of vacuum.

The use of cast aluminum materials that are adhesively bonded together provide very rigid platens that have precision-flat surfaces that are dimensionally stable over long periods of time. Use of hard coatings on the surfaces of the platens provides wear-resistant coatings that are easy to apply and to maintain. The platens are constructed using ribs that provide very substantial stiffness and yet are light in weight. These low mass inertia platens can to quickly accelerated to high speeds and decelerated with a minimum of rotational torque forces. Relatively small motors can be used to drive the platens.

Platens are constructed where the platen mass center is offset a very small distance from the center of rotation of the spherical-action bearings that support the platens. These spherical bearing devices allow the platen to be driven in a rotary direction but allow the platen to freely float when in abrading contact with workpieces mounted on three-point spaced air bearing rotary spindles. Minimizing this offset distance prevents platen out-of-balance forces from distorting the precision-flat contact of the moving platen abrasive when in high speed abrading contact with the flat-surfaced workpieces.

Lightweight platens also allow the use of lightweight lapper machine structures. The fixed-spindle floating platen lapper machine can be used with a pivot-balanced lapper machine configuration that provide very precise control of the very small abrading forces that are used in high speed flat lapping. The weight of this pivot-balanced lapper machine is typically only a small fraction of the weight of conventional lapping machine.

BRIEF DESCRIPTION OF THE DRAWING

FIG. 6.1 is a cross section view of a three-point attached floating-platen with a support rib.

FIG. 6.2 is a top view of a three-point attached floating-platen having a support rib.

FIG. 28.1 is a cross section view of an abrading platen having an anodized surface coating.

FIG. 28.2 is a cross section view of an abrading platen having a hardened bead coating.

FIG. 28.3 is a cross section view of an abrading platen having a external surface coating.

FIG. 28.4 is an isometric view of a very large high-speed rotary abrading platen.

FIG. 44 is an orthographic view of a portion of annular vacuum groove flat cover plate.

DETAILED DESCRIPTION OF THE INVENTION

Figure 1:
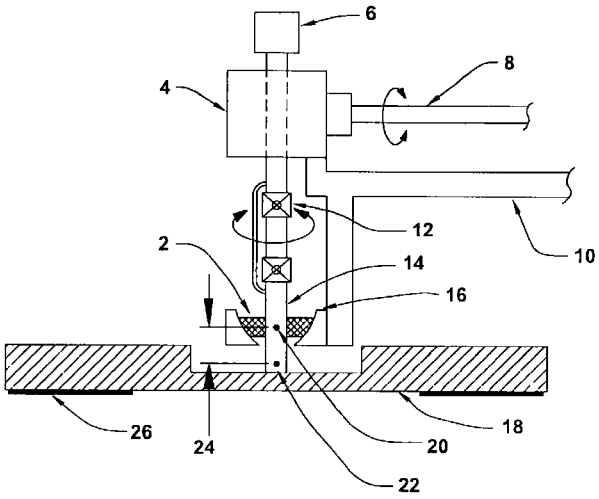
FIG. 1 is a cross section view of a floating-platen with an off-set center of gravity.

The fixed-spindle floating-platen lapping machines used for high speed flat lapping require very precisely controlled abrading forces that change during a flat lapping procedure. Very low abrading forces are used because of the extraordinarily high cut rates when diamond abrasive particles are used at very high abrading speeds. As per Preston's equation, high abrading pressures result in high material removal rates. The high cut rates are used initially with coarse abrasive particles to develop the flatness of the non-flat workpiece. Then, lower cut rates are used with medium or fine sized abrasive particles during the polishing portion of the flat lapping operation.

When the abrading forces are accurately controlled, the friction that is present in the lapper machine components can create large variations in the abrading forces that are generated by machine members. Here, even though the generated forces are accurate, these forces are either increased or decreased by machine element friction. Abrading forces that are not precisely accurate prevent successful high speed flat lapping. Also, the lapping machines must be robust to resist abrading forces without distortion of the machine members in a way that affects the flatness of the workpieces. Further, the machine must be light in weight, easy to use and tolerant of the harsh abrasive environment.

Pivot-Balance Floating-Platen Machine

The fixed-spindle floating-platen lapping machines used for high speed flat lapping require very precisely controlled abrading forces that change during a flat lapping procedure. Very low abrading forces are used because of the extraordinarily high cut rates when diamond abrasive particles are used at very high abrading speeds. As per Preston's equation, high abrading pressures result in high material removal rates. The high cut rates are used initially with coarse abrasive particles to develop the flatness of the non-flat workpiece. Then, lower cut rates are used with medium or fine sized abrasive particles during the polishing portion of the flat lapping operation.

When the abrading forces are accurately controlled, the friction that is present in the lapper machine components can create large variations in the abrading forces that are generated by machine members. Here, even though the generated forces are accurate, these forces are either increased or decreased by machine element friction. Abrading forces that are not precisely accurate prevent successful high speed flat lapping.

Also, the lapping machines must be robust to resist abrading forces without distortion of the machine members in a way that affects the flatness of the workpieces. Further, the machine must be light in weight, easy to use and tolerant of the harsh abrasive environment The pivot-balance floating-platen lapping machine provides these desirable features. The lapper machine components such as the platen drive motor are used to counterbalance the weight of the abrasive platen assembly. Low friction pivot bearings are used. The whole pivot frame can be raised or lowered from a machine base by an electric motor driven screw jack. Zero-friction air bearing cylinders can be used to apply the desired abrading forces to the platen as it is held in 3-point abrading contact with the workpieces attached to rotary spindles.

The air pressure applied to the air cylinder is typically provide by a UP (electrical current-to-pressure) pressure regulator that is activated by an abrading process controller. The actual force generated by the air cylinder can be sensed and verified by an electronic force sensor load cell that is attached to the piston end of the air cylinder. The force sensor allows feed-back type closed-loop control of the abrading pressure that is applied to the workpieces. Abrading pressures on the workpieces can be precisely changed throughout the lapping operation by the lapping process controller.

The spindles are attached to a dimensionally stable granite base. Spherical bearings allow the platen to freely float during the lapping operation. A right-angle gear box has a hollow drive shaft to provide vacuum to attach raised island abrasive disks to the platen. A set of two constant velocity universal joints attached to drive shafts allow the spherical motion of the rotating platen.

When the pivot balance is adjusted where the weight of the drive motor and hardware equals the weight of the platen and its hardware, then the pivot balance frame has a "tared" or "zero" balance condition. To accomplish this, a counterbalance weight can be moved along the pivot balance frame. Also, weighted mechanical screw devices can be easily adjusted to provide a true balance condition. Use of frictionless air bearings at the rotational axis of the pivot frame allows this precision balancing to take place.

Platen Center of Gravity Offset

Platens are constructed where the platen mass center is offset a very small distance from the center of rotation of the spherical-action bearings that support the platens. These spherical bearing devices allow the platen to be driven in a rotary direction but allow the platen to freely float when in abrading contact with workpieces mounted on three-point spaced air bearing rotary spindles. Minimizing this offset distance prevents platen out-of-balance forces from distorting the precision-flat contact of the moving platen abrasive when in high speed abrading contact with the flat-surfaced workpieces.

FIG. 1 is a cross section view of a pivot-balance floating-platen lapper machine where the center of gravity of the rotating platen is off-set from the center of spherical rotation of the platen spherical rotation device. The abrading platen 18 has an attached flexible abrasive disk 26 where the abrading platen 18 has a mass center 22 that has an off-set distance 24 that is less than 3 inches (7.6 cm) or preferred to be less than 2 inches (5 cm) and more preferred to be less than 1 inch (2.5 cm) and most preferred to be less than 0.5 inches (1.3 cm) and most highly preferred to be less than 0.25 inches (0.64 cm) from the center of spherical rotation 20 of the platen spherical rotation device 16.

The platen 18 has a platen rotation drive shaft 14 that is rotationally driven by a gearbox 4 with an universal joint 12. Vacuum is supplied to the platen 18 by a rotary union 6 and the gearbox 4 is attached to and supported by a pivot frame 10 where a platen drive motor (not shown) rotates a gearbox 4 input drive shaft 8. The platen spherical rotation bearing rotor 2 is supported by a platen spherical rotation bearing housing 16 that is supported by the pivot frame 10.

Brake Pad Platen Center of Gravity Offset

Figure 2:
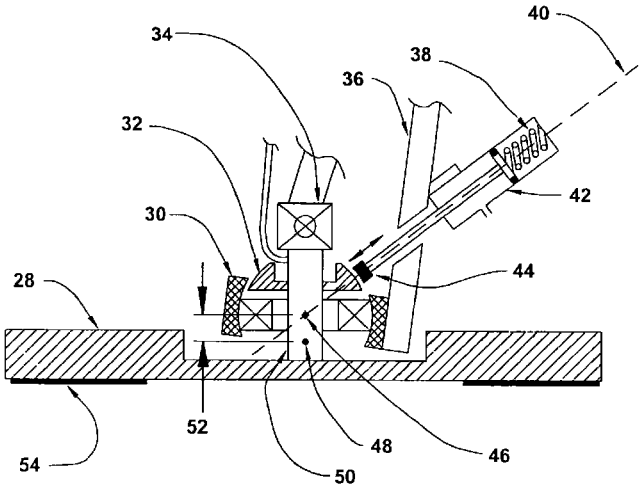
FIG. 2 is a cross section view of a floating-platen having a spherical-action brake.

FIG. 2 is a cross section view of a pivot-balance floating-platen lapper machine having a mechanical friction spherical brake where the center of gravity of the rotating platen is off-set from the center of spherical rotation of the platen spherical rotation device. The abrading platen 28 has an attached flexible abrasive disk 54 where the abrading platen 28 has a mass center 48 that has an off-set distance 52 that is less than 3 inches (7.6 cm) or preferred to be less than 2 inches (5 cm) and more preferred to be less than 1 inch (2.5 cm) and most preferred to be less than 0.5 inches (1.3 cm) and most highly preferred to be less than 0.25 inches (0.64 cm) from the center of spherical rotation 46 of the platen spherical rotation device 30.

The platen 28 has a platen rotation drive shaft 50 that is rotationally driven by a gearbox (not shown) with an universal joint 34. The platen spherical rotation bearing device 30 is supported by the pivot frame 36. The pivot frame 36 also supports a return-spring air cylinder drive device 42 that has a return spring 38 that forces a spherical-surfaced brake pad 44 against a spherical-surfaced rotor 32 that is attached to the platen 28 drive shaft 50 where the brake pad 44 is translated linearly along an axis 40 that intersects the center of spherical rotation 46 of the platen spherical rotation device 30.

Raised and Tilted Pivot Frame

When the pivot frame is raised by the electric actuator or by hydraulic cylinders, the floating platen can also be tilted by rotation of the pivot frame about the pivot frame rotation axis. Once the pivot frame is tilted, the frame can be locked in that tilted position with the use of a frame position hydraulic locking device. This hydraulic locking device allows hydraulic fluid to pass from one chamber of a linear piston-type cylinder to another chamber through by-pass tubing. By shutting a by-pass valve, hydraulic fluid can not pass from one chamber to another and the cylinder shaft is locked in position. During a lapping operation, the hydraulic locking device is deactivated to allow friction-free rotational motion of the pivot frame.

Figure 3:
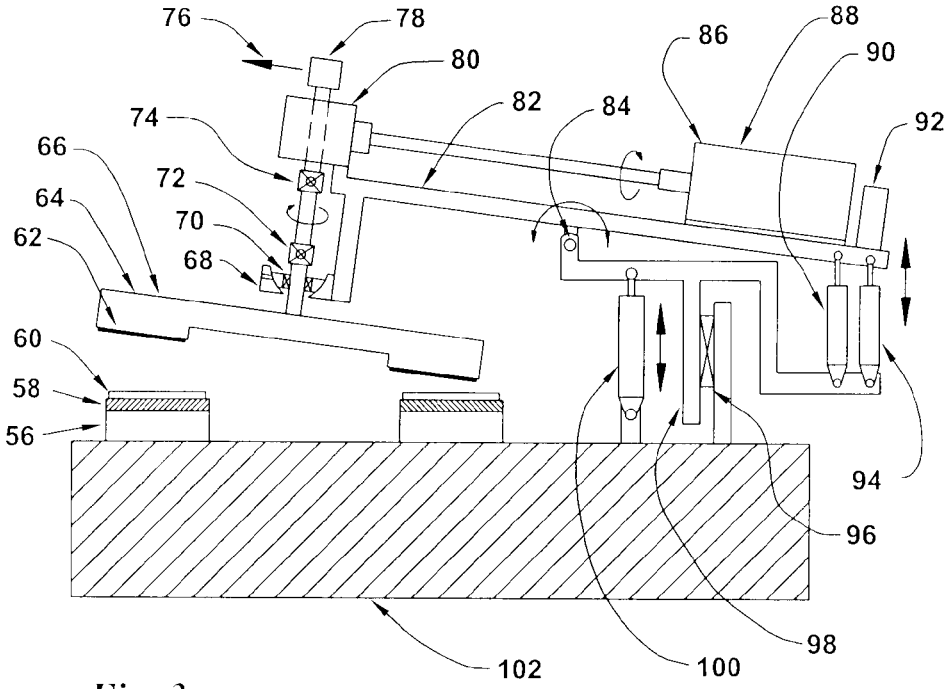
FIG. 3 is a cross section view of a raised and tilted pivot-balance floating-platen.

FIG. 3 is a cross section view of a raised and tilted pivot-balance floating-platen lapper machine. Here, the pivot frame is raised and rotated and the floating-platen is tilted away from a horizontal position. The pivot-balance floating-platen lapping machine 86 provides these desirable features. The lapper machine 86 components such as the platen drive motor 88 and a counterweight 92 are used to counterbalance the weight of the abrasive platen assembly 66 where the pivot frame 82 is balanced about the pivot frame 82 pivot center 84.

The pivot frame 82 has a rotation axis centered at the pivot frame pivot center 84 where the platen assembly 66 is attached at one end of the pivot frame 82 from the pivot center 84 and the platen motor 88 and a counterbalance weight 92 are attached to the pivot frame 82 at the opposed end of the pivot frame 82 from the pivot center 84. The pivot frame 82 has low friction rotary pivot bearings at the pivot center 84 where the pivot bearings can be frictionless air bearings or low friction roller bearings. The platen drive motor 88 is attached to the pivot frame 82 in a position where the weight of the platen drive motor 88 nominally or partially counterbalances the weight of the abrasive platen assembly 66. A movable and weight-adjustable counterweight 92 is attached to the pivot frame 82 in a position where the weight of the counterweight 92 partially counterbalances the weight of the abrasive platen assembly 66. The weight of the counterweight 92 is used together with the weight of the platen motor 88 to effectively counterbalance the weight of the abrasive platen assembly 66 that is also attached to the pivot frame 82. When the pivot frame 82 is counterbalanced, the pivot frame 82 pivots freely about the pivot center 84. The platen drive motor 88 rotates a drive shaft 23 that is coupled to the gear box 80 to rotate the gear box 80 hollow drive shaft.

The whole pivot frame 82 can be raised or lowered from a machine base 102 by a elevation frame 98 lift device 100 that can be an electric motor driven screw jack lift device or a hydraulic lift device. The elevation frame 98 lift device 100 can have a position sensor that can be used to precisely control the vertical position of the elevation frame 98. Zero-friction air bearing cylinders 94 can be used to apply the desired abrading forces to the platen 64 as it is held in 3-point abrading contact with the workpieces 60 attached to rotary spindles 90 having rotary spindle-tops 58. One end of one or more air bearing cylinders 94 can be attached to the pivot frame 82 at different positions to apply forces to the pivot frame 82 where these applied forces provide an abrading force to the platen 64. The support end of the air bearing cylinders 94 can also be attached to the elevation frame 98. The floating platen 64 has a spherical rotation and a cylindrical rotation that is provided by the spherical-action platen support bearing 70 that supports the weight of the floating platen 64 where the spherical-action platen support bearing 70 is supported by the pivot frame 82.

The air pressure applied to the air cylinder 94 is typically provide by an I/P (electrical current-to-pressure) pressure regulator (not shown) that is activated by an abrading process controller (not shown). The actual force generated by the air cylinder 94 can be sensed and verified by an electronic force sensor load cell that is attached to the cylinder rod end of the air cylinder 94. The force sensor allows feed-back type closed-loop control of the abrading pressure that is applied to the workpieces 60. Abrading pressures on the workpieces 60 can be precisely changed throughout the lapping operation by the lapping process controller.

The spindles 56 are attached to a dimensionally stable granite or epoxy-granite base 102. A spherical-action bearing 70 allows the platen 64 to freely float with a spherical action motion during the lapping operation. A right-angle gear box 80 has a hollow drive shaft to provide vacuum to attach raised island abrasive disks 62 to the platen 64. Vacuum 76 is applied to a rotary union 78 that allows rotation of the gear box 80 drive hollow shaft to route vacuum to the platen 64 through tubing or other passageway devices (not shown) where abrasive disks 62 can be attached to the platen 64 by vacuum. The spherical bearing 70 can be a roller bearing or an air bearing having an air passage 68 that allows pressurized air to be applied to create an air bearing effect or vacuum to be applied to lock the spherical bearing 70 rotor and housing components together. One or more conventional universal joints or plate-type universal joints or constant velocity universal joints or a set of two constant velocity universal joints 72, 74 attached to the drive shaft 15 allow the spherical motion of the rotating platen 64.

The pivot frame 82 can be rotated to desired positions and locked at the desired rotation position by use of a pivot frame locking device 90 that is attached to the pivot frame 82 and to the pivot frame 82 elevation frame 98. The pivot frame 82 can be raised or lowered to selected elevation positions by the electric motor screw jack 100 or by a hydraulic jack 100 that is attached to the machine base 102 and to the pivot frame 82 elevation frame 98 where the pivot frame 82 elevation frame 98 is supported by a translatable slide device 96 that is attached to the machine base 102.

Platen Reinforcing Support Ribs

To provide extra rigidity to the platen annular body, multiple platen support ribs can be attached to the platen where the multiple ribs extend to the annular center of the platen. Here, abrading forces that are applied by the pivot frame that supports the rotatable platen are transferred to the hub that surrounds the platen drive shaft. Portions of the applied abrading forces are then transferred to the center of the platen annular body by the very stiff platen support ribs. Without the multiple platen support ribs, the applied abrading forces are transferred through the thickness of the platen body. The platen support ribs minimize the out-of-plane distortion of the platen annular abrading surface.

It is critical that the applied abrading forces do not distort the platen annular body where the flatness variation of the platen abrading surface exceeds 0.0001 inches (3 microns) to successfully accomplish flat lapping of workpieces. The abrading forces are applied through the pivot frame that holds the stationary part of the spherical roller bearing. These abrading forces are typically just a fraction of the weight of the platen assembly. However, if the abrading forces do exceed the weight of the platen these abrading forces are transferred through the spherical roller bearing device.

Internal platen support ribs can be attached to the platen where these multiple radial ribs extend from the drive shaft hub to the annular center of the platen. These multiple ribs typically are equal in number to the external platen stiffening ribs and are attached to the platen at the same tangential locations as the internal platen stiffening ribs. Here, the adhesively attached platen support ribs and the respective radial platen stiffening ribs form continuous beam structures that are exceedingly stiff. Collectively, these radial rib structures, which are evenly distributed around the annular platen, can transfer large abrading forces without distorting the precision-flat platen abrading surface.

Here, abrading forces that are applied by the pivot frame that supports the rotatable platen are transferred to the hub that surrounds the platen drive shaft. Portions of the applied abrading forces are then transferred to the center of the platen annular body by the very stiff platen support ribs. Without the multiple platen support ribs, the applied abrading forces are transferred only through the thickness of the platen body. Use of non-rib platen annular bodies that have very thick cross-sections can also provide a radial stiffness equal to a platen having the external platen support ribs.

Figure 4:
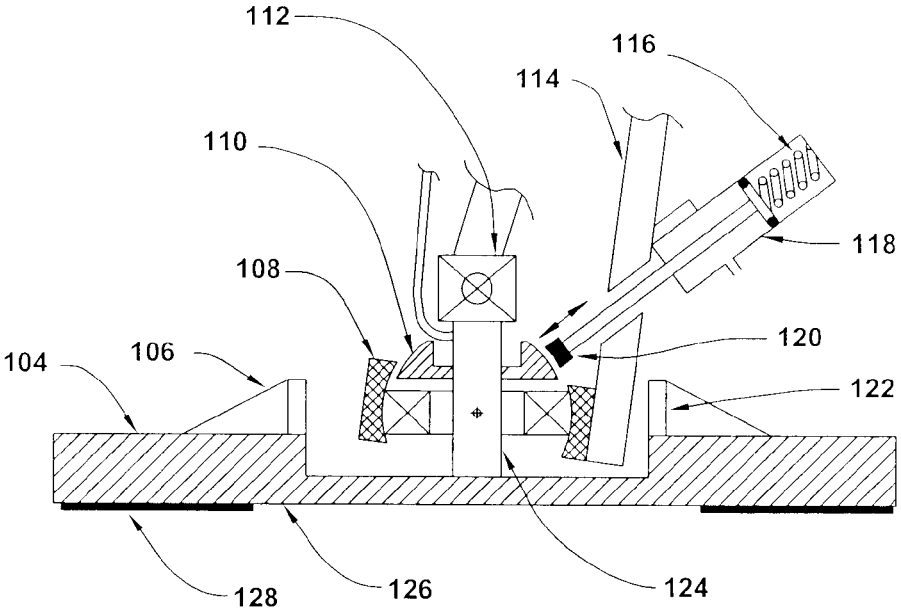
FIG. 4 is a cross section view of a floating-platen having structural support ribs.

FIG. 4 is a cross section view of a floating-platen having structural support ribs. The abrading platen 104 has an attached flexible abrasive disk 128 that is attached with vacuum to the flat annular surface 126 of the platen 104. The platen 104 has a platen rotation drive shaft 124 that is rotationally driven by a gearbox (not shown) with an universal joint 112. The platen spherical rotation bearing 108 is supported by the pivot frame 114. The pivot frame 114 also supports a return-spring air cylinder drive device 118 that has a return spring 116 that forces a spherical-surfaced brake pad 120 against a spherical-surfaced rotor 110 that is attached to the platen 104 drive shaft 124.

The platen 104 has multiple reinforcing radial ribs 106 that extend out radially from an annular platen 104 hub 122 where the reinforcing radial ribs 106 are positioned around the circumference of the platen 104. Abrading forces are applied by the platen spherical rotation bearing 108 and are transferred to the platen 104 annular hub 122 where the abrading forces are then transferred to the center of the platen 104 annular abrading area 126 by the reinforcing radial ribs 106. Use of the multiple reinforcing radial ribs 106 minimizes the distortion of the platen 104 body by the abrading forces where the precision-flat annular bottom abrading surface 126 of the platen 104 remains precisely flat. The precision-flat annular bottom abrading surface 126 of the platen 104 remains flat so that the abrasive surface of the abrasive disk 128 is held in flat-surfaced abrading contact with workpieces (not shown).

Rigid Platen External Annular Support Rib

A floating-platen can be made more rigid by use of an attached external annular rib. Use of the external annular support rib or other-shaped annular support ribs or multiple external annular support ribs that are integrally attached to the top surface of the annular platen provides very substantial circumferential rigidity to the platen and provides uniform distribution of the applied abrading forces across the radial width of the annular abrading platen. Also, the associated plated rotary platen drive hub is also very stiff structurally. Multiple platen attachment devices that are simple to use are evenly distributed around the circumference of the platen.

This particular platen attachment structure design provides a maximum of structural stiffness with a minimum of structure weight and rotational mass inertia. This allows the transmission of large torque forces that can quickly accelerate and decelerate the platens to and from their high rotational speeds. Providing quick platen speed-ups and platen braking times decreases the process time for high speed flat lapping of workpieces.

Figure 5:
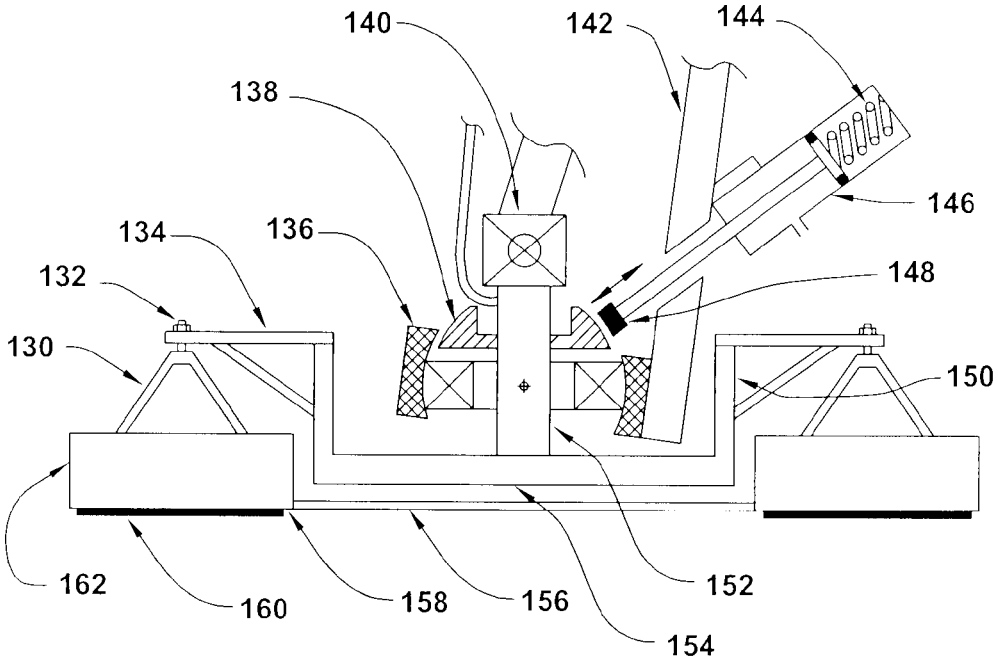
FIG. 5 is a cross section view of a floating-platen having an external annular support rib.

FIG. 5 is a cross section view of a floating-platen having an external annular support rib. Here, the annular body of the platen has an annular circumferential rib that has a V-shape where the annular rib provides structural stiffness to the platen across the radial width of the platen and also around the circumference of the platen annular body.

In addition, a flexible bellows-type device (not shown) can be used to provide a seal for the platen 162 device where abrasive debris generated by the abrasive lapping process does not contaminate the components of platen 162 lapping device. This platen 162 system is well suited for use in a harsh abrading environment.

The annular abrading platen 162 has an attached flexible abrasive disk 160 that is attached with vacuum to the flat annular surface 158 of the annular platen 162. The annular platen 162 has a platen rotation drive shaft 152 that is rotationally driven by a gearbox (not shown) using an universal joint 140. The annular platen 162 also has a platen circular drive base plate 154 that is attached to the platen rotation drive shaft 152. The annular platen 162 platen circular base plate 154 is also attached to a platen rotational drive annular hub 150 that is attached to an annular platen support plate 134 that is attached to an annular platen 162 annular reinforcing rib 130 by use of fastener-devices 132.

The annular platen 162 annular reinforcing rib 130 provides substantial circumferential rigidity to the annular platen 162 which provides assurance that the abrading forces that are applied by the platen drive shaft 152 are uniformly distributed around the circumference of the annular platen 162. Also, the annular platen 162 annular reinforcing rib 130 has a triangular cross-section shape that is positioned in the radial center of the annular platen 162 to provide that the applied abrading forces are uniformly distributed across the radial width of the annular platen 162. The annular platen 162 annular platen support structure 130 is attached to the top flat surface of the annular platen 162 where the annular platen support structure 130 extends around the circumference of the platen 162. A platen 162 cover plate 156 provides flat-surfaced support for the central area of the flexible abrasive disks 160 that are attached to the platen 162.

The platen spherical rotation bearing 136 is supported by the pivot frame 142. The pivot frame 142 also supports a return-spring air cylinder drive device 146 that has a return spring 144 that forces a spherical-surfaced brake pad 148 against a spherical-surfaced rotor 138 that is attached to the platen 162 drive shaft 152.

Abrading forces are applied by the platen spherical rotation bearing 136 and are transferred to the platen 162 annular hub 150 where the abrading forces are then transferred to the center of the platen 162 annular abrading area 158 by the annular reinforcing rib 130. Use of the annular reinforcing rib 130 minimizes the distortion of the platen 162 body by the abrading forces where the precision-flat annular bottom abrading surface 158 of the platen 162 remains precisely flat. The precision-flat annular bottom abrading surface 158 of the platen 162 remains flat so that the abrasive surface of the abrasive disk 160 is held in flat-surfaced abrading contact with workpieces (not shown).

Figure 6:
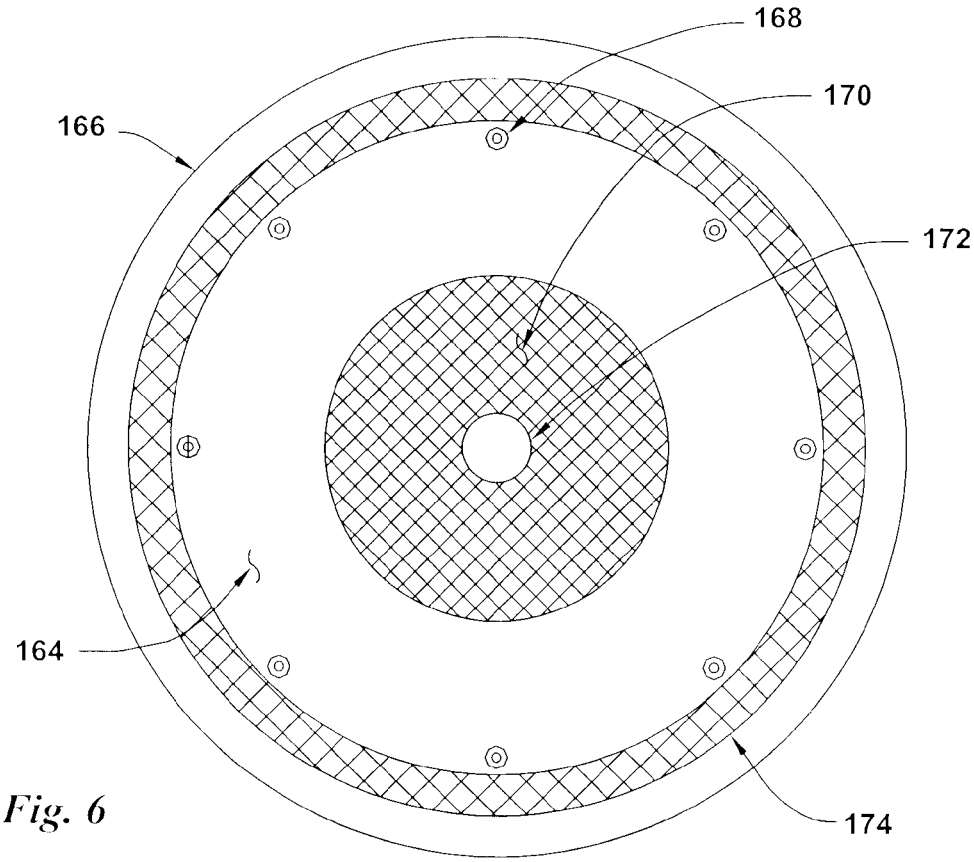
FIG. 6 is a top view of a floating-platen having an external annular support rib.

FIG. 6 is a top view of a floating-platen having an external annular support rib. A rotary platen 166 is driven in a rotational direction by a drive shaft 172 that is attached to a platen 166 platen circular base plate 170. The platen circular base plate 170 is also attached to a platen rotational drive annular hub (not shown) that is attached to an annular platen support plate 164. The annular platen support plate 164 is attached to an annular platen 166 annular reinforcing rib 174 by use of fastener-devices 168.

In another embodiment, the annular platen body can be supported by a three-point hub that extends from the platen drive shaft to the platen annular body. Use of the three-point hub that has three independent arms provides assurance that the platen annular body precision-flat abrading surface is not distorted if the three-point hub three independent arms are distorted by thermal stresses caused by temperature differentials between the arms or portions of the arms or rotary platen drive hub. Because of the high speed that the annular platen is rotated, there is a large convection heat transfer coefficient present on the outer exposed surface of the annular abrading platen. Here, this high convection coefficient, the rotating annular platen will tend to assume the same temperature as the ambient air surrounding the rotating abrading platen.

Also, because the platen typically is constructed from aluminum, which has very high thermal conductivity, any small temperature gradients within the aluminum annular platen structure will be diminished by the high thermal conductivity of the aluminum. The whole body of the rotating platen will tend to have a uniform temperature with the result that there will be little thermal distortion of the precision-flat platen abrading surface due to temperature gradients within the platen body.

The abrading forces that are applied to the abrading surface of the platen are imposed at the three points by the three-point hub arms that are attached to the rotary platen drive shaft. The V-shaped reinforcing annular rib that is attached integrally to the platen body is configured to be sufficiently stiff that the abrading forces that are imposed at the three support points by the three hub arms on the V-shaped reinforcing annular rib is uniformly distributed along the circumference of the platen to avoid localized circumferential and radial distortion of the platen precision-flat abrading surface.

FIG. 6.1 is a cross section view of a three-point attached floating-platen having an external annular support rib. Here, the annular body of the platen has an annular circumferential rib that has a V-shape where the annular rib provides structural stiffness to the platen across the radial width of the platen and also around the circumference of the platen annular body.

In addition, a flexible bellows-type device (not shown) can be used to provide a seal for the platen 175*n* device where abrasive debris generated by the abrasive lapping process does not contaminate the components of platen 175*n* lapping device. This platen 175*n* system is well suited for use in a harsh abrading environment.

The annular abrading platen 175*n* has an attached flexible abrasive disk 175*m* that is attached with vacuum to the flat annular surface 175*l* of the annular platen 175*n*. The annular platen 175*n* has a platen rotation drive shaft 175*f* that is rotationally driven. The annular platen 175*n* also has a platen circular drive base plate 175*j* that is attached to the platen rotation drive shaft 175*f*. The annular platen 175*n* platen circular base plate 175*j* is also attached to a platen rotational drive annular hub 175*h* that is attached to an annular platen support plate 175*c* that is attached to an annular platen 175*n* annular reinforcing rib 175*a* by use of fastener-devices 175*b*.

The annular platen 175*n* annular reinforcing rib 175*a* provides substantial circumferential rigidity to the annular platen 175*n* which provides assurance that the abrading forces that are applied by the platen drive shaft 175*f* are uniformly distributed around the circumference of the annular platen 175*n*. Also, the annular platen 175*n* annular reinforcing rib 175*a* has a triangular cross-section shape that is positioned in the radial center of the annular platen 175*n* to provide that the applied abrading forces are uniformly distributed across the radial width of the annular platen 175*n*. The annular platen 175*n* annular platen support structure 175*a* is attached to the top flat surface of the annular platen 175*n* where the annular platen support structure 175*a* extends around the circumference of the platen 175*n*. A platen 175*n* cover plate 175*k* provides flat-surfaced support for the central area of the flexible abrasive disks 175*m* that are attached to the platen 175*n*.

The platen spherical rotation bearing 175*d* having a spherical center of rotation 175*e* is supported by the pivot frame 175*g*. Abrading forces are applied by the platen spherical rotation bearing 175*d* and are transferred to the platen 175*n* annular hub 175*h* where the abrading forces are then transferred to the center of the platen 175*n* annular abrading area 175*l* by the annular reinforcing rib 175*a*. Use of the annular reinforcing rib 175*a* minimizes the distortion of the platen 175*n* body by the abrading forces where the precision-flat annular bottom abrading surface 175*l* of the platen 175*n* remains precisely flat. The precision-flat annular bottom abrading surface 175*l* of the platen 175*n* remains flat so that the abrasive surface of the abrasive disk 175*m* is held in flat-surfaced abrading contact with workpieces (not shown). The annular platen 175*n* has a platen center of mass 175*i*.

FIG. 6.2 is a top view of a three-point attached floating-platen having an external annular support rib. A rotary platen 175*q* is driven in a rotational direction by a drive shaft 175*x* that is attached to a platen 175*q* platen circular base plate 175*v*. The platen circular base plate 175*v* is also attached to a platen rotational drive annular hub (not shown) that is attached to an annular platen support plate 175*o*. The annular platen support plate 175*o* is attached to an annular platen 175*q* composite V-shaped annular reinforcing rib 175*r*, 175*t* having angled walls and a flat-surfaced top 175*s* by use of three equally spaced fastener-devices 175*u*. The annular platen 175*q* has a outer annular flat surface 175*p* and a inner annular flat surface 175*o*.

Raised Elevation Frame and Pivot Frames

The frame of the pivot-balance lapper is attached to a pair of linear slides where the frame can be raised with the use of a pair of electric jacks such as linear actuators. These actuators can provide closed-loop precision control of the position of the pivot frame and are well suited for long term use in a harsh abrading environment. When the pivot frame and floating platen are raised, workpieces can be changed and the abrasive disks that are attached to the platen can be easily changed. The platen is allowed to float with the use of a spherical-action platen shaft bearing.

Single or multiple friction-free air bearing air cylinders can be used to precisely control the abrading forces that are applied to the workpieces by the platen. These air cylinders are located at one end of the beam-balance pivot frame and the platen is located at the opposed end of the beam-balance pivot frame. Use of air bearings on the pivot frame pivot axis shaft eliminates any bearing friction. Cylindrical air bearings that are used on the pivot axis are available from New Way Air Bearing Company, Aston, Pa.

Any force that is applied by the air cylinders is directly transmitted across the length of the pivot frame to the platen because of the lack of pivot bearing friction. Other bearings such as needle bearings, roller bearings or fluid lubricated journal bearings can be used but all of these have more rotational friction than the air bearings. Air bearing cylinders such as the AirPel® cylinders from Airpot Corporation of Norwalk, Conn. can be selected where the cylinder diameter can provide the desired range of abrading forces.

Once the frictionless pivot frame is balanced, any force applied by the abrading force cylinders on one end of the pivot frame is directly transmitted to the platen abrasive surface that is located at the other end of this balance-beam apparatus. To provide a wide range of abrading forces, multiple air cylinders of different diameter sizes can be used in parallel with each other. Because the range of air pressure supplied to the cylinders has a typical limited range of from 0 to 100 psia with limited allowable incremental pressure control changes, it is difficult to provide the extra-precise abrading force load changes required for high speed flat lapping. Use of small-diameter cylinders provide very finely adjusted abrading forces because these small cylinders have nominal force capabilities.

The exact forces that are generated by the air cylinders can be very accurately determined with load cell force sensors. The output of these load cells can be used by feedback controller devices to dynamically adjust the abrading forces on the platen abrasive throughout the lapping procedure. This abrading force control system can even be programmed to automatically change the applied-force cylinder forces to compensate for the very small weight loss experienced by an abrasive disk during a specific lapping operation. Also, the weight variation of "new" abrasive disks that are attached to a platen to provide different sized abrasive particles can be predetermined. Then the abrading force control system can be used to compensate for this abrasive disk weight change from the previous abrasive disk and provide the exact desired abrading force on the platen abrasive.

The abrading force feedback controller provides an electrical current input to an air pressure regulator referred to as an I/P (current to pressure) controller. The abrading force controller has the capability to change the pressures that are independently supplied to each of the parallel abrading force air cylinders. The actual force produced by each independently controlled air cylinder is determined by a respected force sensor load cell to close the feedback loop.

Figure 7:
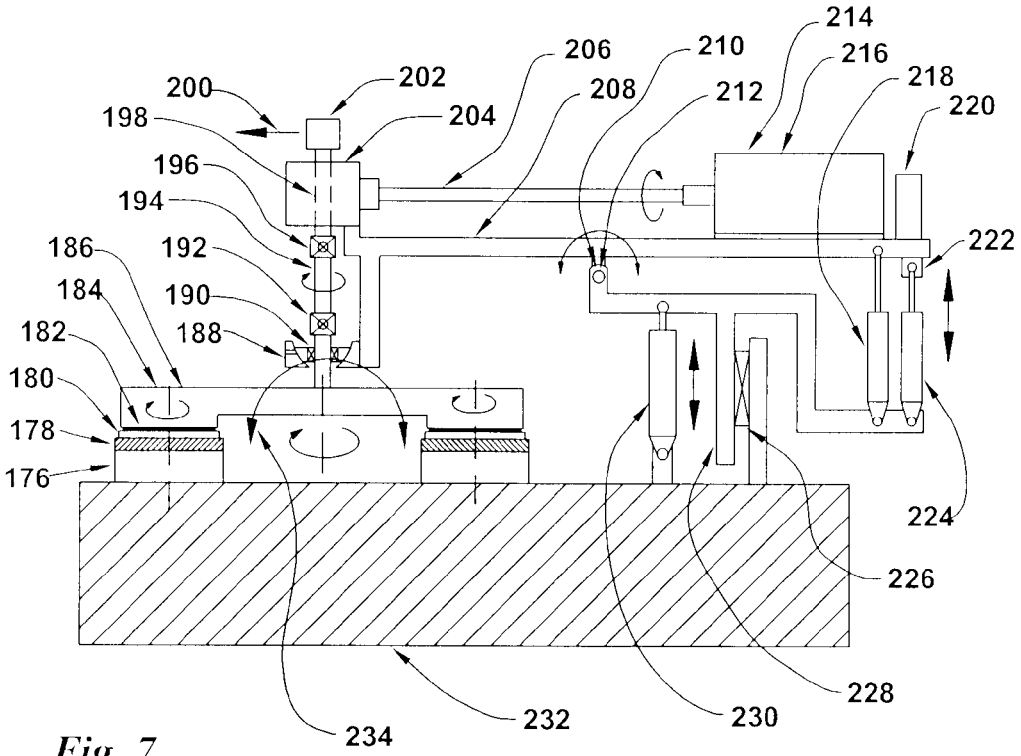
FIG. 7 is a cross section view of a pivot-balance floating-platen lapper machine.

FIG. 7 is a cross section view of a pivot-balance floating-platen lapper machine. The pivot-balance floating-platen lapping machine 214 provides these desirable features. The lapper machine 214 components such as the platen drive motor 216 and a counterweight 220 are used to counterbalance the weight of the abrasive platen assembly 186 where the pivot frame 208 is balanced about the pivot frame 208 pivot center 210. A right-angle gear box 204 has a hollow drive shaft to provide vacuum to attach raised island abrasive disks 182 to the platen 184. The spherical bearing 190 having a spherical rotation 234 can be a roller bearing or an air bearing having an air passage 188 that allows pressurized air to be applied to create an air bearing effect or vacuum to be applied to lock the spherical bearing 190 rotor and housing components together. One or more conventional universal joints or plate-type universal joints or constant velocity universal joints or a set of two constant velocity universal joints 192, 196 attached to the drive shaft 194 allow the spherical rotation and cylindrical rotation motion of the rotating platen 184.

The pivot frame 208 has a rotation axis centered at the pivot frame pivot center 210 where the platen assembly 186 is attached at one end of the pivot frame 208 from the pivot center 210 and the platen motor 216 and a counterbalance weight 220 are attached to the pivot frame 208 at the opposed end of the pivot frame 208 from the pivot center 210. The pivot frame 208 has low friction rotary pivot bearings 212 at the pivot center 210 where the pivot bearings 212 can be frictionless air bearings or low friction roller bearings. The platen drive motor 216 is attached to the pivot frame 208 in a position where the weight of the platen drive motor 216 nominally or partially counterbalances the weight of the abrasive platen assembly 186. A movable and weight-adjustable counterweight 220 is attached to the pivot frame 208 in a position where the weight of the counterweight 220 partially counterbalances the weight of the abrasive platen assembly 186.

The weight of the counterweight 220 is used together with the weight of the platen motor 216 to effectively counterbalance the weight of the abrasive platen assembly 186 that is also attached to the pivot frame 208. When the pivot frame 208 is counterbalanced, the pivot frame 208 pivots freely about the pivot center 210. The platen drive motor 216 rotates a drive shaft 206 that is coupled to the gear box 204 to rotate the gear box 204 hollow drive shaft 198. Vacuum 200 is applied to a rotary union 202 that allows rotation of the gear box 204 drive hollow shaft 198 to route vacuum to the platen 184 through tubing or other passageway devices (not shown) where abrasive disks 182 can be attached to the platen 184 by vacuum. The pivot frame 208 can be rotated to desired positions and locked at the desired rotation position by use of a pivot frame locking device 218 that is attached to the pivot frame 208 and to the pivot frame 208 elevation frame 228. Zero-friction air bearing cylinders 224 can be used to apply the desired abrading forces to the platen 184 as it is held in 3-point abrading contact with the workpieces 180 attached to rotary spindles 176 having rotary spindle-tops 178.

The whole pivot frame 208 can be raised or lowered from a machine base 232 by a elevation frame 228 lift device 230 that can be an electric motor driven screw jack lift device or a hydraulic lift device. The elevation frame 228 lift device 230 is attached to a linear slide 226 that is attached to the machine base 232 and also is attached to the elevation lift frame 228 where the elevation lift frame 228 lift device 230 can have a position sensor (not shown) that can be used to precisely control the vertical position of the elevation frame 228. Zero-friction air bearing cylinders 224 can be used to apply the desired abrading forces to the platen 184 as it is held in 3-point abrading contact with the workpieces 180 attached to rotary spindles 176 having rotary spindle-tops 178. One end of one or more air bearing cylinders 224 can be attached to the pivot frame 208 at different positions to apply forces to the pivot frame 208 where these applied forces provide an abrading force to the platen 184. The support end of the air bearing cylinders can be attached to the elevation frame 228.

Figure 8:
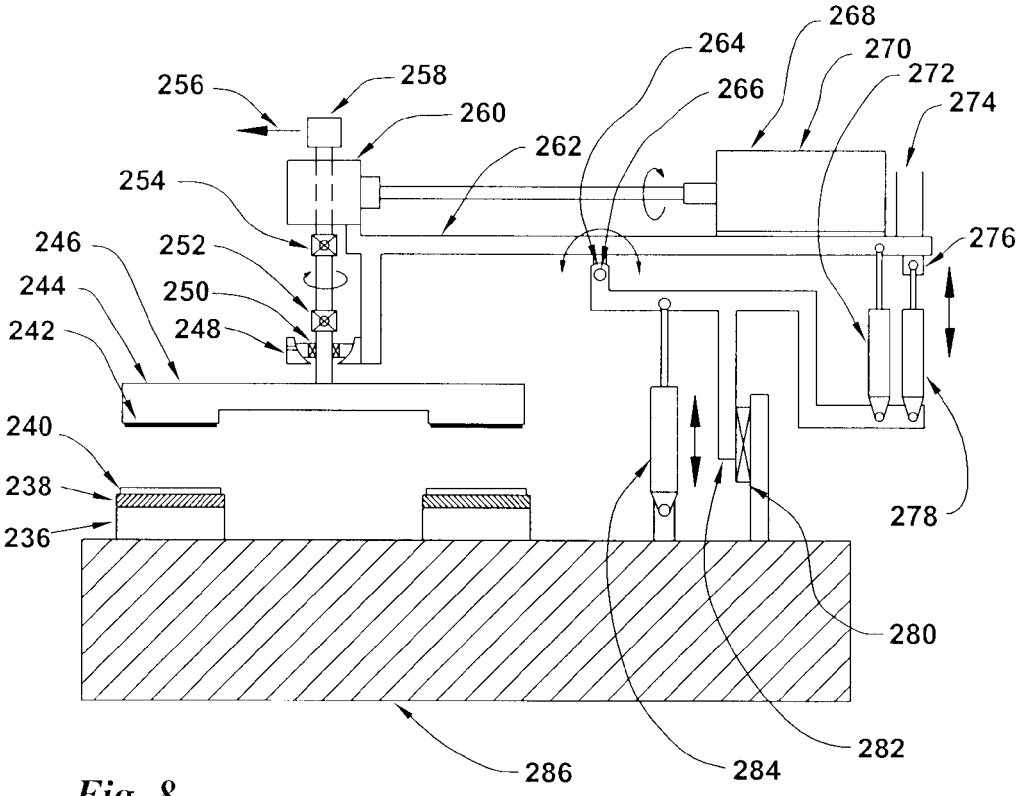
FIG. 8 is a cross section view of a raised pivot-balance floating-platen lapper machine.

FIG. 8 is a cross section view of a raised pivot-balance floating-platen lapper machine. Here, the pivot frame is raised up to allow workpieces and abrasive disks to be changed. The pivot-balance floating-platen lapping machine 268 provides these desirable features. The lapper machine 268 components such as the platen drive motor 270 and a counterweight 274 are used to counterbalance the weight of the abrasive platen assembly 246 where the pivot frame 262 is balanced about the pivot frame 262 pivot center 264.

The pivot frame 262 has a rotation axis centered at the pivot frame pivot center 264 where the platen assembly 246 is attached at one end of the pivot frame 262 from the pivot center 264 and the platen motor 270 and a counterbalance weight 274 are attached to the pivot frame 262 at the opposed end of the pivot frame 262 from the pivot center 264. The pivot frame 262 has low friction rotary pivot bearings 266 at the pivot center 264 where the pivot bearings 266 can be frictionless air bearings or low friction roller bearings. The platen drive motor 270 is attached to the pivot frame 262 in a position where the weight of the platen drive motor 270 nominally or partially counterbalances the weight of the abrasive platen assembly 246. A movable and weight-adjustable counterweight 274 is attached to the pivot frame 262 in a position where the weight of the counterweight 274 partially counterbalances the weight of the abrasive platen assembly 246. The weight of the counterweight 274 is used together with the weight of the platen motor 270 to effectively counterbalance the weight of the abrasive platen assembly 246 that is also attached to the pivot frame 262. When the pivot frame 262 is counterbalanced, the pivot frame 262 pivots freely about the pivot center 264. The platen drive motor 270 rotates a drive shaft 206 that is coupled to the gear box 260 to rotate the gear box 260 hollow drive shaft.

The whole pivot frame 262 can be raised or lowered from a machine base 286 by a elevation frame 282 lift device 284 that can be an electric motor driven screw jack lift device or a hydraulic lift device. The elevation frame 282 lift device 284 can have a position sensor that can be used to precisely control the vertical position of the elevation frame 282. Zero-friction air bearing cylinders 278 can be used to apply the desired abrading forces to the platen 244 as it is held in 3-point abrading contact with the workpieces 240 attached to rotary spindles 236 having rotary spindle-tops 238. One end of one or more air bearing cylinders 278 can be attached to the pivot frame 262 at different positions to apply forces to the pivot frame 262 where these applied forces provide an abrading force to the platen 244. The support end of the air bearing cylinders 278 can also be attached to the elevation frame 282. The floating platen 244 has a spherical rotation and a cylindrical that is provided by the spherical-action platen support bearing 250 that supports the weight of the floating platen 244 where the spherical-action platen support bearing 250 is supported by the pivot frame 262.

The air pressure applied to the air cylinder 278 is typically provide by an I/P (electrical current-to-pressure) pressure regulator (not shown) that is activated by an abrading process controller (not shown). The actual force generated by the air cylinder 278 can be sensed and verified by an electronic force sensor load cell 276 that is attached to the cylinder rod end of the air cylinder 278. The force sensor 276 allows feed-back type closed-loop control of the abrading pressure that is applied to the workpieces 240. Abrading pressures on the workpieces 240 can be precisely changed throughout the lapping operation by the lapping process controller.

The spindles 236 are attached to a dimensionally stable granite or epoxy-granite base 286. A spherical-action bearing 250 allows the platen 244 to freely float with a spherical action motion during the lapping operation. A right-angle gear box 260 has a hollow drive shaft to provide vacuum to attach raised island abrasive disks 242 to the platen 244. Vacuum 256 is applied to a rotary union 258 that allows rotation of the gear box 260 drive hollow shaft to route vacuum to the platen 244 through tubing or other passageway devices (not shown) where abrasive disks 242 can be attached to the platen 244 by vacuum. The spherical bearing 250 can be a roller bearing or an air bearing having an air passage 248 that allows pressurized air to be applied to create an air bearing effect or vacuum to be applied to lock the spherical bearing 250 rotor and housing components together. One or more conventional universal joints or plate-type universal joints or constant velocity universal joints or a set of two constant velocity universal joints 252, 254 attached to the drive shaft allow the spherical rotation and cylindrical rotation motion of the rotating platen 244.

The pivot frame 262 can be rotated to desired positions and locked at the desired rotation position by use of a pivot frame locking device 272 that is attached to the pivot frame 262 and to the pivot frame 262 elevation frame 282. The pivot frame 262 can be raised or lowered to selected elevation positions by the electric motor screw jack 284 or by a hydraulic jack 284 that is attached to the machine base 286 and to the pivot frame 262 elevation frame 282 where the pivot frame 262 elevation frame 282 is supported by a translatable slide device 280 that is attached to the machine base 286.

Pivot-Balance Platen Spherical Rotation

When the pivot frame is raised by the pair of electric actuators (or by hydraulic cylinders) and tilted, the floating platen can also be rotated back into a horizontal position because of the use of a spherical-action platen shaft bearing. The drive shafts that are used to rotate the platen are connected with constant velocity universal joints to the platen drive shaft and to the gear box drive shaft. These universal joints allow the floating platen to have a spherical rotation while rotational power is supplied by the drive shafts to rotate the platen. The constant velocity universal joints are sealed and are well suited for use in a harsh abrading environment. If desired, the platen can be rotated at very low speeds while the pivot frame is tilted and the platen is tilted back where the abrading surface is nominally horizontal.

Figure 9:
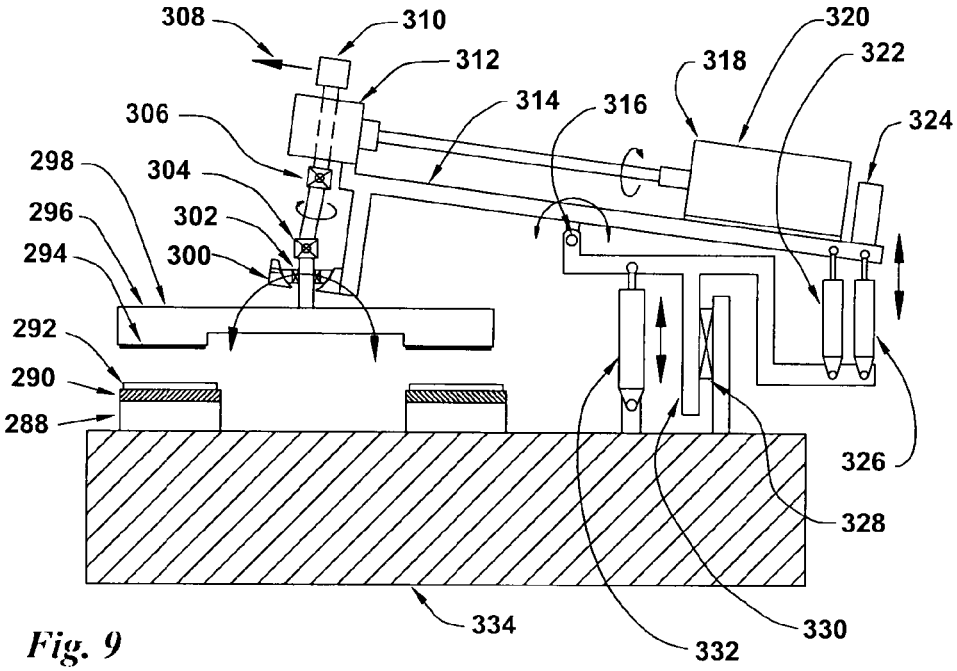
FIG. 9 is a cross section view of a raised floating-platen lapper with a horizontal platen.

FIG. 9 is a cross section view of a raised pivot-balance floating-platen lapper machine with a horizontal platen. Here, the pivot frame is raised and rotated and the floating-platen is rotated back to a nominally horizontal position. The pivot-balance floating-platen lapping machine 318 provides these desirable features. The lapper machine 318 components such as the platen drive motor 320 and a counterweight 324 are used to counterbalance the weight of the abrasive platen assembly 298 where the pivot frame 314 is balanced about the pivot frame 314 pivot center 316. Vacuum 308 is applied to a rotary union 310 that allows rotation of the gear box 312 drive hollow shaft to route vacuum 308 to the platen 296 through tubing or other passageway devices (not shown) where abrasive disks 294 can be attached to the platen 296 by vacuum.

The pivot frame 314 has a rotation axis centered at the pivot frame pivot center 316 where the platen assembly 298 is attached at one end of the pivot frame 314 from the pivot center 316 and the platen motor 320 and a counterbalance weight 324 are attached to the pivot frame 314 at the opposed end of the pivot frame 314 from the pivot center 316. The pivot frame 314 has low friction rotary pivot bearings at the pivot center 316 where the pivot bearings can be frictionless air bearings or low friction roller bearings. The platen drive motor 320 is attached to the pivot frame 314 in a position where the weight of the platen drive motor 320 nominally or partially counterbalances the weight of the abrasive platen assembly 298. A movable and weight-adjustable counterweight 324 is attached to the pivot frame 314 in a position where the weight of the counterweight 324 partially counterbalances the weight of the abrasive platen assembly 298. The weight of the counterweight 324 is used together with the weight of the platen motor 320 to effectively counterbalance the weight of the abrasive platen assembly 298 that is also attached to the pivot frame 314. When the pivot frame 314 is counterbalanced, the pivot frame 314 pivots freely about the pivot center 316. The platen drive motor 320 rotates a drive shaft 23 that is coupled to the gear box 312 to rotate the gear box 312 hollow drive shaft.

The whole pivot frame 314 can be raised or lowered from a machine base 334 by a elevation frame 330 lift device 332 that can be an electric motor driven screw jack lift device or a hydraulic lift device. The elevation frame 330 lift device 332 can have a position sensor that can be used to precisely control the vertical position of the elevation frame 330. Zero-friction air bearing cylinders 326 can be used to apply the desired abrading forces to the platen 296 as it is held in 3-point abrading contact with the workpieces 292 attached to rotary spindles 288 having rotary spindle-tops 290. One end of one or more air bearing cylinders 326 can be attached to the pivot frame 314 at different positions to apply forces to the pivot frame 314 where these applied forces provide an abrading force to the platen 296. The support end of the air bearing cylinders 326 can also be attached to the elevation frame 330. The floating platen 296 has a spherical rotation and a cylindrical rotation that is provided by the spherical-action platen support bearing 302 that supports the weight of the floating platen 296 where the spherical-action platen support bearing 302 is supported by the pivot frame 314.

The air pressure applied to the air cylinder 326 is typically provide by an I/P (electrical current-to-pressure) pressure regulator (not shown) that is activated by an abrading process controller (not shown). The actual force generated by the air cylinder 326 can be sensed and verified by an electronic force sensor load cell that is attached to the cylinder rod end of the air cylinder 326. The force sensor allows feed-back type closed-loop control of the abrading pressure that is applied to the workpieces 292. Abrading pressures on the workpieces 292 can be precisely changed throughout the lapping operation by the lapping process controller.

The spindles 288 are attached to a dimensionally stable granite or epoxy-granite base 334. A spherical-action bearing 302 allows the platen 296 to freely float with a spherical action motion during the lapping operation. A right-angle gear box 158 has a hollow drive shaft to provide vacuum to attach raised island abrasive disks 294 to the platen 296. Vacuum 308 is applied to a rotary union 310 that allows rotation of the gear box 312 drive hollow shaft to route vacuum 308 to the platen 296 through tubing or other passageway devices (not shown) where abrasive disks 294 can be attached to the platen 296 by vacuum. The spherical bearing 302 can be a spherical roller bearing or an air bearing having an air passage 300 that allows pressurized air to be applied to create an air bearing effect or vacuum to be applied to lock the spherical bearing 302 rotor and housing components together. One or more conventional universal joints or plate-type universal joints or constant velocity universal joints or a set of two constant velocity universal joints 304, 306 attached to the drive shaft allow the spherical rotation motion and the cylindrical rotation motion of the rotating platen 296 that rotates the abrasive disk 294 when the abrasive disk 294 is in abrading contact with workpieces 292.

The pivot frame 314 can be rotated to desired positions and locked at the desired rotation position by use of a pivot frame locking device 322 that is attached to the pivot frame 314 and to the pivot frame 314 elevation frame 330. The pivot frame 314 can be raised or lowered to selected elevation positions by the electric motor screw jack 332 or by a hydraulic jack 332 that is attached to the machine base 334 and to the pivot frame 314 elevation frame 330 where the pivot frame 314 elevation frame 330 is supported by a translatable slide device 328 that is attached to the machine base 334.

Pivot-Balance Lapper Frame

A top view of the pivot-balance lapping machine shows how this lightweight framework and platen assembly has widespread support members that provide unusual stiffness to the abrading system. The two primary supports of the pivot frame are the two linear slides that have a very wide stance by being positioned at the outboard sides of the rigid granite base. The two precision-type heavy-duty sealed pivot frame linear slides have roller bearings that provide great structural rigidity for the abrasive platen as the platen rotates during the lapping operation.

Very low friction pivot bearings are used on the pivot shaft to minimize the pivot shaft friction as the pivot frame rotates. Because this pivot shaft friction is so low, the exact abrading force that is generated by the pivot abrading force air cylinder is transmitted to the abrading platen during the lapping operation. Cylindrical air bearings can provide zero-friction rotation of the pivot frame support shaft even when the pivot frame and platen system is quite heavy.

Figure 10:
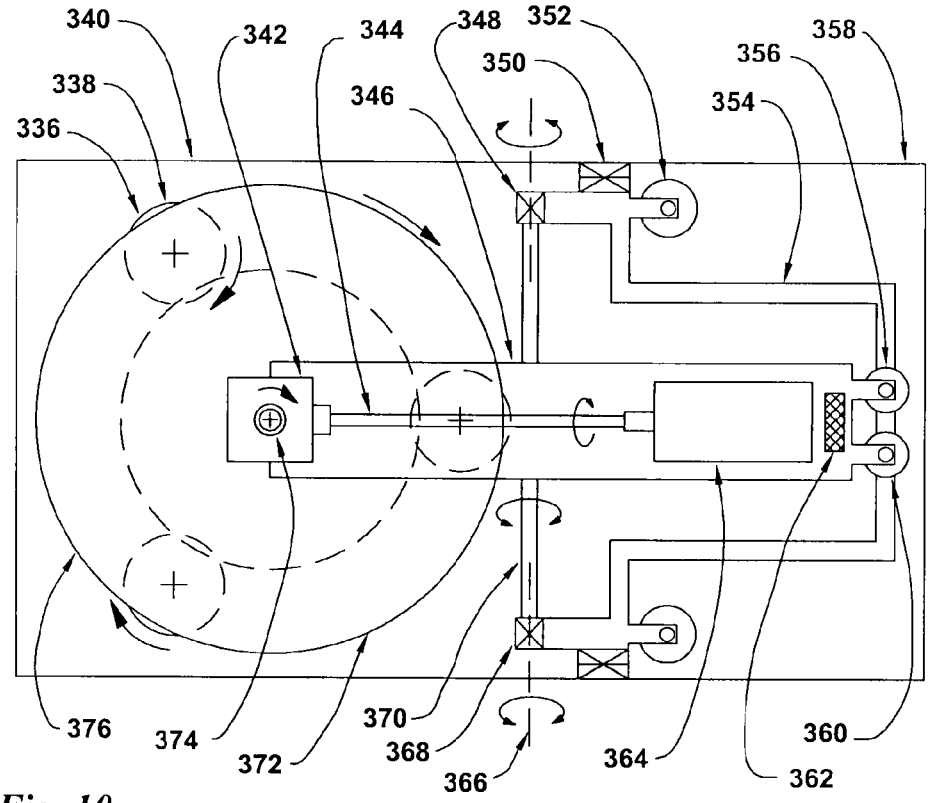
FIG. 10 is a top view of a pivot-balance floating-platen lapper machine.

FIG. 10 is a top view of a pivot-balance floating-platen lapper machine. The pivot-balance floating-platen lapping machine 340 components include the platen drive motor 364 and a counterweight 362 are that are used to counterbalance the weight of the abrasive platen assembly 372 where the pivot frame 346 is balanced about the pivot frame 346 pivot center 348 rotation axis 366.

The pivot frame 346 has a rotation axis 366 centered at the pivot frame pivot center 348 where the platen assembly 372 is attached at one end of the pivot frame 346 from the pivot axis 366 and the platen motor 364 and a counterbalance weight 362 are attached to the pivot frame 346 at the opposed end of the pivot frame 346 from the pivot axis 366. The pivot frame 346 has low friction rotary pivot bearings 368 at the pivot center 348 where the pivot bearings 368 can be frictionless air bearings or low friction roller bearings. The radial stiffness of these pivot frame 346 air bears 368 are typically much stiffer than equivalent roller bearings 368. The platen drive motor 364 is attached to the pivot frame 346 in a position where the weight of the platen drive motor 364 nominally or partially counterbalances the weight of the abrasive platen assembly 372. A movable and weight-adjustable counterweight 362 is attached to the pivot frame 346 in a position where the weight of the counterweight 362 partially counterbalances the weight of the abrasive platen assembly 372. The weight of the counterweight 362 is used together with the weight of the platen motor 364 to effectively counterbalance the weight of the abrasive platen assembly 372 that is also attached to the pivot frame 346. When the pivot frame 346 is counterbalanced, the pivot frame 346 pivots freely about the pivot axis 366. The platen drive motor 364 rotates a drive shaft 344 that is coupled to the gearbox 342 to rotate the gearbox 342 hollow abrading platen 376 rotary drive shaft 374.

The whole pivot frame 346 can be raised or lowered from a machine base 358 by a elevation frame 354 lift device 352 that can be an electric motor driven screw jack lift device or a hydraulic lift device. The elevation frame 354 lift device 352 is attached to a linear slide 350 that is attached to the machine base 358 and also is attached to the elevation lift frame 354 where the elevation lift frame 354 lift device 352 can have a position sensor (not shown) that can be used to precisely control the vertical position of the elevation lift frame 354.

The elevation frame 354 can be raised with the use of an elevation frame 354 lift devices 352 such as a pair of electric jacks such as a linear actuator produced by Exlar Corporation, Minneapolis, Minn. These linear actuators can provide closed-loop precision control of the position of the elevation frame 354 and are well suited for long term use in a harsh abrading environment. When the elevation frame 354 and the pivot frame 346 and the abrasive platen assembly 372 and the floating platen 376 are raised, workpieces can be changed and the abrasive disks (not shown) that are attached to the platen can be easily changed. Here the floating platen 376 is allowed to have a spherical motion floatation and cylindrical rotation with the use of a spherical-action platen shaft bearing (not shown that rotates the abrasive disk when the abrasive disk is in abrading contact with workpieces (not shown).

Zero-friction air bearing cylinders 356 can be used to apply the desired abrading forces to the platen 376 as it is held in 3-point abrading contact with the workpieces 336 attached to rotary spindles 338 having rotary spindle-tops. One end of one or more air bearing cylinders 356 can be attached to the pivot frame 346 at different positions to apply forces to the pivot frame 346 where these applied forces provide an abrading force to the platen 376. The support end of the air bearing cylinders 356 can be attached to the elevation frame 354. A pivot frame 346 locking device 360 is attached both to the pivot frame 346 locking and the elevation frame 354.

The top view of the pivot-balance lapping machine 340 shows how this lightweight framework and platen assembly has widespread support members that provide unusual stiffness to the abrading system. The two primary supports of the pivot frame are the two linear slides 350 that have a very wide stance by being positioned at the outboard sides of the rigid granite, epoxy-granite, cast iron or steel machine base 358. The two precision-type heavy-duty sealed pivot frame machine tool type linear slides 350 have roller bearings that provide great structural rigidity for the lapping machine 340 and particularly for the abrasive platen 376 when the platen 376 is rotated during the lapping operation.

Very low friction pivot bearings 368 are used on the pivot shaft 370 to minimize the pivot shaft 370 friction as the pivot frame 346 rotates. Because this pivot shaft 370 friction is so low, the abrading force that is generated by the pivot abrading force air cylinder 356 is transmitted without friction-distortion to the abrading platen 376 during the lapping operation. Cylindrical air bearings 368 can provide zero-friction rotation of the pivot frame 346 support shaft 370 even when the pivot frame 346 and platen assembly 372 is quite heavy.

The pivot-balance floating-platen lapping machine 340 is an elegantly simple abrading machine that provides extraordinary precision control of abrading forces for this abrasive high speed flat lapping system. All of its components are all robust and are well suited for operation in a harsh abrading atmosphere with minimal maintenance.

Fixed-Spindles Floating-Platen

Figure 11:
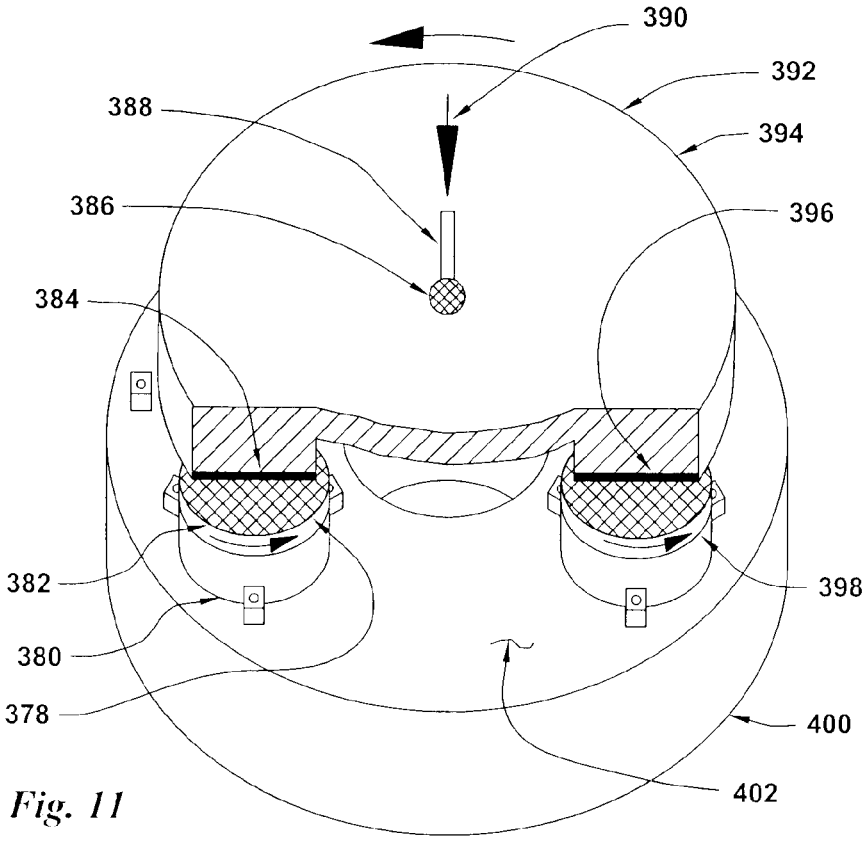
FIG. 11 is an isometric view of an abrading system having fixed-position spindles.

FIG. 11 is an isometric view of an abrading system having three-point fixed-position rotating workpiece spindles supporting a floating rotating abrasive platen. Three evenly-spaced rotatable spindles 380 (one not shown) having rotating tops 398 that have attached workpieces 382 support a floating abrasive platen 392. The platen 392 has a vacuum, or other, abrasive disk attachment device (not shown) that is used to attach an annular abrasive disk 396 to the precision-flat platen 392 abrasive-disk mounting surface 384. The abrasive disk 396 is in flat abrasive surface contact with all three of the workpieces 382. The rotating floating platen 392 is driven through a spherical-action universal-joint type of device 386 having a platen drive shaft 540 to which is applied an abrasive contact force 390 to control the abrading pressure applied to the workpieces 382. The workpiece rotary spindles 380 are mounted on a granite, or other material, base 400 that has a flat surface 402. The three workpiece spindles 380 have spindle top surfaces that are co-planar. The workpiece spindles 380 can be interchanged or a new workpiece spindle 380 can be changed with an existing spindle 380 where the flat top surfaces of the spindles 380 are co-planar. Here, the equal-thickness workpieces 382 are in the same plane and are abraded uniformly across each individual workpiece 382 surface by the platen 392 precision-flat planar abrasive disk 396 abrading surface. The planar abrading surface 384 of the floating platen 392 is approximately co-planar with the flat surface 402 of the granite base 400.

The spindle 380 rotating surfaces spindle tops 398 can driven by different techniques comprising spindle 380 internal spindle shafts (not shown), external spindle 380 flexible drive belts (not shown) and spindle 380 internal drive motors (not shown). The individual spindle 380 spindle tops 398 can be driven independently in both rotation directions and at a wide range of rotation speeds including very high speeds of 10,000 surface feet per minute (3,048 meters per minute). Typically the spindles 380 are air bearing spindles that are very stiff to maintain high rigidity against abrading forces and they have very low friction and can operate at very high rotational speeds. Suitable roller bearing spindles can also be used in place of air bearing spindles.

Abrasive disks (not shown) can be attached to the spindle 380 spindle tops 398 to abrade the platen 392 annular flat surface 384 by rotating the spindle tops 398 while the platen 392 flat surface 384 is positioned in abrading contact with the spindle abrasive disks that are rotated in selected directions and at selected rotational speeds when the platen 392 is rotated at selected speeds and selected rotation direction when applying a controlled abrading force 390. The top surfaces 378 of the individual three-point spindle 380 rotating spindle tops 398 can be also be abraded by the platen 392 planar abrasive disk 396 by placing the platen 392 and the abrasive disk 396 in flat conformal contact with the top surfaces 378 of the workpiece spindles 380 as both the platen 392 and the spindle tops 398 are rotated in selected directions when an abrading pressure force 390 is applied. The top surfaces 378 of the spindles 380 abraded by the platen 392 results in all of the spindle 380 top surfaces 378 being in a common plane.

The granite base 400 is known to provide a time-stable precision-flat surface 402 to which the precision-flat three-point spindles 380 can be mounted. One unique capability provided by this abrading system 394 is that the primary datum-reference can be the fixed-position granite base 400 flat surface 402. Here, spindles 380 can all have the precisely equal heights where they are mounted on a precision-flat surface 402 of a granite base 400 where the flat surfaces 378 of the spindle tops 398 are co-planar with each other.

When the abrading system is initially assembled it can provide extremely flat abrading workpiece 382 spindle 380 top 398 mounting surfaces and extremely flat platen 392 abrading surfaces 384. The extreme flatness accuracy of the abrading system 394 provides the capability of abrading ultra-thin and large-diameter and high-value workpieces 382, such as semiconductor wafers, at very high abrading speeds with a fully automated workpiece 382 robotic device (not shown).

In addition, the system 394 can provide unprecedented system 394 component flatness and workpiece abrading accuracy by using the system 394 components to "abrasively dress" other of these same-machine system 394 critical components such as the spindle tops 398 and the platen 392 planar-surface 384. These spindle top 398 and the platen 392 annular planar surface 384 component dressing actions can be alternatively repeated on each other to progressively bring the system 394 critical components comprising the spindle tops 398 and the platen 392 planar-surface 384 into a higher state of operational flatness perfection than existed when the system 394 was initially assembled. This system 394 self-dressing process is simple, easy to do and can be done as often as desired to reestablish the precision flatness of the system 394 component or to improve their flatness for specific abrading operations.

This single-sided abrading system 394 self-enhancement surface-flattening process is unique among conventional floating-platen abrasive systems. Other abrading systems use floating platens but these systems are typically double-sided abrading systems. These other systems comprise slurry lapping and micro-grinding (flat-honing) systems that have rigid bearing-supported rotated lower abrasive coated platens. They also have equal-thickness flat-surfaced workpieces in flat contact with the annular abrasive surfaces of the lower platens. The floating upper platen annular abrasive surface is in abrading contact with these multiple workpieces where these multiple workpieces support the upper floating platen as it is rotated. The result is that the floating platens of these other floating platen systems are supported by a single-item moving-reference device, the rotating lower platen.

Large diameter rotating lower platens that are typically used for double-sided slurry lapping and micro-grinding (flat-honing) often have substantial abrasive-surface out-of-plane variations. These undesired abrading surface variations are due to many causes comprising: relatively compliant (non-stiff) platen support bearings that transmit or magnify bearing dimension variations to the outboard tangential abrading surfaces of the lower platen abrasive surface; radial and tangential out-of-plane variations in the large platen surface; time-dependent platen material creep distortions; abrading machine operating-temperature variations that result in expansion or shrinkage distortion of the lower platen surface; and the constant wear-down of the lower platen abrading surface by abrading contact with the workpieces that are in moving abrading contact with the lower platen abrasive surface. The single-sided abrading system 394 is completely different than the double-sided system (not-shown).

The floating platen 392 system 394 performance is based on supporting a floating abrasive platen 392 on the top surfaces 378 of three-point spaced fixed-position rotary workpiece spindles 380 that are mounted on a stable machine base 400 flat surface 402 where the top surfaces 378 of the spindles 380 are precisely located in a common plane. The top surfaces 378 of the spindles 380 can be approximately or substantially co-planar with the precision-flat surface 402 of a rigid fixed-position granite, or other material, base 400 or the top surfaces 378 of the spindles 380 can be precisely co-planar with the precision-flat surface 402 of a rigid fixed-position granite, or other material, base 400. The three-point support is required to provide a stable support for the floating platen 392 as rigid components, in general, only contact each other at three points. As an option, additional spindles 380 can be added to the system 394 by attaching them to the granite base 400 at locations between the original three spindles 380.

This three-point workpiece spindle abrading system 394 can also be used for abrasive slurry lapping (not shown), for micro-grinding (flat-honing) (not shown) and also for chemical mechanical planarization (CMP) (not shown) abrading to provide ultra-flat abraded workpieces 382.

Figure 12:
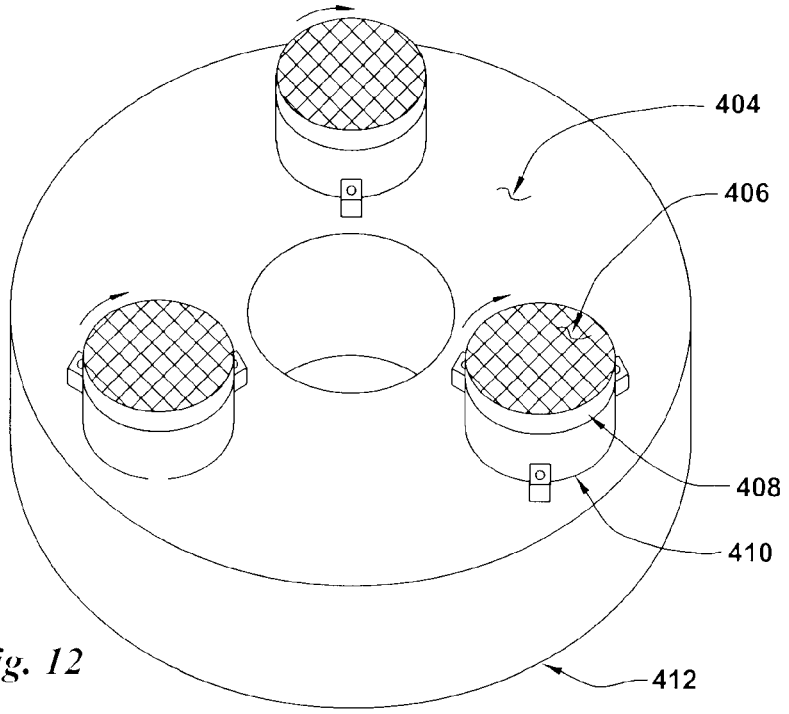
FIG. 12 is an isometric view of fixed-position spindles mounted on a granite base.
Figure 13:
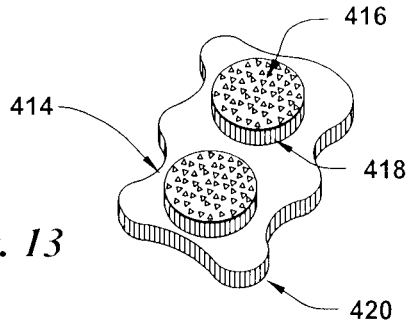
FIG. 13 is an isometric view of fixed-abrasive coated raised islands on an abrasive disk.
Figure 14:
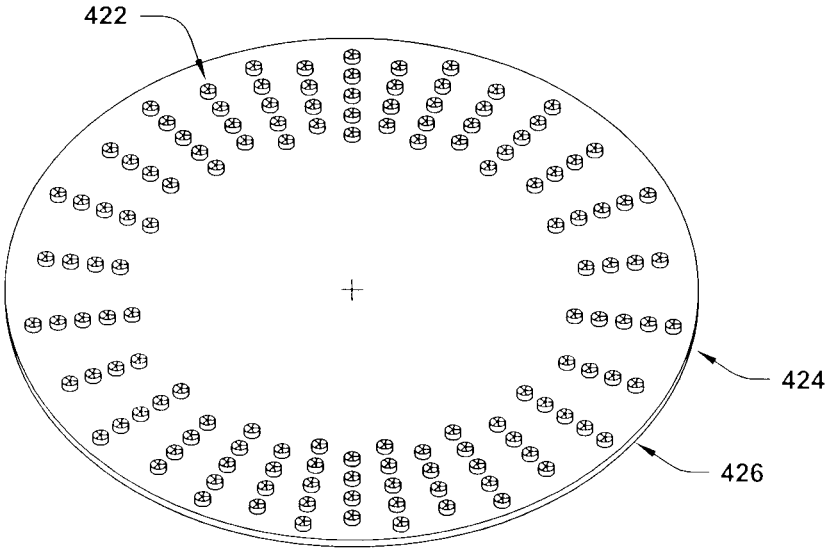
FIG. 14 is an isometric view of a flexible fixed-abrasive coated raised island abrasive disk.

FIG. 12 is an isometric view of three-point fixed-position spindles mounted on a granite base. A granite base 412 has a precision-flat top surface 404 that supports three attached workpiece spindles 410 that have rotatable driven tops 408 where flat-surfaced workpieces 406 are attached to the flat-surfaced spindle tops 408. FIG. 13 is an isometric view of fixed-abrasive coated raised islands on an abrasive disk. Abrasive particle 416 coated raised islands 418 are attached to an abrasive disk 414 backing 420. FIG. 14 is an isometric view of a flexible fixed-abrasive coated raised island abrasive disk. Abrasive particle coated raised islands 422 are attached to an abrasive disk 426 backing 424.

High-Speed Platen Construction

Precision-thickness flexible raised island abrasive disks are attached to the precision-flat surface of a rotary platen that is rotated at high speeds to obtain lapping abrading speeds that typically exceed 10,000 SFPM. Use of diamond abrasive particles at these high speeds provides extremely high workpiece material removal rates (MMR) even for extremely hard workpiece materials such as tungsten carbide. Workpieces are cooled with water but hydroplaning of the workpieces is avoided by using abrasive coated raised islands. Abrasive disks are quickly attached to the platen with vacuum.

For high speed flat lapping, it is required that the platen flatness variation is less than 0.0001 inches (3 Microns) across the platen full annular abrading surface. This precision flatness must be maintained over long periods of time and at very high rotational speeds. The platens are driven by a shaft that is supported by a spherical bearing that allows the platen to "float" as it is rotated. Here, the platen abrasive contacts workpieces that are attached to rotary spindles that provide three-point support of the rotating platen. The platen components are bonded together with structural adhesives.

To provide precision-flat platen surfaces, the platens used for slurry lapping typically are constructed from cast iron. The cast iron is made dimensionally stable by chemical aging or by using a time-aging process. Cast iron is suitable for low speed slurry lapping but it is typically too heavy for the high rotational speeds required for high speed flat lapping.

The material of choice for the high speed platens is Mic-6® cast aluminum available from Alcoa Inc of Davenport, Iowa. This "dead soft" cast aluminum is available in widths of up to 60 inches (152 cm) and thicknesses from 0.25 inches (0.64 cm) to 4 inches (10 cm). It is stress-free and is dimensionally stable over long periods of time. Mic-6® is used for applications requiring precision accuracy and long term dimensional stability such as tooling for plastic injection molds.

All of the platen body components are fabricated from this cast aluminum material and are bonded together with structural adhesives. Use of adhesives avoids the introduction of internal stresses which occurs when parts are welded together or joined together with threaded fasteners. Here, a platen drive shaft hub is independently fabricated and bonded to a composite platen body with adhesives.

Figure 15:
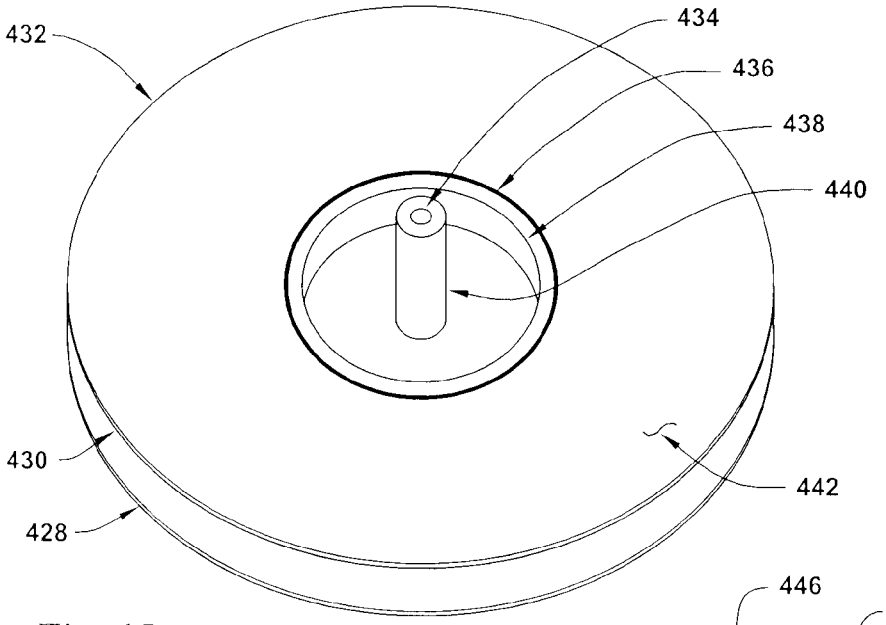
FIG. 15 is an isometric view of a high-speed rotary abrading platen.

FIG. 15 is an isometric view of a high-speed rotary abrading platen. A rotary abrading platen 432 has an upper annular plate 430 having a flat surface 442 and a lower flat-surfaced annular plate 428 that also has a flat surface. A platen 432 drive hub 438 is adhesively bonded with an adhesive 436 to the upper annular plate 430 and also to the lower flat-surfaced annular plate 428. The platen 432 drive hub 438 has a rotary drive shaft 440 that has a vacuum hole 434 at the rotational center of the drive shaft 440. All of the platen 432 components including the upper annular plate 430 having a flat surface 442 and a lower flat-surfaced annular plate 428 that also has a flat surface and the platen 432 drive hub 438 are typically constructed from stress-free materials such as Mic-6® cast aluminum materials or stress-free cast iron.

Figure 16:
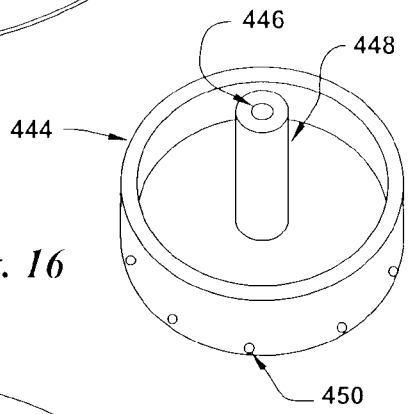
FIG. 16 is an isometric view of a high-speed rotary abrading platen center hub.
Figure 17:
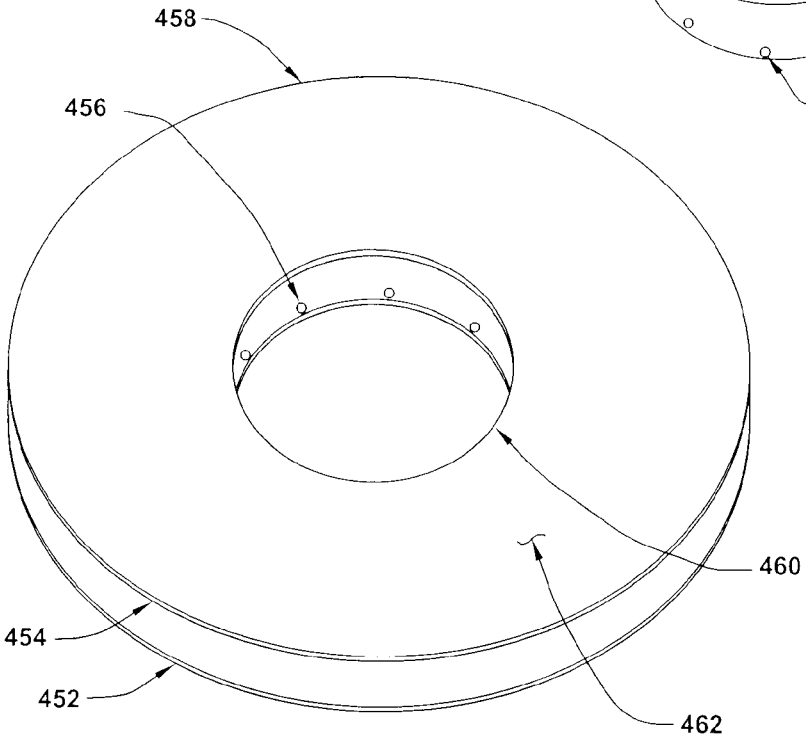
FIG. 17 is an isometric view of a high-speed rotary abrading platen annular abrading section.

FIG. 16 is an isometric view of a high-speed rotary abrading platen center hub. A platen hub 444 has a platen drive shaft 448 that has a platen drive shaft 448 vacuum hole 446 that is connected with vacuum passages (not shown) to radial vacuum port holes 450. FIG. 17 is an isometric view of a high-speed rotary abrading platen annular abrading section. The platen annular abrading section 458 has radial vacuum port holes 456 and the platen annular abrading section 458 has an upper annular plate 454 having a flat surface 462 and a lower flat-surfaced annular plate 452 that also has a flat surface. The platen annular abrading section 458 upper annular plate 454 has a inner annular radius 460.

Lightweight and Rigid Platen

A very high structural stiffness of the platen can be provided with the use of lightweight (but stiff) radial rib beam members. Large opening holes can be used to reduce the rib weight but yet maintain the beam stiffness of the radial rib. Reducing the weight of the platen allows it to be accelerated to high speeds very quickly as the rotational mass inertia of the platen is minimized. The platen drive shaft and hub would be typically fabricated from the cast aluminum material but it could also be produced from naval brass. This corrosion resistant brass has a similar coefficient of thermal expansion but is stiffer and stronger than the cast aluminum. The drive shaft has a spline to provide rotation of the platen.

The planar stiffness of the platen abrading surface increases by the cube of the thickness of the platen body. Here, the platen overall thickness can be increased substantially to provide increased planar stiffness of the platen. This increase in the platen thickness (and stiffness) has a large advantage in that it results in only a minimum increase in the platen weight. Continuous-flat plates of the cast aluminum are adhesively bonded to both the upper and lower surfaces of the platen body. This platen composite construction results in a platen stiffness that is almost equal to that of a solid, but very heavy, platen with just a small fraction of the material weight.

Vacuum passages can be incorporated into the radial rids with little change in the stiffness of the rib structure. Vacuum can he be supplied to vacuum holes that penetrate the platen abrading surface to attach the flexible raised island abrasive disks to the platen. The outer annular band ring portion of a platen is a composite structure where all of the platen components are joined together using high strength structural adhesives. The primary source of the radial stiffness of the annular platen body is provided by the multiple radial stiffening ribs. The center section of these ribs can be cut-out to reduce the weight of the ribs. These cut-outs have very little effect on the stiffness of the ribs. Annular top and bottom plates also provide substantial stiffness for the platen body. Both the inner and outer periphery of the platen body have circular wall shapes.

Thin annular surface plates constructed from hard steel or stainless steel are also adhesively bonded to the annular top and bottom plates. The external bottom surface plate is ground to provide a precision flat surface for mounting flexible raised island abrasive disks. The external top surface plate is also typically ground to provide a precision-flat platen mounting surface when using an air bearing platen to precision flat grind the exposed platen bottom surface. Vacuum passages located at the base of the radial ribs provide vacuum to a circumferential pattern of disk vacuum through-holes. This pattern of vacuum holes extends tangentially around the bottom surface of the platen annular flexible abrasive disk mounting surface.

Figure 18:
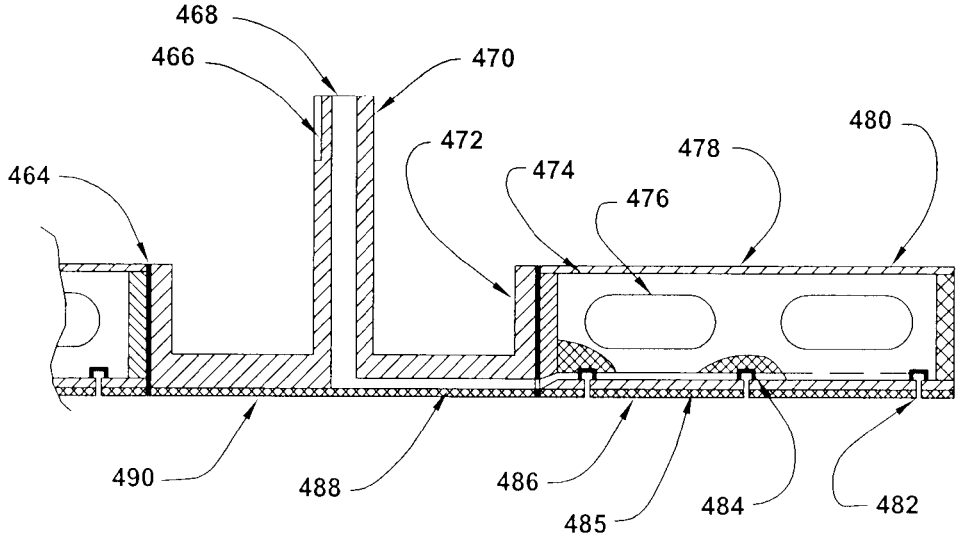
FIG. 18 is a cross section view of an abrading platen and platen hub assembly.

FIG. 18 is a cross section view of an abrading platen and platen hub assembly. An abrading platen assembly 480 has a platen annular portion 474 that is attached to a platen drive hub 470 outer annular wall 472 with adhesive 464. The platen drive hub 470 has a spline 466 that can engage a rotary drive device (not shown) that can apply substantial torque to the drive hub 470 to rotationally accelerate and decelerate the platen assembly 480. The platen annular portion 474 has a flat-surfaced upper cover plate 478 and a flat-surfaced lower cover plate 486 where both the flat-surfaced upper cover plate 478 and a flat-surfaced lower cover plate 486 are attached to a radial structural rib 474. The multiple radial structural ribs 474 have cut-out holes 476 to reduce the weight of the ribs 474.

Vacuum holes 482 extend from the flexible abrasive disk (not shown) mounting surface 485 into a vacuum passage 488 and extend into tangential vacuum passageways 484 that extend around the circumference of the platen annular portion 474. A circular cover plate 490 is attached to the platen drive hub 470. The drive hub 470 has a vacuum passageway 468 that is connected to vacuum passageway 488.

Figure 19:
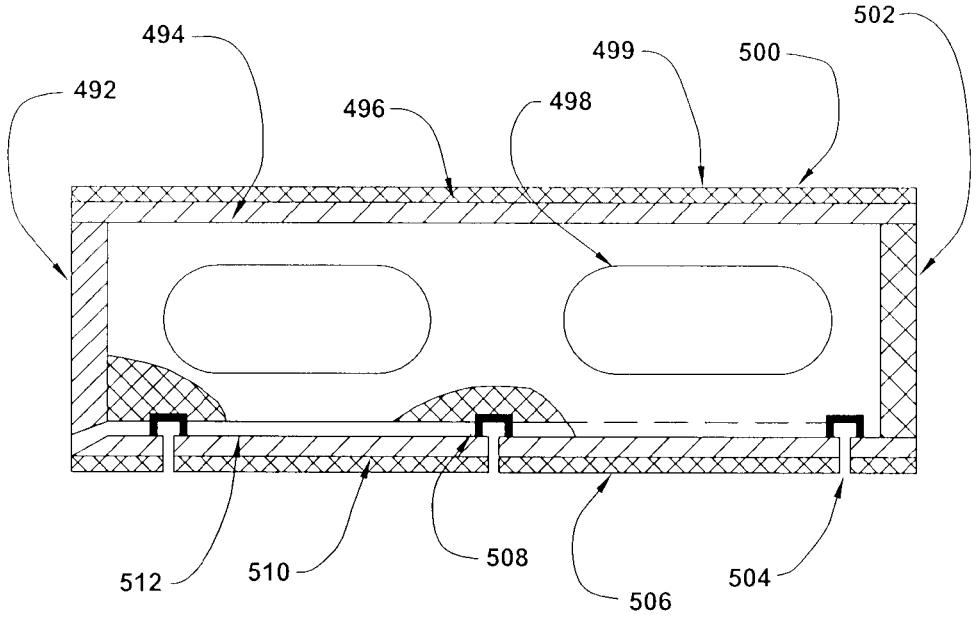
FIG. 19 is a cross section view of an annular portion of an abrading platen.

FIG. 19 is a cross section view of an annular portion of an abrading platen. An annular platen abrading portion 500 has an upper annular cover plate 496 having a wear-resistant coating 499 and a lower annular cover plate 510 having a wear-resistant coating 506. The annular platen abrading portion 500 also has multiple radial structural ribs 494 that are positioned around the circumference of the annular platen abrading portion 500 where the ribs 494 have cut-out holes 498 that reduce the weight of the annular platen abrading portion 500. The annular platen abrading portion 500 also has an annular outer periphery wall 502 and an annular inner periphery wall 492.

Flexible abrasive disks (not shown) can be attached by vacuum to the lower annular cover plate 510 wear-resistant coating 506 surface of the annular platen abrading portion 500. Vacuum holes 504 extend from the flexible abrasive disk mounting surface 506 into a radial ribs 494 vacuum passage 512 and also extend into tangential vacuum passageways 508 that extend around the circumference of the platen annular portion 500. All of the components of the platen abrading portion 500 are typically bonded together with structural adhesive (not shown).

Figure 20:
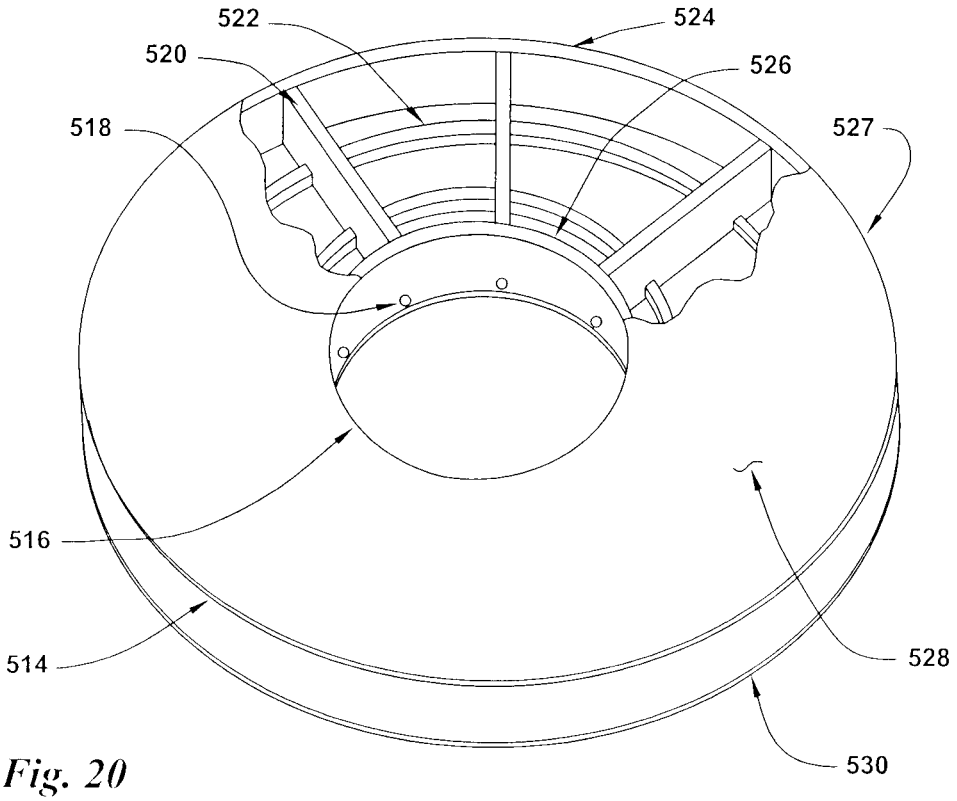
FIG. 20 is an isometric view of a high-speed rotary abrading platen with radial ribs.

FIG. 20 is an isometric view of a high-speed rotary abrading platen with radial ribs. When a composite abrading platen annular body 527 is constructed, vacuum is routed from the multiple radial stiffening ribs 520 to vacuum holes 518 in the platen annular body 530 platen hub wall 526 by the use of sealed tangential vacuum channels 522. These vacuum channels 522 are positioned to supply vacuum to rows of vacuum through-holes (not shown) that are located at two or more radial locations on the platen body 527. The vacuum passageways (not shown) that extend radially along the bottom portion of the radial ribs 520 also penetrate the inner rotational drive hub (not shown) of the platen body 527. The corresponding vacuum passageways in the platen drive shaft hub are all interconnected to a vacuum passage that is located at the axial center of the platen drive shaft (not shown). This allows vacuum to be supplied by the hollow platen drive shaft to the individual disk attachment vacuum through-holes (not shown).

The abrading platen annular body 527 has an upper flat-surfaced plate 513 that has a flat surface 528 and a lower flat-surfaced plate 530 an inner hub wall 526 and an outer periphery wall 524. All of the vacuum holes and passageways can be periodically flushed with water to prevent a build-up of abrading debris within the passages over extended usage of the platens for flat lapping. Build-up of abrading debris could cause the precision-balanced abrading platens to become slightly unbalanced.

Figure 21:
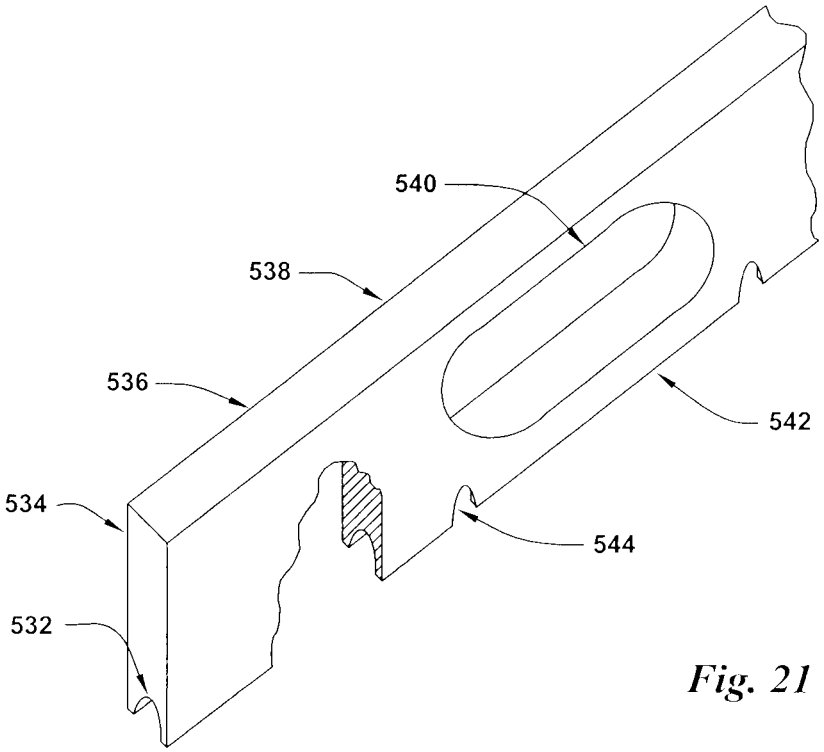
FIG. 21 is an isometric view of radial ribs of an abrading platen annular portion.

FIG. 21 is an isometric view of radial ribs of an abrading platen annular portion. Vacuum is routed from the multiple radial stiffening ribs 536 to platen bottom surface vacuum abrasive disk attachment port holes (not shown) by the use of sealed tangential vacuum channels (not shown). These vacuum channels are positioned to supply vacuum to rows of vacuum through-holes that are located at two or more radial locations on the platen body. The vacuum passageways 532 that extend radially along the bottom portion of the radial ribs 536 are connected to radial vacuum passage holes 544 and they also penetrate the inner hub of the platen body (not shown). The structural radial ribs 536 have flat top surfaces 538 and flat lower surfaces 542 and inner radius ends 534.

There are corresponding vacuum passageways in the platen drive shaft hub (not shown) that are all connected to a vacuum passage that is located at the axial center of the platen drive shaft (not shown). This allows vacuum to be supplied by the hollow platen drive shaft to the individual disk attachment vacuum through-holes. The vacuum passages located at the bottom side of the stiffening ribs are quite small relative to the cross sectional size of the rib. Vacuum is routed from the radial stiffening ribs to vacuum holes by the use of sealed tangential vacuum channels. These vacuum channels are positioned to supply vacuum to rows of vacuum through-holes that are located at two or more radial locations on the platen body. The vacuum passages located at the bottom side of the stiffening ribs are quite small relative to the cross sectional size of the rib.

Figure 22:
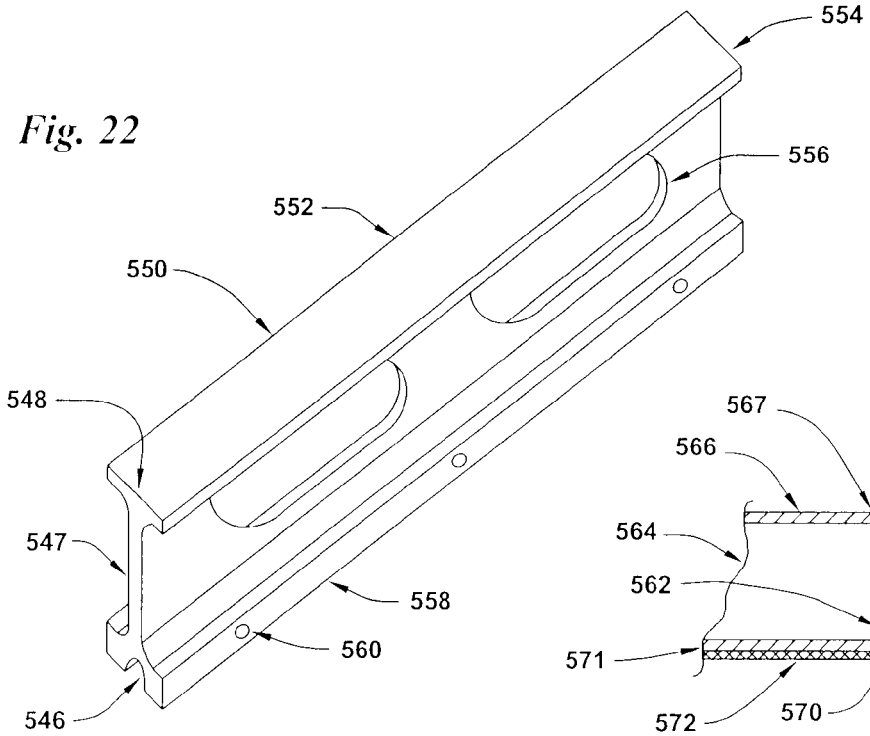
FIG. 22 is an isometric view of form-shaped radial ribs of an abrading platen.

FIG. 22 is an isometric view of form-shaped radial ribs of an abrading platen. Radial stiffening ribs 550 can be constructed with wide upper flat-surfaced flanges 552 and lower wide flat-surfaced flanges 558 that are separated by a narrow rib web 547 having cut-outs 556. The rib web 547 does not have to be thick to contribute stiffness to the rib 550. Also, large port holes 556 can be cut-out of the narrow rib web 547 to reduce the weight of the rib 550 but maintain the ribs 550 structural rigidity. This rib 550 design provides a very stiff rib 550 that is lightweight and has low torsional inertia when installed radially in the platen (not shown) annular body. Low mass inertia of the platen annular body allows the platen to be quickly accelerated and decelerated for quickly bringing the platen up to full speed and for slowing it down. The multiple ribs 550 have vacuum passages 546 than are cut into the lower flat-surfaced flanges 558 and the ribs 550 have an inner radius end 548 and an outer radius end 554.

Figure 23:
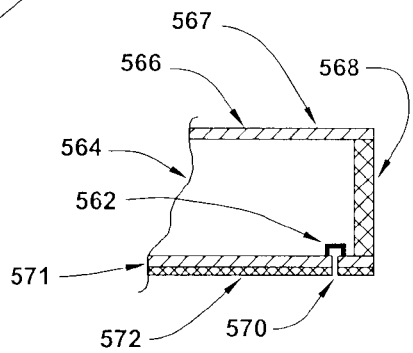
FIG. 23 is a cross section view of form-shaped radial ribs of an abrading platen.

FIG. 23 is a cross section view of form-shaped radial ribs of an abrading platen. A rib 564 has a top annular cover plate 566, a platen 567 circumferential wall 568, a platen 567 bottom annular plate 571 having a wear resistant coating surface 572 that is used to attach a flexible abrasive disk (not shown). The platen 567 has vacuum port holes 570 and tangential vacuum passageways 562.

Figure 24:
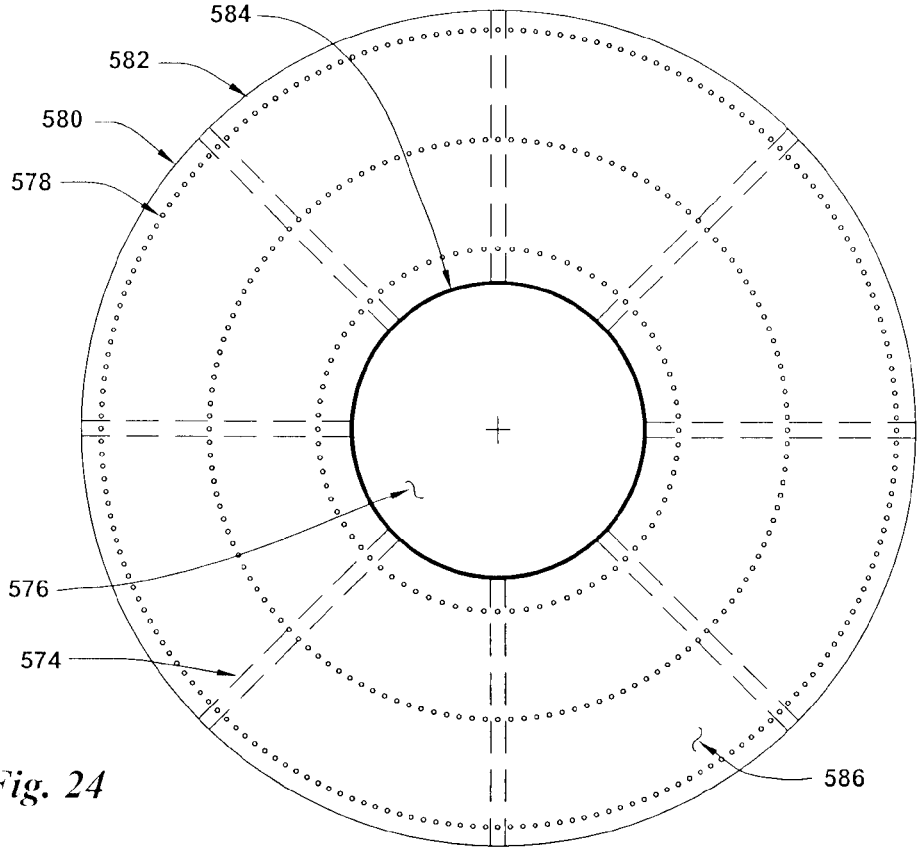
FIG. 24 is a top view of a platen having tangential patterns of vacuum port holes.

FIG. 24 is a top view of a platen having tangential patterns of vacuum port holes. Vacuum is routed from the radial stiffening ribs 574 to vacuum port holes 578 in the bottom flat surface 586 of a platen 580 abrasive disk (not shown) flat-surfaced annular plate 582 by the use of sealed tangential vacuum channels. These vacuum channels are positioned to supply vacuum to rows of vacuum through-holes 578 that are located at two or more radial locations on the platen 580 body. Typically, eight radial ribs 574 are used to stiffen a platen 580 body but more or less of the ribs 574 can be used, depending on the size of the platen 580. The radial ribs 574 and platen annular body 580 are attached to the platen 580 rotational drive hub 576 with adhesive 584.

Tangential vacuum channels (not shown) that are attached to the vacuum holes (not shown) in the radial ribs 574 are sealed at all joints to assure that the vacuum is sealed and that all ingested abrading debris is confined to the vacuum passages. This abrading debris is minimal in volume but provisions are made to flush the vacuum passages out periodically with water. The platen drive hub is adhesively bonded to the platen annular body to provide a stress-free attachment connection of the two platen components.

Figure 25:
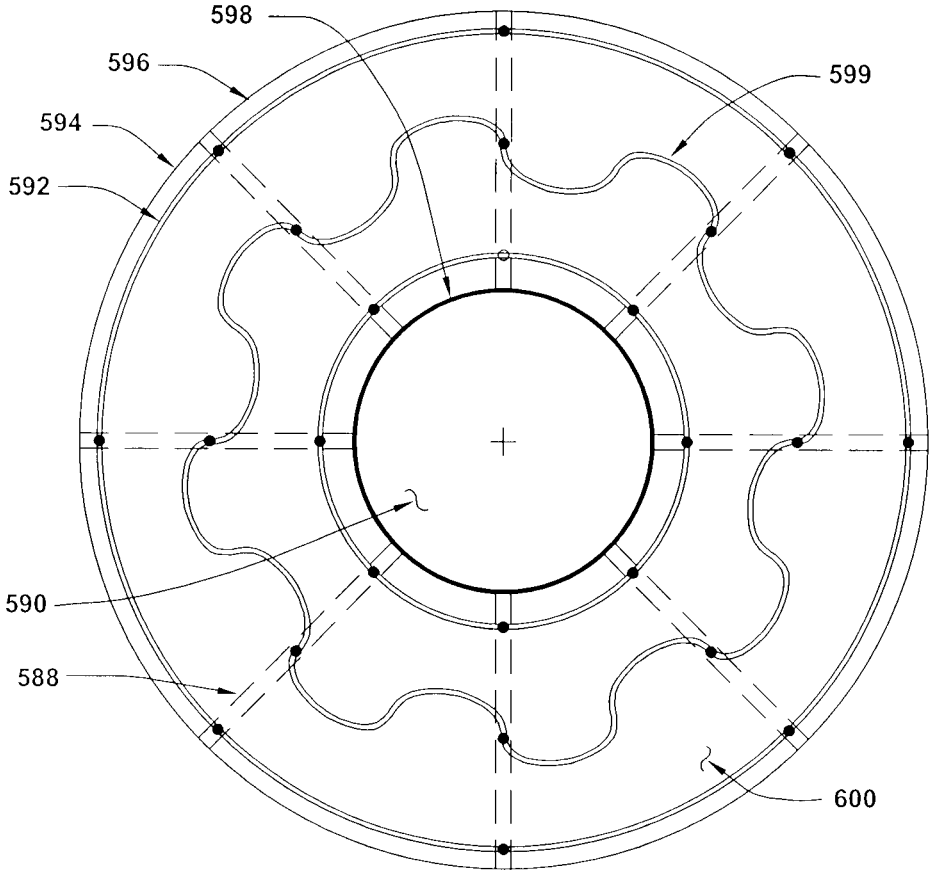
FIG. 25 is a top view of a platen having tangential patterns of vacuum grooves.

FIG. 25 is a top view of a platen having tangential patterns of vacuum grooves. Vacuum is routed from the radial stiffening ribs 588 to vacuum circular grooves 592 or serpentine vacuum grooves 599 in the bottom flat surface 600 of a platen 594 abrasive disk (not shown) flat-surfaced annular plate 596 by the use of sealed tangential vacuum channels. These vacuum channels are positioned to supply vacuum to vacuum surface grooves 592 that are located at two or more radial locations on the platen 594 body. Typically, eight radial ribs 588 are used to stiffen a platen 594 body but more or less of the ribs 588 can be used, depending on the size of the platen 594. The radial ribs 588 and platen annular body 594 are attached to the platen 594 rotational drive hub 590 with adhesive 598.

Tangential vacuum channels (not shown) that are attached to the vacuum holes (not shown) in the radial ribs 588 are sealed at all joints to assure that the vacuum is sealed and that all ingested abrading debris is confined to the vacuum passages. This abrading debris is minimal in volume but provisions are made to flush the vacuum passages out periodically with water. The platen drive hub is adhesively bonded to the platen annular body to provide a stress-free attachment connection of the two platen components.

Figure 26:
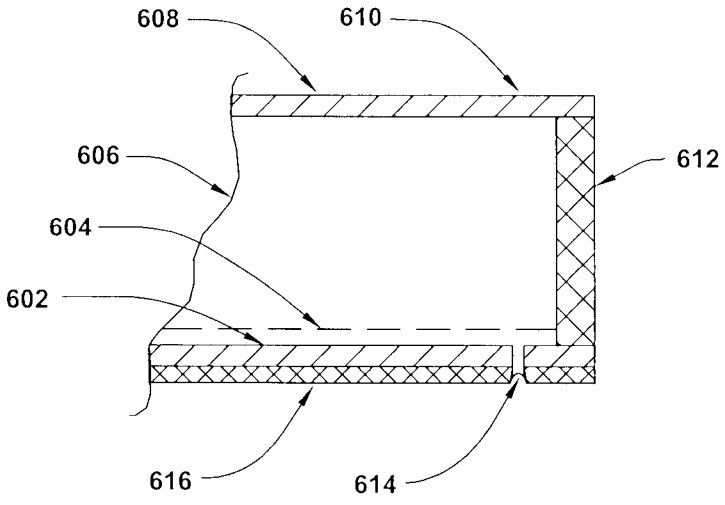
FIG. 26 is a cross section view of form-shaped radial ribs of an abrading platen.

FIG. 26 is a cross section view of form-shaped radial ribs of an abrading platen. A rib 606 has a top annular cover plate 602, a platen 608 circumferential wall 612, a platen 608 bottom annular plate 602 having a wear resistant coating surface 616 that is used to attach a flexible abrasive disk (not shown). The platen 608 has vacuum port holes 614 and tangential vacuum passageways 604.

Platen Surface Wear Resistant Coating

To provide a wear resistant coating on the abrasive disk side of the platen, a cast aluminum annular bottom plate can be provided with a "hard coat" anodized surface. A 0.003 inches (76 micron) thick coating can be formed on the platen surface. This aluminum oxide coating is extremely hard and wear resistant. Many precision products such as air bearing spindles are fabricated from aluminum and where components are anodized to create a hard surface that can be ground to provide precisely-flat surfaces. Aluminum platens are desirable because they are lightweight, are structurally stiff, and provide low mass inertia that minimize the torsional platen drive forces that accelerate and decelerate the high speed rotation of the platens.

A distinct advantage is that the anodized coating is an integral part of the dimensionally stable cast aluminum platen components. Because the anodized coating is so thin compared to the platen annular bottom plate, the anodized coating does not distort the platen precision-flat abrading surface when the platen is subjected to temperature changes. In addition, sapphire (aluminum oxide) hollow orifice inserts can be positioned in the platen annular bottom plate to provide wear resistant vacuum port holes. These orifice inserts act as vacuum passageways to tangential grooves cut in the platen abrading surface that allow abrasive disks to be attached to the platen. The through-hole diameters of the vacuum port holes and the through-hole diameters of the orifice inserts can range from 0.002 inches (0.051 mm) to 0.125 inch (3.18 mm) but preferably range from 0.005 inches (0.127 mm) to 0.060 inch (1.52 mm).

The thickness of wear resistant coatings can range from 0.002 inches (0.051 mm) to 0.125 inch (3.18 mm) but preferably range from 0.005 inches (0.127 mm) to 0.060 inch (1.52 mm) but most preferably range from 0.005 inches (0.127 mm) to 0.020 inch (0.51 mm).

A wear resistant coating can also be applied to upper and lower flat annular surfaces of an annular abrading platen by coating these surfaces with wear resistant materials. Applying adhesive based wear resistant coatings provides a simpler process than using a chemical process to anodize an abrading platen constructed of aluminum where the chemicals convert the surface of the platen aluminum material to aluminum oxide. The aluminum oxide produced by anodizing is very hard and wear resistant. Also, the annular and other exterior surfaces of the abrading platen can be plated with layers of metal to provide hard wear resistant surfaces. However, these metal plating processes also require the use of chemical and require a complex metal coating layer application process.

Another simple method of providing the platen abrading surface with a wear resistant coating is to attach aluminum oxide beads to the platen surface with a structural adhesive.

These equal-sized aluminum oxide beads are very hard and wear resistant. They can be applied to platens constructed from a wide variety of materials including aluminum and cast iron. Application of adhesive-based wear resistant coatings that are filled with hard-material particles is a simple process than can be done without special process application process facilities or chemicals such as are used for anodizing or metal plating. The adhesive coatings can be applied to existing platens even after a lapping machine has been constructed and operated for some time. Here, existing wear resistant coatings can also be removed form platen surfaces and be replaced with a new wear resistant coating.

The beads can be solid aluminum oxide and they can be vitrified aluminum oxide if desired. Ceramic or polymer matrix based beads can also be filled with other abrasive particles such as aluminum oxide, diamond or CBN particles. Wear-resistant bead sizes can range from 0.002 inches (0.051 mm) to 0.125 inch (3.18 mm) but preferably range from 0.005 inches (0.127 mm) to 0.060 inch (1.52 mm) but most preferably range from 0.005 inches (0.127 mm) to 0.020 inch (0.51 mm).

A size-coat type of adhesive mixture that is filled with abrasive particles such as aluminum oxide, CBN or diamond can also be applied to the exposed surface of the attached wear-resistant beads where this particle filled adhesive mixture resides in the gaps between individual wear resistant beads. The hardened particles in the size-coat mixture filler reduces erosion of the size-coat filler material between the bears and increases its resistance to abrading to assure that a vacuum seal is maintained when flexible abrasive disks are attached by vacuum to the platen abrading surface.

After the beads are attached and bonded to the platen, the coated-bead common exposed surface can ground precisely flat. Also, after the beads are attached and bonded to the platen and the size-coat mixture is applied to the top exposed surface of the bead tops and solidified, the composite coated-bead and size-coat mixture layer together form a common exposed wear-resistant coating exposed surface that can be ground or machined precisely flat. Worn wear-resistant beads are easy to remove from the platen surfaces and can be replaced by coating-on a new layer of wear-resistant beads.

A distinct advantage is that the bead coating is that it becomes an integral part of the dimensionally stable cast aluminum platen components. Because the individual beads are so small, as compared to the platen annular bottom plate, the distributed bead coating does not distort the platen precision-flat abrading surface when the platen is subjected to temperature changes.

In addition, sapphire (aluminum oxide) hollow orifice inserts can be positioned in the platen annular bottom plate to provide wear resistant vacuum port holes. These orifice inserts act as vacuum passageways to tangential grooves cut in the platen abrading surface that allow abrasive disks to be attached to the platen. Abrasive debris that is captured by the abrasive disk vacuum attachment system can abrade and enlarge the individual platen vacuum port holes. Use of the extremely hard sapphire inserts having a hardness of 9 mhos (where diamond has a hardness of 10 mhos) provides assurance that the wear of the vacuum port holes is minimized.

The circular or serpentine-shaped tangential grooves cut in the platen abrading surface to act as vacuum passageways for the vacuum attachment of the flexible abrasive disks intersect the vacuum port holes that extend into the platen surface to intersect radial and tangential vacuum passageways that are located internal to the platen body. The typical size of the hard aluminum oxide beads that are coated on a platen surface can range from less than 0.005 inches (0.127 mm) to more than 0.010 inches (0.254 mm). The surface of a platen can be re-ground repetitively before the beads have to be replaced. The flatness of the ground surface of the bead coated platen surface typically has a variation of less than 0.0001 inches (3 microns). Both the upper and lower surfaces of the platen can be coated with beads and ground flat.

The tangential vacuum grooves in the bead coated surface have a depth that is less than the diameter of the beads, when the platen is first fabricated. The typical groove width can range from 0.002 inches (0.051 mm) to 0.060 inches (1.52 mm) or the groove width can be optimized as desired and the grooves can be ground into individual beads. Vacuum grooves can be re-ground when the platen abrading surface is re-ground.

Figure 27:
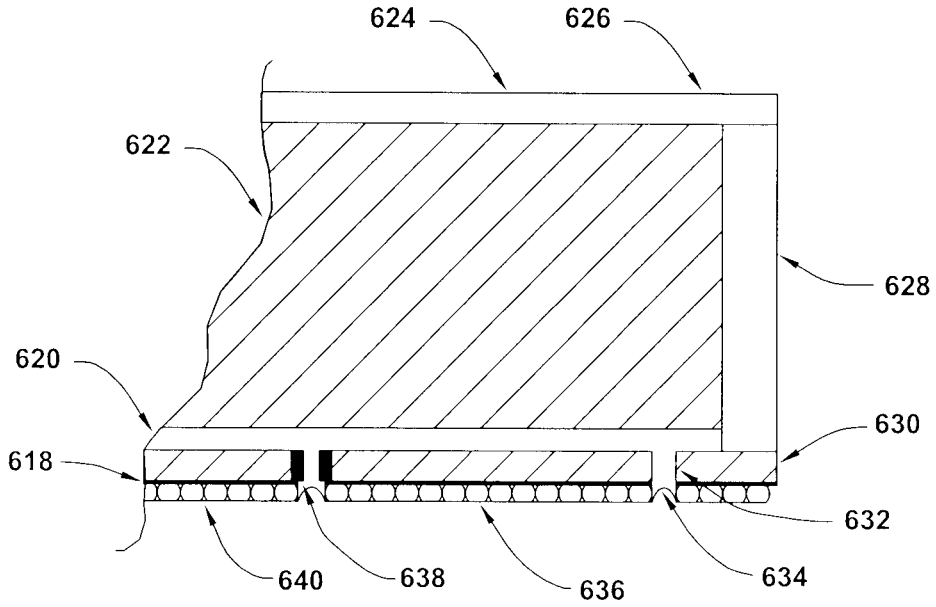
FIG. 27 is a cross section view of a floating-platen having a wear-resistant surface coating.

FIG. 27 is a cross section view of a floating-platen having an external wear-resistant surface coating. The abrading platen 624 has a top annular surface plate 626, an outer periphery annular wall 628 and an internal radial reinforcing rib 622. The internal radial reinforcing rib 622 has a vacuum passageway 620 that is cut into the bottom of the radial rib 622 where the vacuum passageway 620 extends along the length of the rib 622. The vacuum passageway 620 intersects platen 624 vacuum port holes 632 that extend to tangential vacuum grooves 634 and where the tangential vacuum grooves 634 extend around the circumference of the platen annular abrading surface 636. The vacuum port holes 632 can have sapphire or hardened through-hole inserts 638 that are constructed from aluminum oxide or hardened metals.

The platen 624 has a bottom annular plate 630 that is coated with a layer of adhesive 618 where spherical hard-material beads or particles 640 are bonded to the platen 624 bottom plate 630 by the adhesive 618. The hard material beads or particles 640 can be made from materials selected from the group of ceramics, aluminum oxide, diamond, cubic boron nitride (CBN) and metals. A size coating of adhesive or particle-filled adhesive can be applied to the exposed surface of the spherical hard-material beads or particles 640 to fill the gaps between individual spherical hard-material beads or particles 640. When the adhesive 618 is fully solidified, the exposed surface of the spherical hard-material beads or particles 640 can be ground to form a precision-flat platen 624 annular abrading surface 636.

The curved-shaped vacuum grooves that are cut or ground into the disk mounting surface typically will have a groove width of only 0.020 inches (0.51 mm) and a depth of only 0.005 inches (0.13 mm). The typical thickness of the wear-resistant coating on the platen abrading surface which is the flexible abrasive disk mounting surface can range from less than 0.005 inches (0.13 mm) to more than 0.010 inches (0.25 mm). The vacuum through-holes typically have a diameter of 0.040 inches (1.02 mm). The groove widths can range from 0.002 inches (0.051 mm) to 0.125 inch (3.18 mm) but preferably range from 0.005 inches (0.127 mm) to 0.060 inch (1.52 mm). The groove depths can range from 0.002 inches (0.051 mm) to 0.125 inch (3.18 mm) but preferably range from 0.005 inches (0.127 mm) to 0.060 inch (1.52 mm) and most preferably range from 0.005 inches (0.127 mm) to 0.020 inch (0.51 mm).

Use of curved shapes for the grooves minimizes the accumulation of abrading debris in the grooves. These grooves are easily cleaned with the application of pressurized water streams to the bottom disk mount surface of the platen to prepare for the attachment of a new or different abrasive disk.

When a different raised island abrasive disk is attached to a platen, the disk is positioned tangentially where a registration mark on the flexible disk is aligned with a permanent orientation mark on the platen surface. Use of this disk orientation registration mark system allows abrasive disks to be removed from a platen and re-installed on the same platen without having to "dress" the disk abrasive to re-establish the abrasive precision flatness. Once an abrasive disk is "worn-in" on a platen, it can be re-mounted many times for instant use for abrading.

Figure 28:
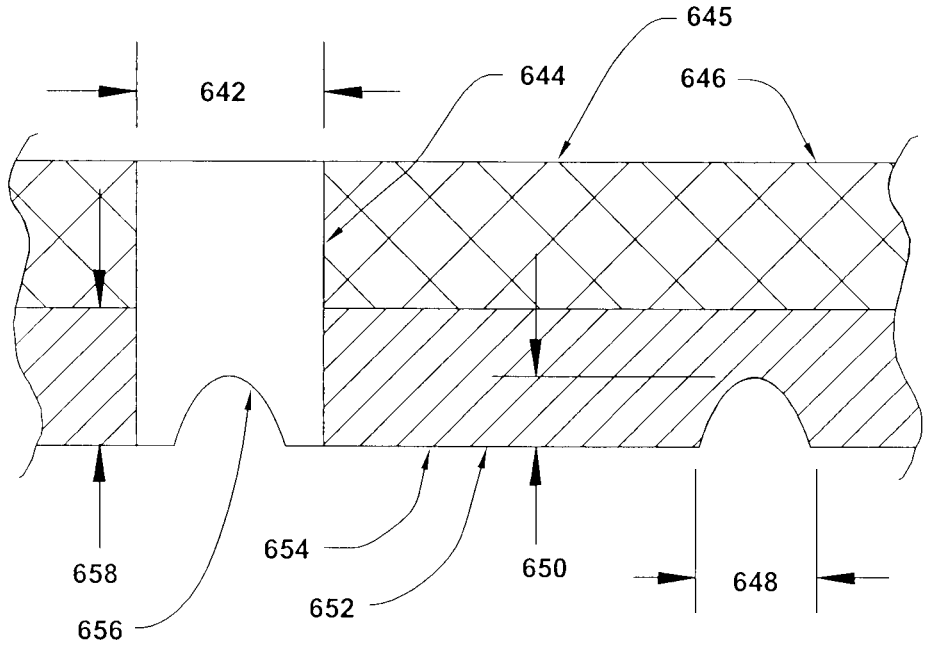
FIG. 28 is a cross section view of an abrading platen having a wear-resistant surface coating.

FIG. 28 is a cross section view of an abrading platen having an external wear-resistant surface coating. The abrading platen 645 has a bottom annular surface plate 646 that has vacuum port holes 644 that extend to tangential vacuum grooves 656 where the tangential vacuum grooves 656 extend around the circumference of the platen 645 annular abrading surface 652. The vacuum port holes 644 can have port hole 644 diameters 642 and the straight-edged or curve-shaped vacuum grooves 656 can have groove widths 648 and groove depths 650. The platen 645 bottom annular plate 646 can be coated with a layer of wear-resistant materials 654 such as anodized aluminum oxide coatings or spherical hard-material beads or particles. The platen 645 has a wear-resistant materials 654 coating thickness 658.

To provide a wear resistant coating on the abrasive disk side of the platen, the cast aluminum annular bottom plate can be provided with a "hard coat" anodized surface. A 0.003 inches (76 micron) thick coating can be formed on the platen surface. This aluminum oxide coating is extremely hard and wear resistant. Many precision products such as air bearing spindles are fabricated from aluminum where these components are anodized to create a hard surface that can be ground to provide precisely-flat surfaces. Metal plating can also be applied to these components to provide wear-resistant coatings.

A distinct advantage is that the anodized coating is an integral part of the dimensionally stable cast aluminum platen components. Because the anodized coating is so thin compared to the platen annular bottom plate, the anodized coating does not distort the platen precision-flat abrading surface when the platen is subjected to temperature changes. In addition, sapphire (aluminum oxide) hollow orifice inserts can be positioned in the platen annular bottom plate to provide wear resistant vacuum port holes. These orifice inserts act as vacuum passageways to tangential grooves cut in the platen abrading surface that allow abrasive disks to be attached to the platen.

FIG. 28.1 is a cross section view of an abrading platen having an anodized or plated external wear-resistant surface coating. The abrading platen 664 has a top annular surface plate 666, an outer periphery annular wall 668 and an internal radial reinforcing rib 662. The internal radial reinforcing rib 662 has a vacuum passageway 660 that is cut into the bottom of the radial rib 662 where the vacuum passageway 660 extends along the length of the rib 662. The vacuum passageway 660 intersects platen 664 vacuum port holes 670 that extend to tangential vacuum grooves 672 and where the tangential vacuum grooves 672 extend around the circumference of the platen annular abrading surface 674. The vacuum port holes 670 can have sapphire or hardened through-hole inserts 678 that are constructed from aluminum oxide or hardened metals.

The platen 664 has a bottom annular plate 669 that is coated with an anodized or metal plated layer 676. After the coated anodized or metal plated layer 676 is applied, the exposed surface of the wear-resistant coating 676 can be ground flat to form a platen 664 annular abrading surface 674 flexible abrasive disk (not shown) precision-flat mounting surface 680. The abrading platen 664 top annular surface plate 666 can also be coated with a wear-resistant coating 665.

Another method of providing the platen abrading surface with a wear resistant coating is to attach aluminum oxide beads to the platen surface with a structural adhesive. These equal-sized aluminum oxide beads are very hard and wear resistant. The beads can be solid aluminum oxide and they can be vitrified if desired. Beads can also be filled with other abrasive particles such as diamond or CBN. The bead adhesive can also be filled with abrasive particles such as aluminum oxide or diamond to increase its resistance to abrading. After the beads are attached to the platen, the bead-common surface is ground precisely flat. Worn beads are easy to remove from the platen surfaces and can be replaced by coating-on a new layer of beads.

A distinct advantage is that the bead coating is that it becomes an integral part of the dimensionally stable cast aluminum platen components. Because the individual beads are so small, as compared to the platen annular bottom plate, the distributed bead coating does not distort the platen precision-flat abrading surface when the platen is subjected to temperature changes.

In addition, sapphire (aluminum oxide) hollow orifice inserts can be positioned in the platen annular bottom plate to provide wear resistant vacuum port holes. These orifice inserts act as vacuum passageways to tangential grooves cut in the platen abrading surface that allow abrasive disks to be attached to the platen.

FIG. 28.2 is a cross section view of an abrading platen having an hardened bead external wear-resistant surface coating. The abrading platen 695 has a top annular surface plate 690, an outer periphery annular wall 698 and an internal radial reinforcing rib 688. The internal radial reinforcing rib 688 has a vacuum passageway 686 that is cut into the bottom of the radial rib 688 where the vacuum passageway 686 extends along the length of the rib 688. The vacuum passageway 686 intersects platen 695 vacuum port holes 700 that extend to tangential vacuum grooves 702 and where the tangential vacuum grooves 702 extend around the circumference of the platen 695 annular abrading surface 706. The vacuum port holes 700 can have sapphire or hardened through-hole inserts 708 that are constructed from aluminum oxide or hardened metals.

The platen 695 has a bottom annular plate 684 that is coated with a layer of adhesive 682 where spherical hard-material beads or particles 704 are bonded to the platen 695 bottom plate 684 by the adhesive 682. The hard material beads or particles 704 can be made from materials selected from the group of ceramics, aluminum oxide, diamond, cubic boron nitride (CBN) and metals. A size coating of adhesive or particle-filled adhesive 707 can be applied to the exposed surface of the spherical hard-material beads or particles 704 to fill the gaps between individual spherical hard-material beads or particles 704. When the adhesive 682 is fully solidified, the exposed surface of the spherical hard-material beads or particles 704 can be ground flat to form a platen 695 annular abrading surface 706 flexible abrasive disk (not shown) precision-flat mounting surface 710.

The abrading platen 695 top annular surface plate 690 can also be surface-coated with a wear-resistant coating layer of spherical hard-material beads or particles 694 that are bonded to the platen 695 top annular surface plate 690 by the adhesive 692.

The typical size of the hard aluminum oxide beads that are coated on a platen surface can range from less than 0.005 inches (0.127 mm) to more than 0.020 inches (0.51 mm). The surface of a platen can be re-ground repetitively before the beads have to be replaced. The flatness of the ground surface of the bead coated platen surface has a variation of less than 0.0001 inches (3 microns). Both the upper and lower surfaces of the platen can be coated with beads and ground flat.

The tangential vacuum grooves in the bead coated surface have a depth that is less than the diameter of the beads, when the platen is first fabricated. The typical groove width can be optimized as desired and the grooves can be ground into individual beads. Vacuum grooves can be re-ground when the platen abrading surface is re-ground. Tangential patterns of individual vacuum through-holes can also be used with the beads in place of the platen tangential grooves. The bead adhesive can also be filled with abrasive particles such as aluminum oxide or diamond to increase its resistance to abrading.

FIG. 28.3 is a cross section view of an abrading platen having an external wear-resistant surface coating. The abrading platen 717 has a bottom annular surface plate 718 that has vacuum port holes 715 that extend to tangential vacuum grooves 728 where the tangential vacuum grooves 728 extend around the circumference of the platen 717 annular abrading surface 727. The vacuum port holes 715 can have port hole 715 diameters 714 and the straight-edged or curve-shaped vacuum grooves 728 can have groove widths 722 and groove depths 724. The platen 717 bottom annular plate 718 can be coated with a layer of wear-resistant materials such as anodized aluminum oxide coatings or spherical hard-material beads or particles 716. The platen 717 has a wear-resistant materials 716 coating material beads or particles 716 thickness 712.

The platen 717 has a bottom annular plate 718 that is coated with a layer of adhesive 720 where spherical hard-material beads or particles 716 are bonded to the platen 717 bottom plate 718 by the adhesive 720. The hard material beads or particles 716 can be made from materials selected from the group of ceramics, aluminum oxide, diamond, cubic boron nitride (CBN) and metals. A size coating of adhesive or particle-filled adhesive 723 can be applied to the exposed surfaces of the spherical hard-material beads or particles 716 to fill the gaps between individual spherical hard-material beads or particles 716. When the adhesives 720 and 723 are fully solidified, the exposed surface of the spherical hard-material beads or particles 716 can be ground flat to form a platen 717 annular abrading surface 727 flexible abrasive disk (not shown) precision-flat mounting surface 726.

Very large platens can be constructed from cast aluminum plate materials where the size of the platen exceeds the available 60 inch (152 cm) wide plate materials. This is done by fabricating the large platens from annular are segments that are machine cut-out of the cast aluminum plate materials. The pie-shaped arc segments on the top of the platen are staggered circumferentially with the pie-shaped arc segments on the bottom of the platen. The outer circumference of the platen is constructed from three layers of arc segments that are also staggered with each other. Staggering of the joints is done to avoid structural discontinuities in the outer platen periphery wall. All of the corrosion resistant stress-free cast aluminum platen components are bonded to each other with structural adhesives.

FIG. 28.4 is an isometric view of a very large high-speed rotary abrading platen. The platen annular abrading section 738 inner periphery annular wall 736 has radial vacuum port holes 730 and the platen annular abrading section 738 has an upper annular plate 739 having a flat surface 738 and a lower flat-surfaced annular plate 740 that also has a flat surface. The platen annular abrading section 738 upper annular plate 739 has pie-shaped sections 742 that are bonded together with adhesives (not shown) to form a continuous-surfaced plate 739 and the platen annular abrading section 738 upper has a inner annular radius 746.

The very large platen section 738 has an outer periphery annular wall 734 that is comprised of annular rib segments 744 that are positioned to be overlapped and staggered to each other in a tangential direction where the annular segments 744 are bonded to each other with adhesives (not shown). Radial structural ribs 732 are attached to the platen section 738 outer periphery annular wall 734 and the platen section 738 inner periphery annular wall 736 and to the annular abrading section 738 upper annular plate 739 and the annular abrading section 738 lower annular plate 740 with adhesives (not shown).

Platen Stiffening Ribs

Platen support ribs can be attached to the platen where these multiple radial ribs extend from the drive shaft hub to the annular center of the platen. These ribs typically are equal in number to the platen stiffening ribs and are attached to the platen at the same tangential locations as the platen stiffening ribs. Here, the adhesively attached platen support ribs and the respective radial platen stiffening ribs form continuous beam structures that are exceedingly stiff. Collectively, these radial rib structures, which are evenly distributed around the annular platen, can transfer large abrading forces without distorting the precision-flat platen abrading surface.

Here, abrading forces that are applied by the pivot frame that supports the rotatable platen are transferred to the hub that surrounds the platen drive shaft. Portions of the applied abrading forces are then transferred to the center of the platen annular body by the very stiff platen support ribs. Without the multiple platen support ribs, the applied abrading forces are transferred only through the thickness of the platen body. Use of non-rib platen annular bodies that have very thick cross-sections can also provide a radial stiffness equal to a platen having the external platen support ribs.

Figure 29:
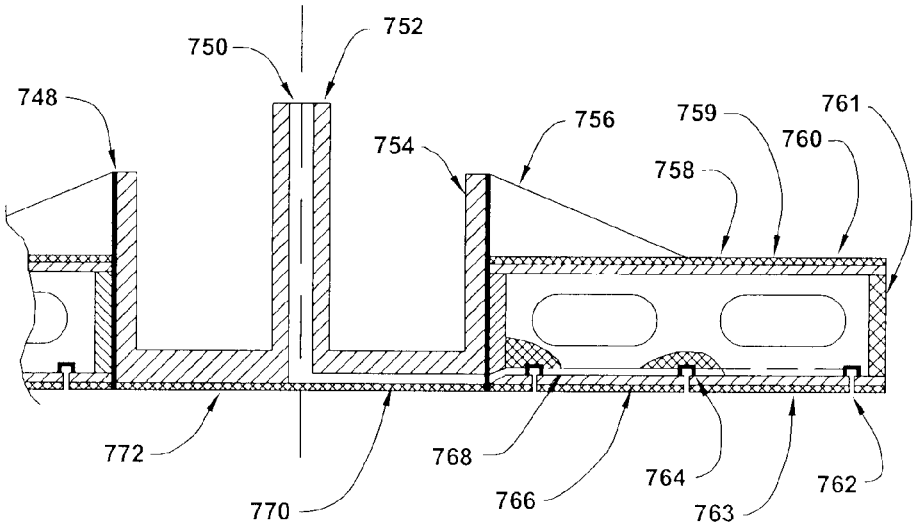
FIG. 29 is a cross section view of an abrading platen with external stiffening ribs.

FIG. 29 is a cross section view of an abrading platen with external stiffening ribs. An abrading platen assembly 759 has a platen annular portion 758 having a flat surface 760 that is attached to a platen drive hub 752 outer annular wall 754 with adhesive 748. The platen drive hub 752 can engage a rotary drive device (not shown) that can apply substantial torque to the drive hub 752 to rotationally accelerate and decelerate the platen assembly 759. The platen annular portion 758 has a flat-surfaced upper annular cover plate 760 and a flat-surfaced lower annular cover plate 766 where both the flat-surfaced upper cover plate 760 and a flat-surfaced lower cover plate 766 are adhesively bonded to an internal structural rib 761.

Vacuum holes 762 extend from the flexible abrasive disk (not shown) mounting surface 763 extend into a vacuum passage 768 and extend into tangential vacuum passageways 764 that extend around the circumference of the platen annular portion 758. The platen drive hub 752 has a vacuum passage 750 that is connected to the vacuum passage 770 that is connected to the vacuum passageway 768. A circular cover plate 772 is attached to the platen drive hub 752. External structural ribs 756 are positioned around the circumference of the platen assembly 759 and the structural ribs 756 are bonded with adhesive 748 to the platen drive hub 752 inner wall 754 and to the platen assembly 759 annular body 758. The platen assembly 759 platen drive hub 752 circular cover plate 772 has an annular surface 770 that supports the inner radius area of the flexible abrasive disk.

A truncated radial stiffening cone can also be used to provide extra stiffening of the center portion of an annular platen abrading surface. The cone wraps around the circumference of the platen annular body and is continuously attached to both the drive shaft hub and the platen annular body with structural adhesive. The cone has a substantial thickness to provide the desired increase in the planar flatness stiffness of the platen annular abrading surface.

Here, abrading forces that are applied by the pivot frame that supports the rotatable platen are transferred to the hub that surrounds the platen drive shaft. Portions of the applied abrading forces are then transferred to the center of the platen annular body by the very stiff platen support cone.

Figure 30:
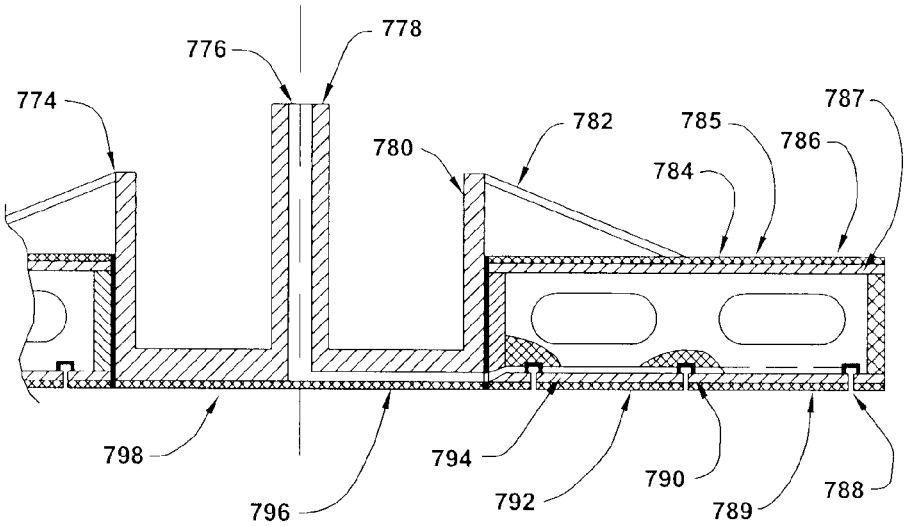
FIG. 30 is a cross section view of an abrading platen with a external stiffening cone.

FIG. 30 is a cross section view of an abrading platen with a external stiffening cone. An abrading platen assembly 785 has a platen annular portion 784 having a flat surface 786 that is attached to a platen drive hub 778 outer annular wall 780 with adhesive 774. The platen drive hub 778 can engage a rotary drive device (not shown) that can apply substantial torque to the drive hub 778 to rotationally accelerate and decelerate the platen assembly 785. The platen annular portion 784 has a flat-surfaced upper annular cover plate 786 and a flat-surfaced lower annular cover plate 792 where both the flat-surfaced upper cover plate 786 and a flat-surfaced lower cover plate 792 are adhesively bonded to an internal structural rib 787.

Vacuum holes 788 extend from the flexible abrasive disk (not shown) mounting surface 789 extend into a vacuum passage 794 and extend into tangential vacuum passageways 790 that extend around the circumference of the platen annular portion 784. The platen drive hub 778 has a vacuum passage 794 that is connected to the vacuum passage 796 that is connected to the vacuum passageway 794. A circular cover plate 798 is attached to the platen drive hub 778. An external structural cone 782 extends around the circumference of the platen assembly 785 and the structural cone 782 is bonded with adhesive 774 to the platen drive hub 778 inner wall 780 and to the platen assembly 785 annular body 784. The platen assembly 785 platen drive hub 778 circular cover plate 798 has an annular surface 796 that supports the inner radius area of the flexible abrasive disk.

Platen support ribs can be attached to the platen where these multiple radial ribs extend from the drive shaft hub to the annular center of the platen. These ribs typically are equal in number to the platen stiffening ribs and are attached to the platen at the same tangential locations as the platen stiffening ribs. Here, the adhesively attached platen support ribs and the respective radial platen stiffening ribs form continuous beam structures that are exceedingly stiff. Collectively, these radial rib structures, which are evenly distributed around the annular platen, can transfer large abrading forces without distorting the precision-flat platen abrading surface.

Figure 31:
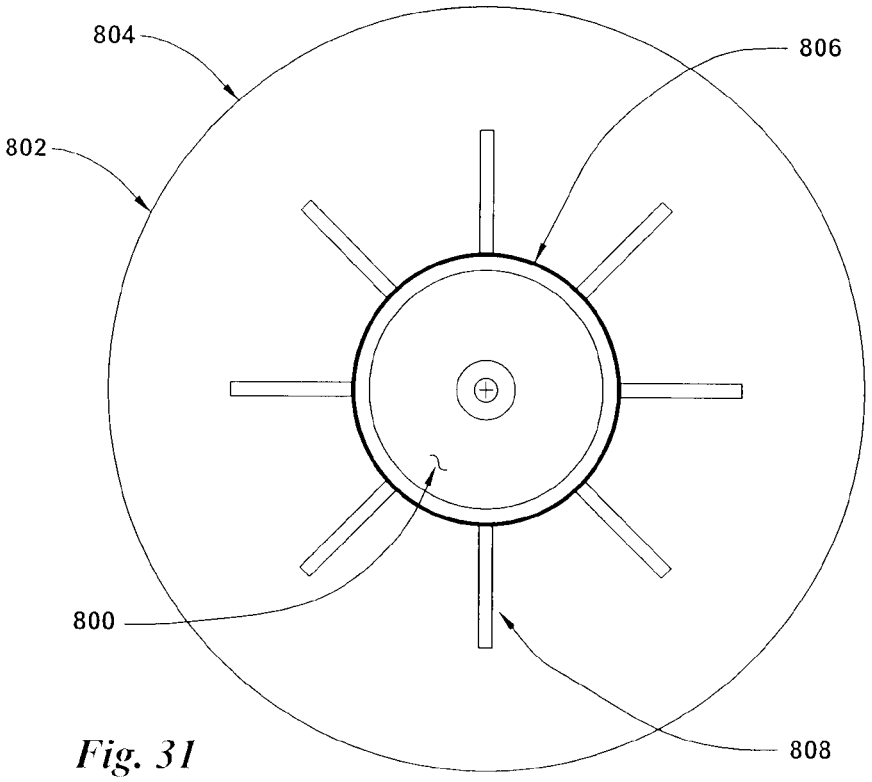
FIG. 31 is a top view of an abrading platen with external stiffening ribs.

FIG. 31 is a top view of an abrading platen with external stiffening ribs. A platen assembly 804 has a flat-surfaced annular plate 802 and a platen rotational drive hub 800 and external support ribs 808. The platen assembly 804 annular plate 802, the platen rotational drive hub 800 and the external support ribs 808 are typically bonded together with structural adhesive 806 but can be joined together by other techniques comprising welding or brazing.

A platen support cone can be attached to the platen where the edges of the cone extend from the drive shaft hub to the annular center of the platen. The cone spans all of the platen stiffening ribs. Here, the adhesively attached platen support cone and the respective radial platen stiffening ribs form a beam structure that is exceedingly stiff. The combination of the support cone and the radial rib structures can transfer large abrading forces without distorting the precision-flat platen abrading surface.

Figure 32:
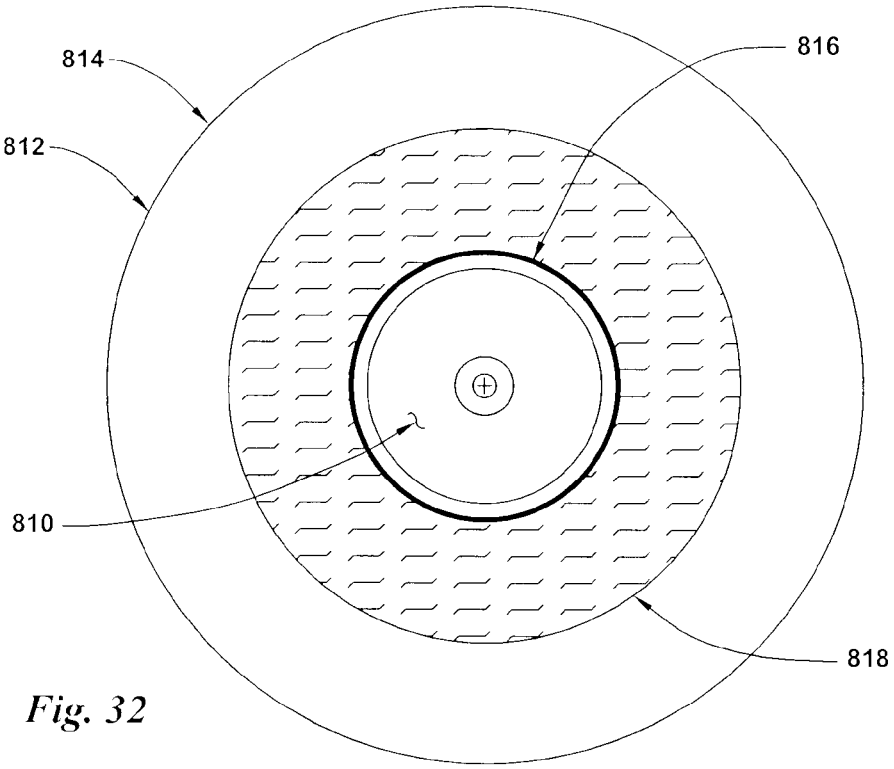
FIG. 32 is a top view of an abrading platen with an external stiffening cone.

FIG. 32 is a top view of an abrading platen with an external stiffening cone. A platen assembly 814 has a flat-surfaced annular plate 812 and a platen rotational drive hub 810 and an external support cone 818. The platen assembly 814 annular plate 812, the platen rotational drive hub 810 and the external support cone 818 are typically bonded together with structural adhesive 816 but can be joined together by other techniques comprising welding or brazing.

A platen hollow drive shaft can be made an integral part of a flat-surfaced flange-type hub that is attached to the platen annular body with fasteners. Using flat-head fasteners allows the drive shaft hub flange to transmit very large torsional forces for accelerating and decelerating the rotation of the platen. A drive shaft spline is used to apply torque to the drive shaft where a spherical bearing can be positioned on the same drive shaft. The drive shaft is hollow to allow vacuum to be routed to the platen annular body using flexible tubing. The drive shaft and the hub flange can be constructed from a variety of materials.

The platen drive shaft and hub flange would be typically fabricated from the cast aluminum material but it could also be produced from naval brass. This corrosion resistant brass has a similar coefficient of thermal expansion but is stiffer and stronger than the cast aluminum. The drive shaft has a spline to provide rotation of the platen.

Figure 33:
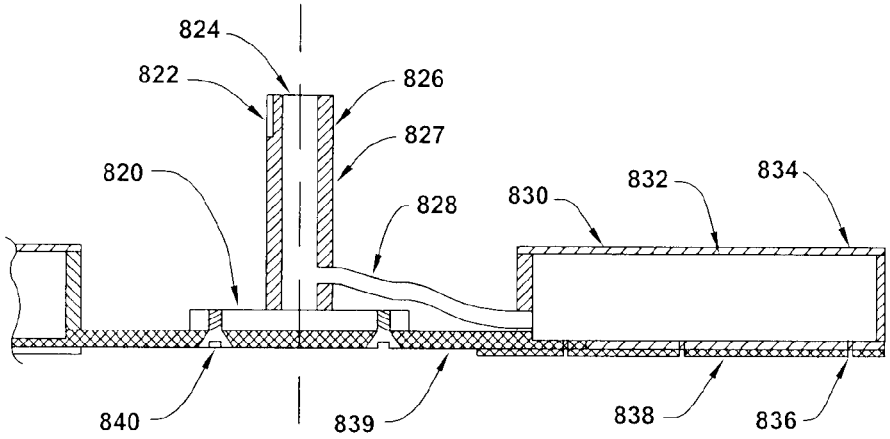
FIG. 33 is a cross section view of an abrading platen with a plate-type drive hub.

FIG. 33 is a cross section view of an abrading platen with a plate-type drive hub. A platen assembly 827 has a platen annular body 830 that has multiple radial stiffening ribs 832, a top flat-surfaced cover plate 834 and a bottom flat-surfaced cover plate 838 that has vacuum holes 836. Flexible abrasive disks (not shown) are attached with vacuum to the bottom cover plate 838. A platen rotary drive shaft 826 has a drive shaft spline 822 that engages a rotary drive shaft device (not shown) to rotate the platen assembly 827 by rotating the drive shaft 826 that is attached to a drive shaft plate 820. The drive shaft plate 820 is attached to a platen drive plate 839 with fasteners 840. A hollow vacuum tubing 828 is connected to a vacuum passage 824 in the drive shaft 826 and is connected to the platen annular body 830 to provide vacuum to the vacuum port holes 836 that are used to attach then abrasive disks to the platen bottom flat-surfaced cover plate 838.

A platen hollow drive shaft can be made constructed from steel to provide very high strength with a minimum sized shaft diameter. Stainless steel can be used because of its high strength and corrosion resistance. The difference in the coefficient of thermal expansion between the stainless steel and the cast aluminum lower portion of the drive shaft is minimized by the location of the steel end of the drive shaft. Any shrinkage or expansion of the steel shaft end and the other cast aluminum components of the platen body are minimized. The bolted joint between the two is located a substantial distance away from the platen abrading surface. Differential thermal expansions or shrinkages of the steel shaft end do not affect the precision-flatness of the platen annular abrading surface.

The steel shaft end has an internal cylindrical extension that extends deep into the cast aluminum drive shaft hub. This steel extension provides very substantial strengthening of the matching cylindrical connection between the drive shaft and the cast aluminum. Here, large dynamic forces can be transferred by the rotating platen body to the platen drive shaft which is constrained by and supported by the platen spherical support bearing. The platen drive shaft end could also be produced from naval brass. This corrosion resistant brass has a similar coefficient of thermal expansion but is stiffer and stronger than the cast aluminum. The drive shaft also has a spline to provide rotation of the platen.

Figure 34:
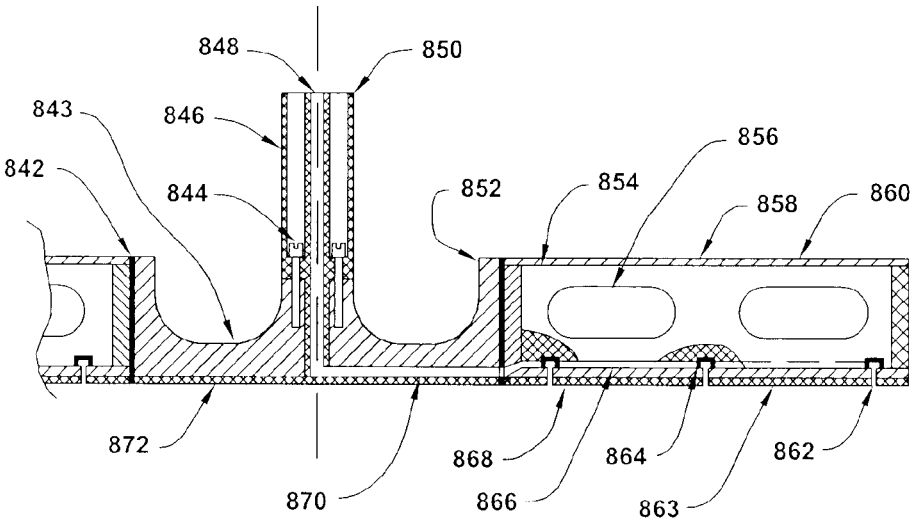
FIG. 34 is a cross section view of an abrading platen with a two-piece drive hub.

FIG. 34 is a cross section view of an abrading platen with a two-piece drive hub. An abrading platen assembly 860 has a platen annular portion 854 that is attached to a platen drive hub 850 outer annular wall 852 with adhesive 842. The platen drive hub 850 can engage a rotary drive device (not shown) that can apply substantial torque to the drive hub 850 to rotationally accelerate and decelerate the platen assembly 860. The platen annular portion 854 has a flat-surfaced upper cover plate 858 and a flat-surfaced lower cover plate 868 where both the flat-surfaced upper cover plate 858 and a flat-surfaced lower cover plate 868 are attached to multiple radial structural ribs 854. The radial structural ribs 854 have cut-out holes 856 to reduce the weight of the ribs 854.

Vacuum holes 862 extend from the flexible abrasive disk (not shown) mounting surface 863 on the cover plate 868 into the vacuum passage 866 and into a vacuum passage 870 and extend also into tangential vacuum passageways 864 that extend around the circumference of the platen annular portion 854. A circular cover plate 872 is attached to the platen drive hub 850. The drive hub 850 has a vacuum passageway 848 that is connected to vacuum passageway 870. The platen rotary drive shaft 850 has a removable drive shaft end section 846 that is attached to the drive shaft hub base 843 with threaded fasteners 844.

The annular abrading surface of the platen must be ground flat with a flatness variation that is less than 0.0001 inches (3 microns). To perform the grinding of this abrading surface, the plate annular body can be mounted upside down on a precision-flat rotary grinding platen. The grinding platen can be supported by air bearings to provide the required grinding platen flatness. When the abrasive platen is attached to the grinding platen by vacuum, a rotary abrasive grinder can be positioned in abrading contact with the platen abrading surface. The grinding platen is then rotated and the grinder wheel is rotated as the grinder is translated radially across the annular surface of the abrading platen. After the abrading platen annular body surface is ground precisely flat, the annular body can be adhesively bonded to the platen drive shaft hub.

Surface Grinding Platen Flatness

Figure 35:
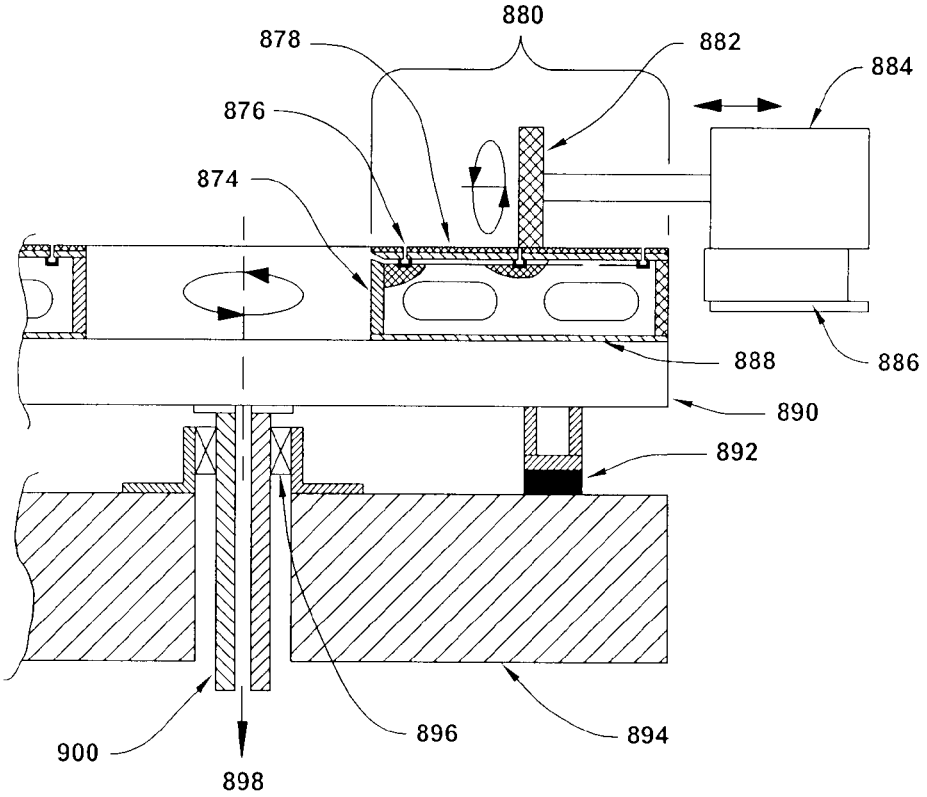
FIG. 35 is a cross section view of surface grinding the abrading surface of a platen.

FIG. 35 is a cross section view of surface grinding the abrading surface of a platen. A platen annular body 874 is attached to a rotating grinder platen 890 having a precision-flat surface 888 where the platen abrading surface 878 of the platen annular body 874 is exposed. A rotating grinder wheel 882 that is rotated by a grinder motor 884 is held in abrading contact with the abrading surface 878 of the platen annular body 874 while the grinder motor 884 and grinder wheel 882 are traversed radially, over an annular area 880, relative to the rotating grinder platen 890 that is rotated during the platen grinding operation. The grinder motor 884 is attached to a slide device 886 that allows the grinder motor 884 and grinder wheel 882 to be translated in a linear direction when the grinder motor 884 wheel shaft is rotated.

There are flexible abrasive disk (not shown) vacuum port holes 876 in the surface of the abrading surface 878 of the platen annular body 874 that is surface ground by the grinder wheel 882. The platen annular body 874 can be attached to a rotating grinder platen 890 by vacuum 898 that is supplied to the grinder platen 890 rotational drive shaft 900 where the drive shaft 900 is supported by bearings 896. The grinder platen 890 outer periphery is shown supported by air bearings 892 or roller bearings and both the platen shaft 900 support bearings 896 and the platen outer support air bearings 892 are supported by a machine base 894, preferably a granite base 894.

To assure that there is non-distorted surface contact of the backside of a platen annular body with a grinder platen when precision grinding the plate annular abrading surface, the backside of the platen can also be ground precisely flat. Here, the abrading surface of the platen is attached with vacuum to the surface of the grinding platen and the backside of the abrading platen is ground precisely flat. The grinding wheel is radially translated in abrading contact across the annular width of the backside off the abrading platen as the grinding platen is rotated.

Figure 36:
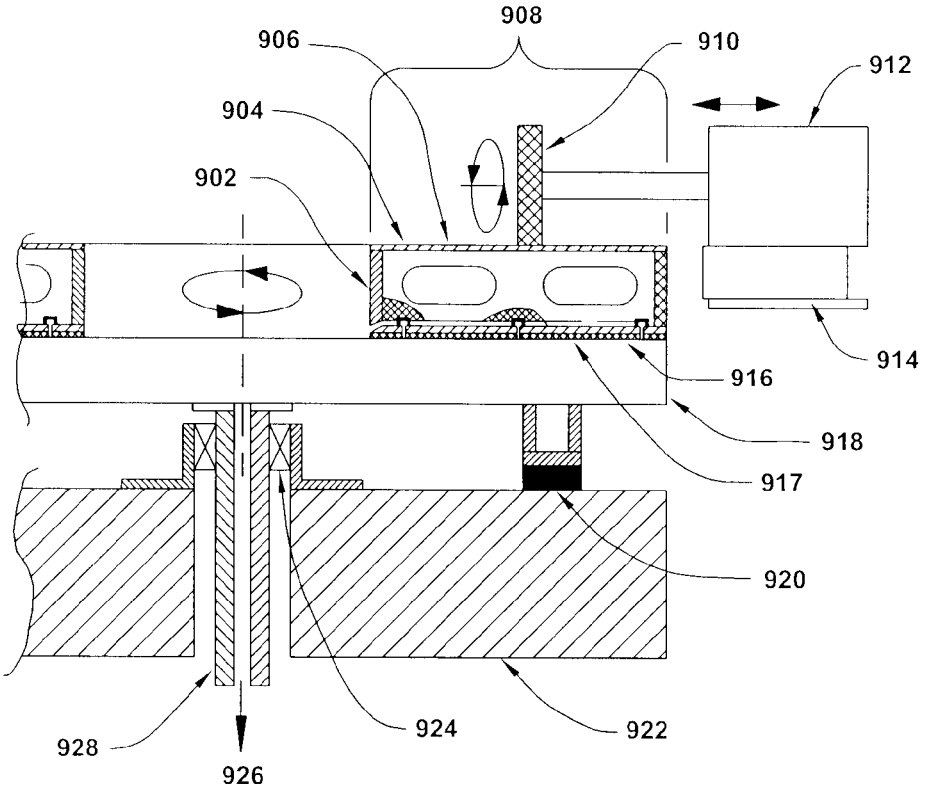
FIG. 36 is a cross section view of surface grinding the bottom surface of a platen.

FIG. 36 is a cross section view of surface grinding the bottom surface of a platen. A platen annular body 902 is attached to a rotating grinder platen 918 having a precision-flat surface 916 where the platen non-abrading surface 906 of the platen annular body 902 is exposed. Here, the abrading side 917 of the platen annular body 902 is attached to the grinder platen 918 annular flat surface 916. A rotating grinder wheel 910 that is rotated by a grinder motor 912 is held in abrading contact with the non-abrading surface 906 of the platen annular body 902 while the grinder motor 912 and grinder wheel 910 are traversed radially, over an annular area 908, relative to the rotating grinder platen 918 that is rotated during the platen grinding operation. The grinder motor 912 is attached to a slide device 914 that allows the grinder motor 912 and grinder wheel 910 to be translated in a linear direction when the grinder motor 912 wheel 910 shaft is rotated.

The platen annular body 902 can be attached to a rotating grinder platen 918 by vacuum 926 that is supplied to the grinder platen 918 rotational drive shaft 928 where the platen drive shaft 928 is supported by bearings 924. The grinder platen 918 outer periphery is shown supported by air bearings 920 or roller bearings and both the platen shaft 928 support bearings 924 and the platen outer support air bearings 920 are supported by a machine base 922, preferably a granite base 922.

The backside of an abrading platen that has an attached drive shaft hub with multiple external support ribs can also be precisely ground flat. This is done to assure that there is non-distorted surface contact of the backside of a platen annular body with a grinder platen when precision grinding the plate annular abrading surface. Here, the abrading surface of the platen is attached with vacuum to the surface of the grinding platen and the exposed non-rib backside portion of the abrading platen is ground precisely flat. The rotating grinding wheel is radially translated in abrading contact across the annular width of the backside of the abrading platen as the grinding platen is rotated. Only the outer annular portion of the backside of the abrading platen is precision-ground flat. The backside portion that contains the multiple radial support ribs is not ground flat.

Figure 37:
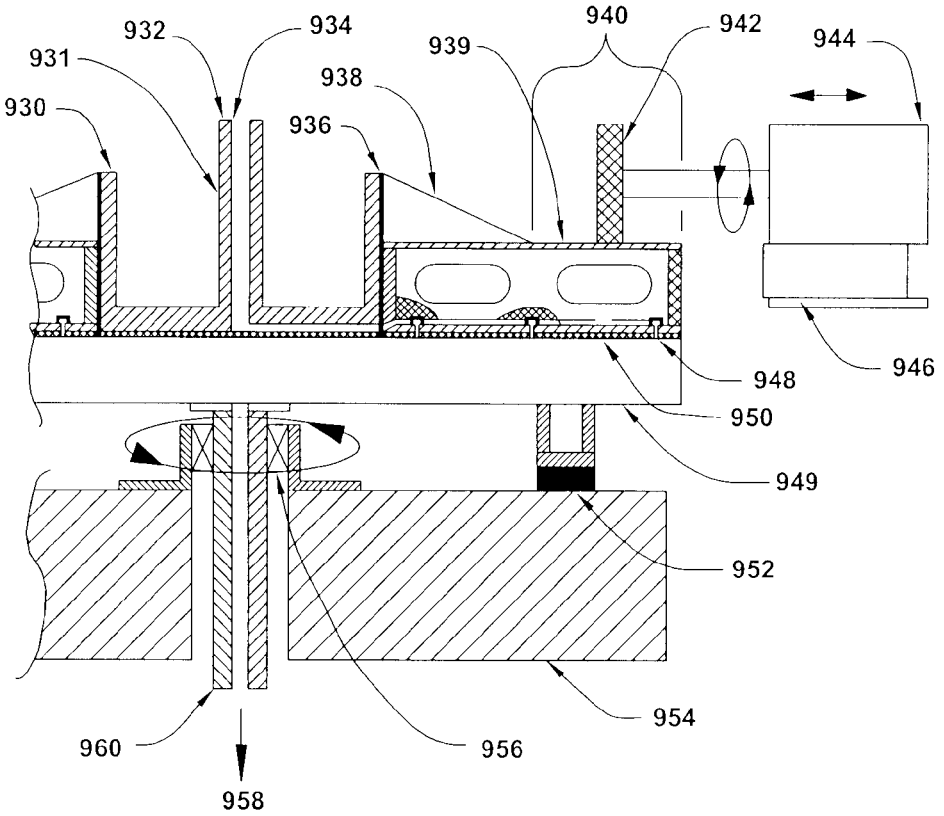
FIG. 37 is a cross section view of surface grinding the bottom of a platen having ribs.

FIG. 37 is a cross section view of surface grinding the bottom outer annular non-abrading surface of a platen having multiple support ribs. A platen annular body 931 is attached to a rotating grinder platen 949 having a precision-flat annular surface 950 where the platen non-abrading outer annular surface 939 of the platen annular body 931 is exposed. Here, the abrading side 948 of the platen annular body 931 is attached to the grinder platen 949 annular flat surface 950. A rotating grinder wheel 942 that is rotated by a grinder motor 944 is held in abrading contact with the non-abrading surface 939 of the platen annular body 931 while the grinder motor 944 and grinder wheel 942 are traversed radially, over an outer annular area 940, relative to the rotating grinder platen 949 that is rotated during the platen grinding operation. The grinder motor 944 is attached to a slide device 946 that allows the grinder motor 944 and grinder wheel 942 to be translated in a linear direction when the grinder motor 944 wheel 942 shaft is rotated.

The platen annular body 931 can be attached to a rotating grinder platen 949 by vacuum 958 that is supplied to the grinder platen 949 rotational drive shaft 960 where the platen drive shaft 960 is supported by bearings 956. The grinder platen 949 outer periphery is shown supported by air bearings 952 or roller bearings and both the platen drive shaft 960 support bearings 956 and the platen outer support air bearings 952 are supported by a machine base 954, preferably a granite base 954.

The platen annular body 931 has a rotary drive shaft 932 that has a vacuum passageway 934 and the platen annular body 931 has drive hub wall 930 that is attached to multiple platen annular body 931 support ribs 938 that are located around the circumference of the platen annular body 931 with an adhesive 936.

The annular abrading side of an abrading platen that has an attached drive shaft hub with external support ribs can also be precisely ground flat. This is done by attaching the abrading platen to a precision-flat annular spacer block that is attached to a grinder platen. The spacer block provides sufficient height to the abrading platen such that neither the attached drive shaft hub or the radial stiffening support ribs contact the surface of the grinder platen. The grinding platen can be supported by air bearings to provide the required grinding platen flatness. When the abrasive platen is attached to the ground spacer block by vacuum, a rotary abrasive grinder can be positioned in abrading contact with the platen abrading surface. The grinding platen is then rotated and the grinder wheel is rotated as the grinder is translated radially across the annular abrading surface of the abrading platen.

Figure 38:
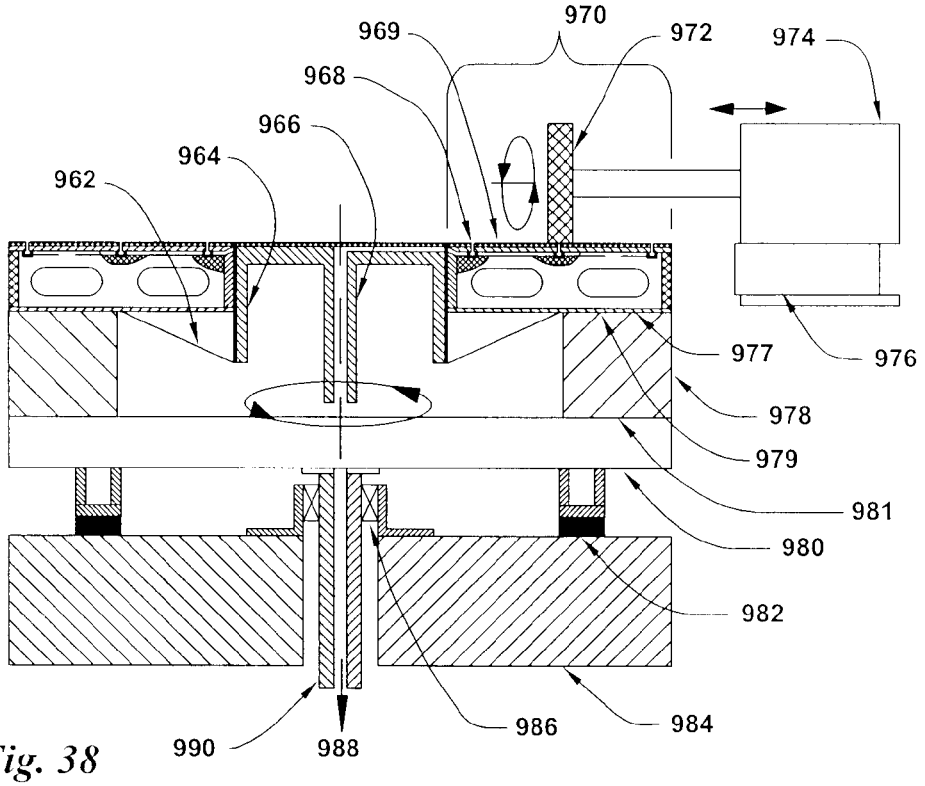
FIG. 38 is a cross section view of grinding the abrading surface of a platen having ribs.

FIG. 38 is a cross section view of surface grinding the outer annular abrading surface of a platen having support ribs. A platen spacer block 978 having a flat annular surface 979 is attached to the flat annular surface 981 of the grinder rotary platen 980 and the platen spacer block 978 annular surface 979 is ground flat by a rotating grinder wheel 972 that is mounted on a grinder motor 974 which is traversed radially across the platen spacer block 978 annular surface 979. This grinding of the spacer block 978 annular surface 979 results in the flat surface of the spacer block 978 annular surface 979 being precisely co-planar with the flat annular surface 981 of the grinder rotary platen 980.

A platen annular body 964 is attached to a rotatable grinder platen 980 having a precision-flat surface 981 by attaching the platen annular body 964 to the platen spacer block 978 annular surface 979 where the platen abrading surface 969 of the platen annular body 964 is exposed. The platen annular body 964 has a rotary drive shaft 966 that has a vacuum passageway and the platen annular body 964 has multiple platen annular body 964 support ribs 962 that are located around the circumference of the platen annular body 964. When the platen annular body 964 is attached to the platen spacer block 978, the platen annular body 964 rotary drive shaft 966 and the platen annular body 964 support ribs 962 do not contact the grinder rotary platen 980 precision-flat surface 981.

A rotating grinder wheel 972 that is rotated by a grinder motor 974 is held in abrading contact with the abrading surface 969 of the platen annular body 964 while the grinder motor 974 and grinder wheel 972 are traversed radially, over an annular area 970, relative to the rotating grinder platen 980 that is rotated during the platen grinding operation. The grinder motor 974 is attached to a slide device 976 that allows the grinder motor 974 and grinder wheel 972 to be translated in a linear direction when the grinder motor 974 wheel 972 shaft is rotated.

There are flexible abrasive disk (not shown) vacuum port holes 968 in the surface of the abrading surface 969 of the platen annular body 964 that are surface-ground by the grinder wheel 972. The platen annular body 964 can be attached to a rotating grinder platen 980 by vacuum 988 that can be routed through vacuum passageways (not shown) in the platen spacer block 978 where the vacuum is supplied to the grinder platen 980 rotational drive shaft 990 and where the drive shaft 990 is supported by bearings 986. The grinder platen 980 outer periphery is shown supported by air bearings 982 or roller bearings and both the platen shaft 990 support bearings 986 and the platen outer support air bearings 982 are supported by a machine base 984, preferably a granite base 984.

Figure 39:
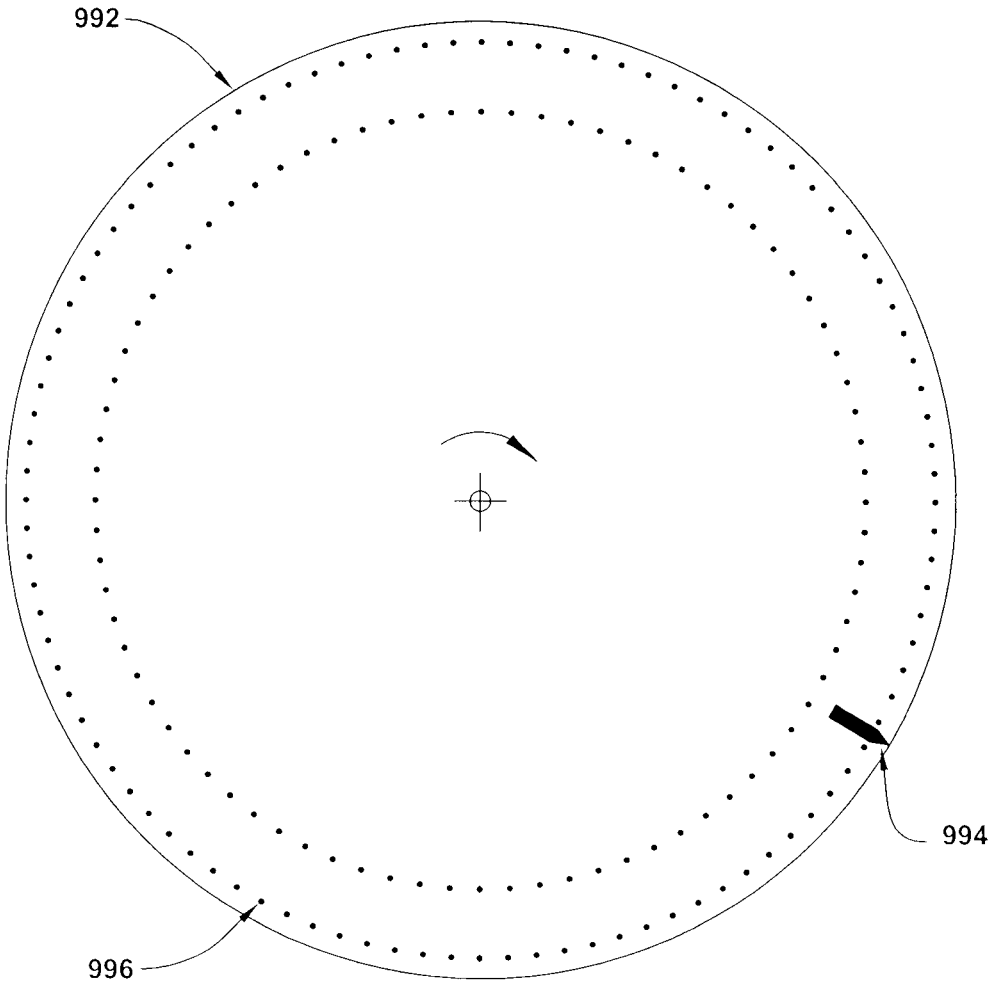
FIG. 39 is a top view of a rotary abrading platen having vacuum port holes.

FIG. 39 is a top view of a rotary abrading platen having vacuum port holes. The rotary platen 992 has rows of vacuum port holes 996 that extend around the circumference of the platen 992. Also, the platen 992 has an indicator marker 994 that is an integral part of the platen 992 where the marker 994 can be used to circumferentially register flexible abrasive disks (not shown) when they are attached to the platen 992. This indicator marker allows the abrasive disks, having a respective indicator mark, to be removed form a platen and be re-attached to the same platen 992 where the original "ground-in" or "dressed" surface of the abrasive disk abrasive is re-established simply by re-attaching the abrasive disk where the abrasive disk indicator mark is tangentially aligned with the abrading platen 992 indicator mark 994.

Platen Vacuum Port Hole Insert Strips

It is desired to fabricate large diameter platens that have internal vacuum passageways connected to vacuum port holes that are used to attach flexible abrasive disks to the platen surface where these platens do not require expensive composite layered platen structures. Platens can be constructed from a single layer sheet material that has annular and radial grooves cut into the top surface of the platen where these grooves have attached covers that route vacuum passageways from the platen center to annular disk attachment paths that have vacuum port holes. These grooves typically have a flat bottom surfaces or ledges to accommodate covers that have the same width as the grooves to allow these pre-machined covers to be adhesively bonded to the groove ledges or bottoms. The covers that extend radially from the platen center would provide sealed passageways to route the vacuum from the platen center to the port-hole covered annular grooves that extend around the platen circumference.

The annular grooves would be radially positioned under the flexible abrasive covered raised island annular portions of the abrasive disks that are attached to the platen to provide maximum hold-down support of the abrasive that is subjected to abrading contact forces. These platen vacuum passageways can be used for flexible continuous coated abrasive disks or for flexible backing raised island abrasive disks. Multiple annular vacuum passageways can be used for large diameter abrasive disks and single annular passageways can be used for small diameter abrasive disks. Each of the continuous coated or annular band raised island abrasive disks would have a backing sheet that extends continuously over the full diameter of the abrasive disk so that vacuum leakage would not occur at the portion of the abrasive disk that is inboard radially from the outer annular vacuum passageways.

In the event that the vacuum port holes become worn due to the ingestion of abrasive particles or the passageways become plugged with grinding debris, the cover can simply be removed from the groove and a substitute new cover can be adhesively attached in place.

The covers can be fabricated from the same material as the platen body or the covers can be fabricated from a variety of materials comprising metals, steel, stainless steel, polymers, composite materials, or inorganic materials. Port holes can be fabricated by using port-hole inserts that are bonded or mechanically crimped or bonded into the cover structures where the inserts are fabricated from a variety of materials comprising metals, polymers, ceramics, and jewels. The radial and the annular port hole covers can be fabricated as individual annular sections that can be adhesively attached to the grooves. New covers would be fabricated to fit flush with the top flat surface of the platen to minimize the necessity of re-machining the top surface of the platen after new replacement covers are installed.

Figure 40:
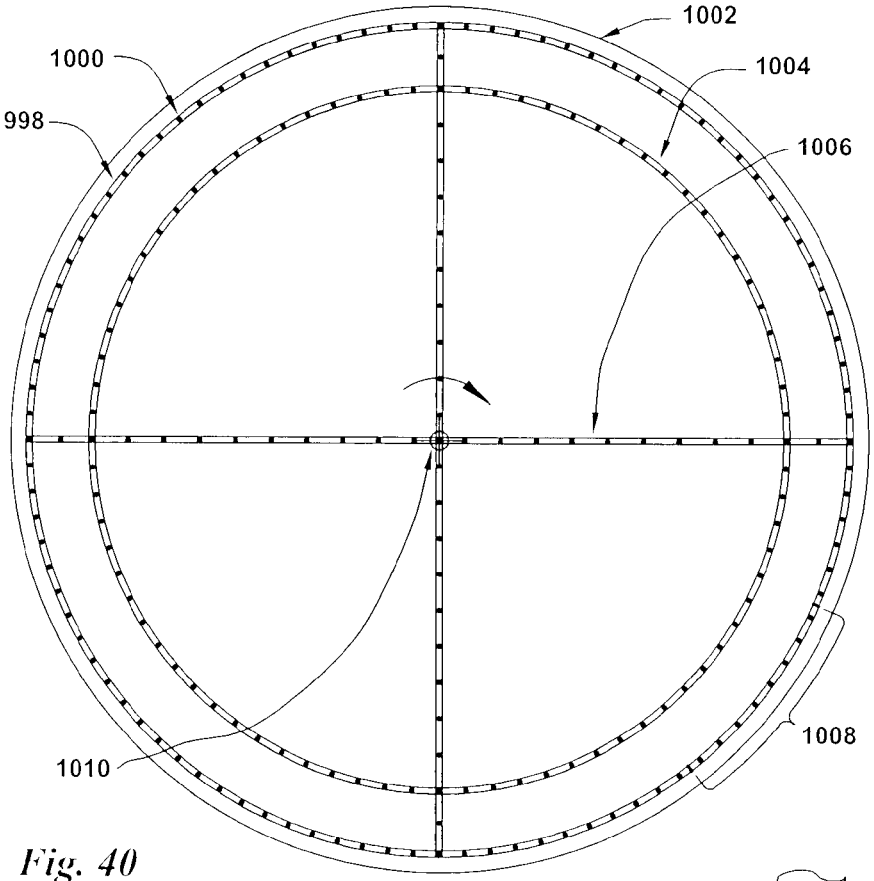
FIG. 40 is a top view of a flat lapper platen assembly that has cover strips of vacuum holes.
Figure 41:
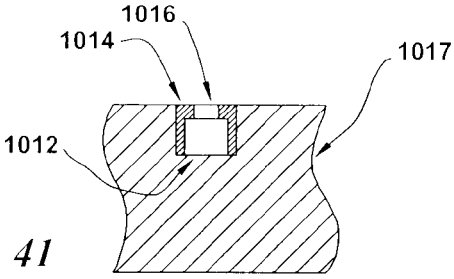
FIG. 41 is a cross section view of a lapper platen assembly having vacuum covers.

FIG. 40 is a top view of a flat lapper platen assembly that has radial and annular covers over vacuum passageway grooves. A flat surfaced platen 1002 has annular groove covered passageways 998 and 1004 that have vacuum port holes 1000. Radial flat-bottomed covered grooves 1006 are used to route vacuum from the platen center vacuum passageway 1010 to the annular passageways 998 and 1004. The annular passageway 998 has an annular cover segment 1008. FIG. 41 is a cross section view of a portion of a flat lapper platen assembly that has vacuum passageway grooves and groove covers. A flat surfaced platen 1017 has grooved vacuum passageways 1012 that are covered with U-shaped covers 1014 that have vacuum port holes 1016.

Figure 42:
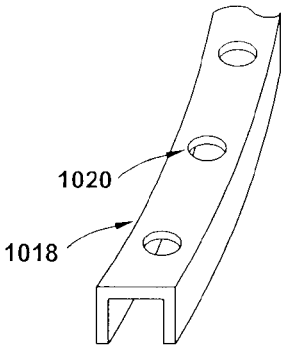
FIG. 42 is an orthographic view of a vacuum groove cover plate that has vacuum port holes.
Figure 43:
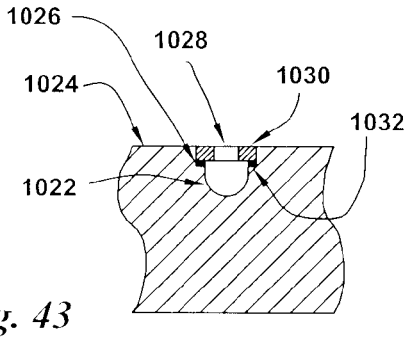
FIG. 43 is a cross section view of a lapper platen that has round-bottomed vacuum grooves.
Figure 44:
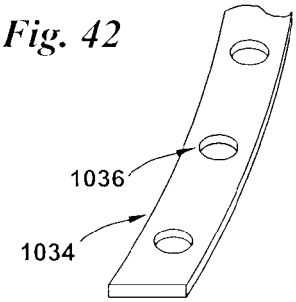
FIG. 44 is an orthographic view of a groove flat cover plate that has vacuum port holes.

FIG. 42 is an orthographic view of a portion of annular vacuum groove U-shaped cover plate that has vacuum port holes. The annular cover plate 1018 has vacuum port holes 1020. FIG. 43 is a cross section view of a portion of a flat lapper platen assembly that has round bottomed vacuum passageway grooves and groove covers. A flat surfaced platen 1024 has round-bottomed grooved vacuum passageways 1022 that are covered with flat covers 1030 that have vacuum port holes 1028. The covers 1030 are bonded to the grooves 1022 upper flat ledges 1032 with an adhesive 1026. FIG. 44 is an orthographic view of a portion of annular vacuum groove flat cover plate that has vacuum port holes. The annular flat cover plate 1034 has vacuum port holes 1036.

Co-Planar Aligned Workpiece Spindles

Figure 45:
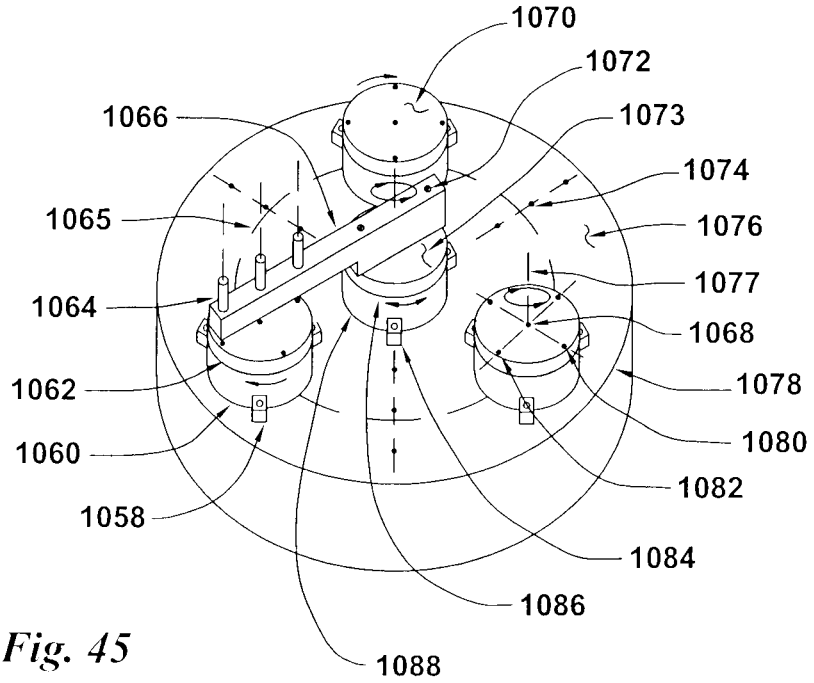
FIG. 45 is an isometric view of an air bearing spindle laser spindle alignment device.

FIG. 45 is an isometric view of an air bearing spindle mounted laser co-planar spindle top alignment device. An air bearing rotary alignment spindle 1088 is mounted on a granite lapper machine base 1078 having a flat surface 1076 where the rotary alignment spindle 1088 is positioned at the center of the machine base 1078. Rotary workpiece spindles 1060 having rotary spindle-tops 1062 are located at the outer periphery of the circular shaped machine base 1078 where these workpiece spindles 1060 are positioned with near-equal distances between them and they surround the alignment spindle 1088. A laser sensor arm 1066 is attached to the top flat surface 1073 of the rotary alignment spindle 1088 spindle-top 1086 where the rotary spindle-top 1086 of the alignment spindle 1088 can be rotated to selected positions.

Three laser distance sensors 1064 are shown attached to the laser sensor arm 1066 where the laser distance sensors 1064 can be used to measure the precise laser span distance between the laser sensor 1064 bottom laser sensor end (not shown) and targets 1068, 1080, 1082 located on the flat surfaces 1070 of the workpiece spindle-tops 1062. One or more of the three laser distance sensors 1064 can also be used to measure the precise laser span distances to select targets 1074 that are located on the flat surface 1076 of the machine base 1078. The select targets 1074 that are located on the flat surface 1076 of the machine base 1078 are typically aligned in a line that extends radially from the center of the machine base 1078 so that the laser span distances of all three select targets 1074 can be measured simultaneously by the distance measuring sensors 1064. The laser sensor arm 1066 that is attached to the top flat surface 1073 of the rotary alignment spindle 1088 spindle-top 1086 can be rotated to align the laser distance sensors 1064 with the selected measurement targets 1068, 1080, 1082 located on the surfaces 1070 of the workpiece spindle-tops 1062 and also to be aligned with targets 1074 that are located on the flat surface 1076 of the machine base 1078.

Commercial air bearing alignment spindles 1088 that are suitable for precision co-planar alignment of the workpiece spindles 1060 spindle-tops 1062 flat surfaces 1070 are available from Nelson Air Corp, Milford, N.H. Air bearing spindles are preferred for this co-planar alignment procedure but suitable rotary flat-surfaced alignment spindles 1088 having conventional roller bearings can also be used. These air bearing alignment spindles 1088 typically provide spindle top 1086 flat surface 1073 flatness accuracy of 5 millionths of an inch (0.13 microns) but can have spindle top 1086 flat surface 1073 flatness accuracies of only 2 millionths of an inch (0.05 microns). These alignment spindle 1088 flatness accuracies are more than adequate to co-planar align the workpiece spindles 1060 spindle-tops 1062 flat surfaces 1070 within the 0.0001 inches (3 microns) required for high speed flat lapping. In addition, the air bearing alignment spindles 1088 are also very stiff for resisting any torsion loads imposed by overhanging the laser sensor arm 1066 past the peripheral edge of the alignment spindles 1088 which prevents deflection of the sensor 1064 end of the laser sensor arm 1066 during all phases of the procedure for co-planar alignment of all the individual workpiece spindles 1060 spindle-tops 1062 flat surfaces 1070.

Typically three workpiece spindles 1060 are used for a lapper machine but more than three workpiece spindles 1060 can be attached to the machine base 1078 and be co-planar aligned using this alignment system. The preferred distance sensors 1064 are laser sensors but they can also be mechanical distance measurement sensors 1064 such as micrometers and also can be ultrasonic distance sensors 1064.

The procedure for co-planar alignment of the workpiece spindle's 1060 spindle-tops 1062 flat surfaces 1070 includes attaching the alignment spindle 1088 to the machine base 1078 flat surface 1076 and attaching the laser sensing arm 1066 having the distance sensors 1064 to the alignment spindle 1088 rotary spindle top 1086 flat surface 1073. Then the laser sensing arm 1066 is rotated to select target positions 1074 on the machine base 1078 and laser span distance measurements are made between the ends of the laser sensors 1064 and the select target positions 1074 on the machine base 1078 to adjust the heights of the rotary alignment spindle 1088 support legs 1084 where the top flat surface 1073 of the rotary spindle-top 1086 of the alignment spindle 1088 is aligned to be co-planar with the top flat surface 1076 of the granite, metal or epoxy-granite machine base 1078.

Each of the workpiece spindles 1060 spindle-tops 1062 flat surfaces 1070 are individually aligned to be co-planar aligned with the top flat surface 1073 of the rotary spindle-top 1086 of the alignment spindle 1088 by adjusting the height of the workpiece spindle 1060 support legs 1058. The co-planar alignment of the workpiece spindles 1060 spindle-tops 1062 flat surfaces 1070 is done by making distance measurements from the ends of the laser sensors 1064 to selected targets 1068, 1080, 1082 on the flat surfaces 1070 of the workpiece spindles 1060 spindle-tops 1062. The laser sensing arm 1066 is rotated to align the laser sensors 1064 with the selected targets 1068, 1080, 1082 on the flat surfaces 1070 of the workpiece spindles 1060 spindle-tops 1062 by manually rotating the rotary spindle-top 1086 of the alignment spindle 1088. When all of the individual workpiece spindles 1060 spindle-tops 1062 flat surfaces 1076 are individually aligned to be co-planar aligned with the with the top flat surface 1073 of the rotary spindle-top 1086 of the alignment spindle 1088, the alignment spindle 1088 is removed from the machine base

1078. This co-planar alignment of the workpiece spindle's 1060 spindle-tops 1062 flat surfaces 1070 can be done periodically to re-establish or verify the accuracy of the workpiece spindles 1060 co-planar alignment. The workpiece spindles 1060 spindle tops 1062 rotate about a spindle tops 1062 target point 1068 that is located at the geometric centers of the spindle-tops 1062.

The three workpiece spindles 1060 are mounted on the flat surface 1076 of the machine base 1078 where the rotational axis 1077 of the spindle tops 1062 intersects a target point 1068 and where the rotational axes 1077 of the spindle tops 1062 intersect a spindle-circle 1065 where the spindle-circle 1065 is coincident with the machine base 1078 nominally-flat top surface 1076.

Figure 46:
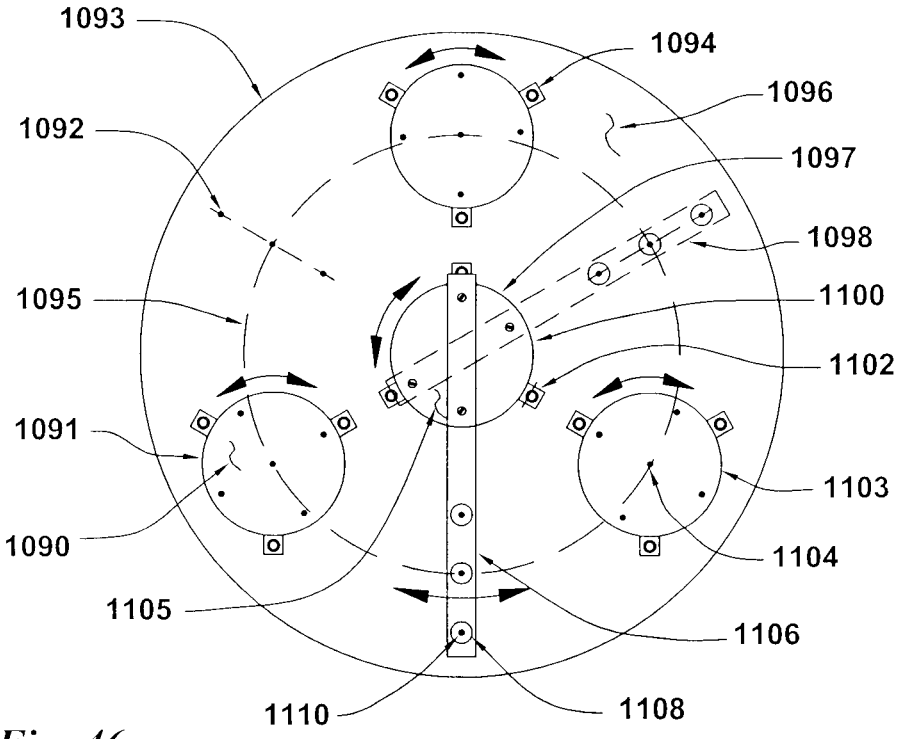
FIG. 46 is a top view of an air bearing spindle laser co-planar spindle top alignment device.

FIG. 46 is a top view of an air bearing spindle mounted laser co-planar spindle top alignment device. An air bearing rotary alignment spindle 1100 is mounted on a granite lapper machine base 1093 having a flat surface 1096 where the rotary alignment spindle 1100 is positioned at the center of the machine base 1093. Rotary workpiece spindles 1091 having flat surfaces 1090 are located at the outer periphery of the circular shaped machine base 1093 where these workpiece spindles 1091 are positioned with near-equal distances between them and they surround the alignment spindle 1100. A laser sensor arm 1106 is attached to the rotary alignment spindle 1100 spindle-top 1097 where the rotary spindle-top 1097 of the alignment spindle 1100 can be rotated to selected positions.

Three laser distance sensors 1108 are shown attached to the laser sensor arm 1106 where the laser distance sensors 1108 having respective laser beam axes 1110 can be used to measure the precise laser span distance between the laser sensor 1108 bottom laser sensor end (not shown) and targets 1104 located on the flat surfaces 1090 of the workpiece spindle's 1091 spindle-tops 1103. One or more of the three laser distance sensors 1108 can also be used to measure the precise laser span distances to select targets 1092 that are located on the flat surface 1096 of the machine base 1093. The select targets 1092 that are located on the flat surface 1096 of the machine base 1093 are typically aligned in a line that extends radially from the center of the machine base 1093 so that the laser span distances of all three select targets 1092 can be measured simultaneously by the distance measuring sensors 1108.

The laser sensor arm 1106 that is attached to the top flat surface of the rotary alignment spindle 1100 spindle-top 1097 can be rotated to align the laser distance sensors 1108 with the selected measurement targets 1104 located on the surfaces of the workpiece spindles 1091 spindle-tops 1103 and also to be aligned with targets 1092 that are located on the flat surface 1096 of the machine base 1093. The laser sensor arm 1106 is shown also in an alternative measurement location as laser sensor arm 1098. Each of the workpiece spindles 1091 have height adjustable support legs 1094 that are adjusted in height to align the workpiece spindle-tops 1103 to be co-planar with the alignment spindle 1100 spindle-top flat surface 1105. Also, the alignment spindle 1100 has height adjustable support legs 1102 that are adjusted in height to align the flat top surface 1105 of the alignment spindle 1100 spindle-tops 1097 to be co-planar with the granite base 1093 flat surface 1096. The three workpiece spindles 1091 are mounted on the flat surface 1096 of the machine base 1093 where the rotational axes of the spindle tops 1103 that intersects the spindle tops 1103 rotation-center target point 1104 intersects a spindle-circle 1095 where the spindle-circle 1095 is coincident with the machine base 1093 nominally-flat top surface 1096.

Fixed-Spindle Floating-Platen System Description

The fixed-spindle floating-platen lapping system has many unique features, configurations and operational procedures. The basic system is an at least three-point, fixed-spindle floating-platen abrading machine comprising:

a) at least three rotary spindles having rotatable flat-surfaced spindle-tops that each have a spindle-top axis of rotation at the center of a respective rotatable flat-surfaced spindle-top for each respective rotary spindles;

b) wherein the at least three spindle-tops' axes of rotation are perpendicular to the respective spindle-tops' flat surfaces;

c) an abrading machine base having a horizontal, nominally-flat top surface and a spindle-circle where the spindle-circle is coincident with the machine base nominally-flat top surface;

d) wherein the at least three rotary spindles are located with near-equal spacing between the respective at least three of the rotary spindles where the respective at least three spindle-tops' axes of rotation intersect the machine base spindle-circle and where the respective at least three rotary spindles are mechanically attached to the machine base;

e) wherein the at least three spindle-tops' flat surfaces are adjustably alignable to be co-planar with each other;

f) a rotatable floating abrading platen having a flat annular abrading surface where the rotatable floating abrading platen is supported by and is rotationally driven about a rotatable floating abrading platen cylindrical-rotation axis located at a cylindrical-rotation center of the rotatable floating abrading platen and perpendicular to the rotatable floating abrading platen flat annular abrading surface by a spherical-action rotation device located coincident with the cylindrical-rotation axis of the rotatable floating abrading platen where the rotatable floating abrading platen spherical-action rotation device restrains the rotatable floating abrading platen in a radial direction relative to the rotatable floating abrading platen cylindrical-rotation axis where the rotatable floating abrading platen cylindrical-rotation axis is nominally concentric with and perpendicular to the machine base spindle-circle where the rotatable floating abrading platen spherical-action rotation device has a spherical center of rotation that is coincident with the rotatable floating abrading platen cylindrical-rotation axis where the rotatable floating abrading platen has a center of mass that is coincident with the rotatable floating abrading platen cylindrical-rotation axis;

g) wherein the rotatable floating abrading platen is comprised of rotatable floating abrading platen components attached together and wherein the rotatable floating abrading platen flat annular abrading surface is partially or fully coated with a wear-resistant coating;

h) wherein the rotatable floating abrading platen has rotatable floating abrading platen internal vacuum passageways and wherein the rotatable floating abrading platen flat annular abrading surface has vacuum port holes that are interconnected with the rotatable floating abrading platen internal vacuum passageways and wherein the rotatable floating abrading platen flat annular abrading surface vacuum port holes can provide vacuum to the rotatable floating abrading platen flat annular abrading surface;

i) wherein the rotatable floating abrading platen spherical-action rotation device allows spherical motion of the rotatable floating abrading platen about the rotatable floating abrading platen spherical-action rotation device spherical center of rotation where the flat annular abrading surface of the rotatable floating abrading platen that is supported by the rotatable floating abrading platen spherical-action rotation device is nominally horizontal; and j) flexible abrasive disk articles having annular bands of abrasive coated surfaces where a selected flexible abrasive disk is attached in flat conformal contact with the rotatable floating abrading platen flat annular abrading surface such that the attached abrasive disk is concentric with the rotatable floating abrading platen flat annular abrading surface;

k) wherein equal-thickness workpieces having parallel opposed flat workpiece top surfaces and flat workpiece bottom surfaces are attached to the respective at least three spindle-tops where the flat workpiece bottom surfaces are in flat-surfaced contact with the flat surfaces of the respective at least three spindle-tops;

l) wherein the rotatable floating abrading platen can be moved to allow the abrasive surface of the flexible abrasive disk that is attached to the rotatable floating abrading platen flat annular abrading surface to contact the top surfaces of the workpieces that are attached to the flat surfaces of the respective at least three spindle-tops wherein the at least three rotary spindles provide at least three-point support of the rotatable floating abrading platen and wherein the rotatable floating abrading platen spherical-action rotation device allows spherical motion of the rotatable floating abrading platen about the rotatable floating abrading platen spherical-action rotation device spherical center of rotation to provide uniform abrading contact of the abrasive surface of the flexible abrasive disk with the respective workpieces;

m) an abrading contact force component where the abrading contact force component can apply an abrading contact force to the rotatable floating abrading platen spherical-action rotation device wherein the applied abrading contact force is applied to the rotatable floating abrading platen by the rotatable floating abrading platen spherical-action rotation device and the applied abrading contact force is applied to the workpieces by the rotatable floating abrading platen;

n) wherein the total rotatable floating abrading platen abrading contact force applied to workpieces that are attached to the respective at least three spindle-top flat surfaces by contact of the abrasive surface of the flexible abrasive disk that is attached to the rotatable floating abrading platen flat annular abrading surface with the top surfaces of the workpieces is controlled through the rotatable floating abrading platen spherical-action rotatable floating abrading platen rotation device to allow the total rotatable floating abrading platen abrading contact force to be evenly distributed to the workpieces attached to the respective at least three spindle-tops; and o) wherein the at least three spindle-tops having attached equal-thickness workpieces can be rotated about the respective spindle-tops' rotation axes and the rotatable floating abrading platen having the attached flexible abrasive disk can be rotated about the rotatable floating abrading platen cylindrical-rotation axis to single-side abrade the workpieces that are attached to the flat surfaces of the at least three spindle-tops while the moving abrasive surface of the flexible abrasive disk that is attached to the moving rotatable floating abrading platen flat annular abrading surface is in force-controlled abrading contact with the top surfaces of the workpieces that are attached to the respective at least three spindle-tops.

The fixed-spindle floating-platen lapping system is described wherein each flexible abrasive disk is attached in flat conformal contact with the rotatable floating abrading platen flat annular abrading surface by disk attachment techniques selected from the group consisting of vacuum disk attachment techniques, mechanical disk attachment techniques and adhesive disk attachment techniques. Also, the system has machine base structural material selected from the group consisting of granite, epoxy-granite, cast iron and steel and wherein the machine base structural material and the machine base structural material is either solid or is temperature controlled by a temperature-controlled fluid that circulates in fluid passageways internal to the machine base structural materials. Further, the system can include at least three rotary spindles are air bearing rotary spindles.

Also, the fixed-spindle floating-platen lapping system is described wherein the rotatable floating abrading platen spherical-action rotation device is an air bearing spherical-action rotation device having a spherical-action rotation device air bearing rotor that supports the rotatable floating abrading platen and the abrading platen spherical-action rotation device has a spherical-action rotation device air bearing housing that is attached to the pivot frame where pressurized air is supplied to the air bearing spherical-action rotation device air bearing housing to create a friction-free air film that is positioned between the spherical-action rotation device air bearing rotor and the spherical-action rotation device air bearing housing to allow friction-free spherical rotation of the spherical-action rotation device air bearing rotor.

In addition, the fixed-spindle floating-platen lapping system is described wherein the rotatable floating abrading platen spherical-action rotation device is a roller bearing having spherical-action rotation capabilities where the roller bearing spherical-action rotation device has a spherical-action rotation device roller bearing rotor that supports the rotatable floating abrading platen and the abrading platen spherical-action rotation device has a spherical-action rotation device roller bearing housing that is attached to the pivot frame to allow spherical rotation of the spherical-action rotation device air bearing rotor. The rotatable floating abrading platen can have a wear-resistant coating that is selected from the group consisting of an anodized coating, a metal plated coating, a hard-material spherical beads material coating and an adhesive mixture type of coating material that is filled with hard-material particles.

The platen wear-resistant coating can be a hard-material spherical beads material coating wherein the hard-material spherical beads are selected from the group consisting of solid aluminum oxide beads, vitrified aluminum oxide beads, beads having a ceramic matrix material that supports hard-material particles, beads having a polymer matrix material that supports hard-material particles, beads that are filled with aluminum oxide particles, beads that are filled with diamond particles and beads that are filled with cubic boron nitride particles. Further, the hard-material spherical beads material coating can be applied to the rotatable floating abrading platen flat annular abrading surface by coating the rotatable floating abrading platen flat annular abrading surface with an adhesive and then depositing the hard-material spherical beads onto the adhesive coating wherein the hard-material spherical beads are attached to the rotatable floating abrading platen flat annular abrading surface by the coated adhesive after which wherein the adhesive coating is solidified.

Also, the platen surface wear-resistant coating can be a size-coat mixture of hard-material particles and an adhesive is applied to the exposed surface of the hard-material spherical beads material coating that is applied to the rotatable floating abrading platen flat annular abrading surface to partially fill localized gaps that exist between portions of the individual hard-material spherical beads wherein a uniform flat surface is formed by the size-coat mixture of hard-material particles and an adhesive wherein the adhesive contained in the mixture of hard-material particles and the adhesive is solidified to form a wear-resistant coating on the rotatable floating abrading platen flat annular abrading surface. Here, the platen surface wear-resistant coating can have a thickness where the platen surface wear-resistant coating ranges from 0.002 inches to 0.125 inches and where the wear-resistant coating has a thickness of the platen surface wear-resistant coating ranges from 0.005 inches to 0.020 inches.

In addition, the wear-resistant coating can be machined or abrasively ground flat after the wear-resistant coating is applied to the rotatable floating abrading platen flat annular abrading surface to provide a flat-surfaced rotatable floating abrading platen flat annular abrading surface.

The fixed-spindle floating-platen lapping system is described wherein hollow wear-resistant hardened material orifice inserts can be selected from the group consisting of sapphire inserts, aluminum oxide inserts and hardened-metal inserts can be positioned in the rotatable floating abrading platen flat annular abrading surface to provide wear resistant vacuum port holes that interconnect the wear-resistant coated rotatable floating abrading platen flat annular abrading surface with the rotatable floating abrading platen internal vacuum passageways wherein vacuum can be supplied to the rotatable floating abrading platen internal vacuum passageways whereby vacuum at the rotatable floating abrading platen flat annular abrading surface is used to attach a flexible abrasive disk to the wear-resistant coated rotatable floating abrading platen abrading surface.

Further, the wear-resistant coated rotatable floating abrading platen flat annular abrading surface can have patterns of vacuum port holes supplying vacuum at the rotatable floating abrading platen flat annular abrading surface to attach a flexible abrasive disk to the wear-resistant coated rotatable floating abrading platen abrading surface where the wear-resistant coated rotatable floating abrading platen flat annular abrading surface vacuum port holes have hole diameters that range from 0.002 inches to 0.125 inches.

Also, the wear-resistant coated rotatable floating abrading platen flat annular abrading surface can have patterns of vacuum grooves supplying vacuum at the rotatable floating abrading platen flat annular abrading surface to attach a flexible abrasive disk to the wear-resistant coated rotatable floating abrading platen abrading surface where the wear-resistant coated rotatable floating abrading platen flat annular abrading surface vacuum grooves have groove widths that range from 0.002 inches to 0.125 inches and groove depths that range from 0.002 inches to 0.015 inches. In addition, the rotatable floating abrading platen components can be comprised of cast aluminum material components wherein rotatable floating abrading platen components are bonded to rotatable floating abrading platen components with adhesives.

A process of providing abrasive flat lapping is described of using an at least three-point, fixed-spindle floating-platen abrading machine comprising:

a) providing at least three rotary spindles having rotatable flat-surfaced spindle-tops that each have a spindle-top axis of rotation at the center of a respective rotatable flat-surfaced spindle-top for each respective rotary spindles;

b) providing that the at least three spindle-tops' axes of rotation are perpendicular to the respective spindle-tops' flat surfaces;

c) providing an abrading machine base having a horizontal, nominally-flat top surface and a spindle-circle where the spindle-circle is coincident with the machine base nominally-flat top surface;

d) positioning the at least three rotary spindles to be located with near-equal spacing between the respective at least three of the rotary spindles where the respective at least three spindle-tops' axes of rotation intersect the machine base spindle-circle and where the respective at least three rotary spindles are mechanically attached to the machine base;

e) aligning the at least three spindle-tops' flat surfaces are adjustably co-planar with each other;

f) providing a rotatable floating abrading platen having a flat annular abrading surface where the rotatable floating abrading platen is supported by and is rotationally driven about a rotatable floating abrading platen cylindrical-rotation axis located at a cylindrical-rotation center of the rotatable floating abrading platen and perpendicular to the rotatable floating abrading platen flat annular abrading surface by a spherical-action rotation device located coincident with the cylindrical-rotation axis of the rotatable floating abrading platen where the rotatable floating abrading platen spherical-action rotation device restrains the rotatable floating abrading platen in a radial direction relative to the rotatable floating abrading platen cylindrical-rotation axis where the rotatable floating abrading platen cylindrical-rotation axis is nominally concentric with and perpendicular to the machine base spindle-circle where the rotatable floating abrading platen spherical-action rotation device has a spherical center of rotation that is coincident with the rotatable floating abrading platen cylindrical-rotation axis where the rotatable floating abrading platen has a center of mass that is coincident with the rotatable floating abrading platen cylindrical-rotation axis;

g) providing that the rotatable floating abrading platen is comprised of rotatable floating abrading platen components attached together and wherein the rotatable floating abrading platen flat annular abrading surface is partially or fully coated with a wear-resistant coating;

h) providing that the rotatable floating abrading platen has rotatable floating abrading platen internal vacuum passageways and wherein the rotatable floating abrading platen flat annular abrading surface has vacuum port holes that are interconnected with the rotatable floating abrading platen internal vacuum passageways and wherein the rotatable floating abrading platen flat annular abrading surface vacuum port holes can provide vacuum to the rotatable floating abrading platen flat annular abrading surface;

i) providing that the rotatable floating abrading platen spherical-action rotation device allows spherical motion of the rotatable floating abrading platen about the rotatable floating abrading platen spherical-action rotation device spherical center of rotation where the flat annular abrading surface of the rotatable floating abrading platen that is supported by the rotatable floating abrading platen spherical-action rotation device is nominally horizontal; and j) providing flexible abrasive disk articles having annular bands of abrasive coated surfaces where a selected flexible abrasive disk is attached in flat conformal contact with the rotatable floating abrading platen flat annular abrading surface such that the attached abrasive disk is concentric with the rotatable floating abrading platen flat annular abrading surface;

k) providing equal-thickness workpieces having parallel opposed flat workpiece top surfaces and flat workpiece bottom surfaces are attached to the respective at least three spindle-tops where the flat workpiece bottom surfaces are in flat-surfaced contact with the flat surfaces of the respective at least three spindle-tops;

l) moving the rotatable floating abrading platen to allow the abrasive surface of the flexible abrasive disk that is attached to the rotatable floating abrading platen flat annular abrading surface to contact the top surfaces of the workpieces that are attached to the flat surfaces of the respective at least three spindle-tops wherein the at least three rotary spindles provide at least three-point support of the rotatable floating abrading platen and wherein the rotatable floating abrading platen spherical-action rotation device allows spherical motion of the rotatable floating abrading platen about the rotatable floating abrading platen spherical-action rotation device spherical center of rotation to provide uniform abrading contact of the abrasive surface of the flexible abrasive disk with the respective workpieces;

m) providing an abrading contact force component where the abrading contact force device applies an abrading contact force to the rotatable floating abrading platen spherical-action rotation device wherein the applied abrading contact force is applied to the rotatable floating abrading platen by the rotatable floating abrading platen spherical-action rotation device and the applied abrading contact force is applied to the workpieces by the rotatable floating abrading platen;

n) providing that the total rotatable floating abrading platen abrading contact force applied to workpieces that are attached to the respective at least three spindle-top flat surfaces by contact of the abrasive surface of the flexible abrasive disk that is attached to the rotatable floating abrading platen flat annular abrading surface with the top surfaces of the workpieces is controlled through the rotatable floating abrading platen spherical-action rotatable floating abrading platen rotation device to allow the total rotatable floating abrading platen abrading contact force to be evenly distributed to the workpieces attached to the respective at least three spindle-tops; and o) rotating the at least three spindle-tops having attached equal-thickness workpieces about the respective spindle-tops' rotation axes and rotating the rotatable floating abrading platen having the attached flexible abrasive disk about the rotatable floating abrading platen cylindrical-rotation axis to single-side abrade the workpieces that are attached to the flat surfaces of the at least three spindle-tops while the moving abrasive surface of the flexible abrasive disk that is attached to the moving rotatable floating abrading platen flat annular abrading surface is in force-controlled abrading contact with the top surfaces of the workpieces that are attached to the respective at least three spindle-tops.

The process of providing abrasive flat lapping is described wherein each flexible abrasive disk is attached in flat conformal contact with the rotatable floating abrading platen flat annular abrading surface by disk attachment techniques selected from the group consisting of vacuum disk attachment techniques, mechanical disk attachment techniques and adhesive disk attachment techniques. Here, the at least three rotary spindles can be air bearing rotary spindles.

What is claimed:

1. An at least three-point, fixed-spindle floating-platen abrading machine comprising:

a) at least three rotary spindles having rotatable flat-surfaced spindle-tops, each of the spindle-tops having a respective spindle-top axis of rotation at the center of a respective rotatable flat-surfaced spindle-top for each respective rotary spindles;

b) wherein a respective axis of rotation for each of the at least three spindle-tops' is perpendicular to the respective spindle-tops' flat surface;

c) an abrading machine base having a horizontal, nominally-flat top surface and a spindle-circle where the spindle-circle is coincident with the machine base nominally-flat top surface;

d) the at least three rotary spindles are located with near-equal spacing between the respective at least three rotary spindles where the respective at least three spindle-tops' axes of rotation intersect the machine base spindle-circle and where the respective at least three rotary spindles are mechanically attached to the machine base;

e) the at least three spindle-tops' flat surfaces are configured to be adjustably alignable to be co-planar with each other;

f) a rotatable floating abrading platen having a flat annular abrading surface where the rotatable floating abrading platen is supported by and is rotationally driven about a rotatable floating abrading platen cylindrical-rotation axis located at i) a cylindrical-rotation center of the rotatable floating abrading platen and ii) perpendicular to the rotatable floating abrading platen flat annular abrading surface by a spherical-action rotation device located coincident with the cylindrical-rotation axis of the rotatable floating abrading platen;

g) the rotatable floating abrading platen spherical-action rotation device restrains the rotatable floating abrading platen in a radial direction relative to the rotatable floating abrading platen cylindrical-rotation axis and the rotatable floating abrading platen cylindrical-rotation axis is nominally concentric with and perpendicular to the machine base spindle-circle, and the rotatable floating abrading platen spherical-action rotation device has a spherical center of rotation that is coincident with the rotatable floating abrading platen cylindrical-rotation axis where the rotatable floating abrading platen has a center of mass that is coincident with the rotatable floating abrading platen cylindrical-rotation axis;

h) the rotatable floating abrading platen is comprised of rotatable floating abrading platen components attached together and the rotatable floating abrading platen flat annular abrading surface is partially or fully coated with a wear-resistant coating;

i) the rotatable floating abrading platen has rotatable floating abrading platen internal vacuum passageways and the rotatable floating abrading platen flat annular abrading surface has vacuum port holes that are interconnected with internal vacuum passageways in the rotatable floating abrading platen and wherein the rotatable floating abrading platen flat annular abrading surface vacuum port holes can provide vacuum to the rotatable floating abrading platen flat annular abrading surface;

j) the rotatable floating abrading platen spherical-action rotation device allows spherical motion of the rotatable floating abrading platen about the rotatable floating abrading platen spherical-action rotation device spherical center of rotation where the flat annular abrading surface of the rotatable floating abrading platen that is supported by the rotatable floating abrading platen spherical-action rotation device is nominally horizontal; and k) flexible abrasive disk articles having annular bands of abrasive coated surfaces where a selected flexible abrasive disk is attached in flat conformal contact with the rotatable floating abrading platen flat annular abrading surface such that the attached abrasive disk is concentric with the rotatable floating abrading platen flat annular abrading surface;

l) equal-thickness workpieces having parallel opposed flat workpiece top surfaces and flat workpiece bottom surfaces are attached to the respective at least three spindle-tops where the flat workpiece bottom surfaces are in flat-surfaced contact with the flat surfaces of the respective at least three spindle-tops;

m) the rotatable floating abrading platen are configured to be moved to allow the abrasive surface of the flexible abrasive disk that is attached to the rotatable floating abrading platen flat annular abrading surface to contact the top surfaces of the workpieces that are attached to the flat surfaces of the respective at least three spindle-tops wherein the at least three rotary spindles provide at least three-point support of the rotatable floating abrading platen and wherein the rotatable floating abrading platen spherical-action rotation device allows spherical motion of the rotatable floating abrading platen about the rotatable floating abrading platen spherical-action rotation device spherical center of rotation to provide uniform abrading contact of the abrasive surface of the flexible abrasive disk with the respective workpieces;

n) an abrading contact force component that can apply an abrading contact force to the rotatable floating abrading platen spherical-action rotation device, wherein the applied abrading contact force is applied to the rotatable floating abrading platen by the rotatable floating abrading platen spherical-action rotation device and the applied abrading contact force is applied to the workpieces by the rotatable floating abrading platen;

o) wherein the total rotatable floating abrading platen abrading contact force applied to workpieces that are attached to the respective at least three spindle-top flat surfaces by contact of the abrasive surface of the flexible abrasive disk that is attached to the rotatable floating abrading platen flat annular abrading surface with the top surfaces of the workpieces is controlled through the rotatable floating abrading platen spherical-action rotatable floating abrading platen rotation device to allow the total rotatable floating abrading platen abrading contact force to be evenly distributed to the workpieces attached to the respective at least three spindle-tops; and p) the at least three spindle-tops having attached equal-thickness workpieces are configured to be rotated about the respective spindle-tops' rotation axes, and the rotatable floating abrading platen having the attached flexible abrasive disk are configured to be rotated about the rotatable floating abrading platen cylindrical-rotation axis to single-side abrade the workpieces that are attached to the flat surfaces of the at least three spindle-tops while the moving abrasive surface of the flexible abrasive disk that is attached to the moving rotatable floating abrading platen flat annular abrading surface is in force-controlled abrading contact with the top surfaces of the workpieces that are attached to the respective at least three spindle-tops.

2. The machine of claim 1 wherein each flexible abrasive disk is attached in flat conformational contact with the rotatable floating abrading platen flat annular abrading surface by disk attachment techniques selected from the group consisting of vacuum disk attachment techniques, mechanical disk attachment techniques and adhesive disk attachment techniques.

3. The machine of claim 1 wherein the machine base structural material is selected from the group consisting of granite, epoxy-granite, and metal and wherein the machine base structural material and the machine base structural material is either a non-porous solid or is a solid material that is temperature controlled by a temperature-controlled fluid that circulates in fluid passageways internal to the machine base structural materials.

4. The machine of claim 1 wherein the at least three rotary spindles are air bearing rotary spindles.

5. The machine of claim 1 wherein the rotatable floating abrading platen spherical-action rotation device is an air bearing spherical-action rotation device having a spherical-action rotation device air bearing rotor that supports the rotatable floating abrading platen and the abrading platen spherical-action rotation device has a spherical-action rotation device air bearing housing attached to the pivot frame where pressurized air is supplied to the air bearing spherical-action rotation device air bearing housing to create a friction-free air film positioned between the spherical-action rotation device air bearing rotor and the spherical-action rotation device air bearing housing allowing spherical rotation of the spherical-action rotation device air bearing rotor.

6. The machine of claim 1 wherein the rotatable floating abrading platen spherical-action rotation device is a roller bearing having spherical-action rotation capabilities where the roller bearing spherical-action rotation device has a spherical-action rotation device roller bearing rotor supporting the rotatable floating abrading platen and the abrading platen spherical-action rotation device has a spherical-action rotation device roller bearing housing attached to the pivot frame allowing spherical rotation of the spherical-action rotation device air bearing rotor.

7. The abrading machine of claim 1 wherein the wear-resistant coating of the rotatable floating abrading platen further comprises an anodized coating, a metal plated coating, a hard-material spherical beads coating and a coating mixture filled with hard-material particles.

8. The abrading machine of claim 7 wherein the wear-resistant coating is a hard-material spherical beads coating wherein the hard-material spherical beads are selected from the group consisting of solid aluminum oxide beads, vitrified aluminum oxide beads, beads having a ceramic matrix material that supports hard-material particles, beads having a polymer matrix material that supports hard-material particles, beads filled with aluminum oxide particles, beads filled with diamond particles and beads filled with cubic boron nitride particles.

9. The abrading machine of claim 7 wherein the hard-material spherical beads material coating has been formed on the rotatable floating abrading platen flat annular abrading surface by coating the rotatable floating abrading platen flat annular abrading surface with an adhesive and then depositing the hard-material spherical beads onto the adhesive coating wherein the hard-material spherical beads are attached to the rotatable floating abrading platen flat annular abrading surface by solidified adhesive coating.

10. The abrading machine of claim 8 wherein a size-coat mixture of hard-material particles and an adhesive has been applied to the exposed surface of the hard-material spherical beads material coating to partially fill localized gaps in the rotatable floating abrading platen flat annular abrading surface that exist between portions of the individual hard-material spherical beads such that a uniform flat surface is formed by the size-coat mixture of hard-material particles and an adhesive wherein the adhesive contained in the mixture of hard-material particles and the adhesive has been solidified to form a wear-resistant coating on the rotatable floating abrading platen flat annular abrading surface.

11. The abrading machine of claim 1 wherein the thickness of the platen surface wear-resistant coating of the rotatable floating abrading platen further comprises a range of from 0.002 inches to 0.125 inches.

12. The abrading machine of claim 1 wherein the thickness of the platen surface wear-resistant coating of the rotatable floating abrading platen further comprises a range of from 0.005 inches to 0.0.020 inches.

13. The abrading machine of claim 1 wherein the wear-resistant coating of the rotatable floating abrading platen further is machined or abrasively ground flat after the wear-resistant coating is applied to the rotatable floating abrading platen flat annular abrading surface to provide a flat-surfaced rotatable floating abrading platen flat annular abrading surface.

14. The abrading machine of claim 1 further comprises hollow wear-resistant hardened material orifice inserts selected from the group consisting of sapphire inserts, aluminum oxide inserts and hardened-metal inserts are positioned in the rotatable floating abrading platen flat annular abrading surface to provide wear resistant vacuum port holes that interconnect the wear-resistant coated rotatable floating abrading platen flat annular abrading surface with the rotatable floating abrading platen internal vacuum passageways wherein vacuum can be supplied to the rotatable floating abrading platen internal vacuum passageways whereby vacuum at the rotatable floating abrading platen flat annular abrading surface attaches a flexible abrasive disk to the wear-resistant coated rotatable floating abrading platen abrading surface.

15. The abrading machine of claim 1 wherein the wear-resistant coated rotatable floating abrading platen flat annular abrading surface of the rotatable floating abrading platen further comprises patterns of vacuum port holes supplying vacuum at the rotatable floating abrading platen flat annular abrading surface to attach a flexible abrasive disk to the wear-resistant coated rotatable floating abrading platen abrading surface where the wear-resistant coated rotatable floating abrading platen flat annular abrading surface vacuum port holes have hole diameters that range from 0.002 inches to 0.125 inches.

16. The abrading machine of claim 1 wherein the wear-resistant coated rotatable floating abrading platen flat annular abrading surface of the rotatable floating abrading platen further comprises patterns of vacuum grooves supplying vacuum at the rotatable floating abrading platen flat annular abrading surface to attach a flexible abrasive disk to the wear-resistant coated rotatable floating abrading platen abrading surface where the wear-resistant coated rotatable floating abrading platen flat annular abrading surface vacuum grooves have groove widths that range from 0.002 inches to 0.125 inches and groove depths that range from 0.002 inches to 0.015 inches.

17. The abrading machine of claim 1 wherein rotatable floating abrading platen components of the rotatable floating abrading platen further comprises cast aluminum material components wherein the rotatable floating abrading platen components are bonded to rotatable floating abrading platen components with adhesives.

18. A process of providing abrasive flat lapping using an at least three-point, fixed-spindle floating-platen abrading machine comprising:

a) providing at least three rotary spindles having rotatable flat-surfaced spindle-tops that each have a spindle-top axis of rotation at the center of a respective rotatable flat-surfaced spindle-top for each respective rotary spindles;

b) providing that the at least three spindle-tops' axes of rotation are perpendicular to the respective spindle-tops' flat surfaces;

c) providing an abrading machine base having a horizontal, nominally-flat top surface and a spindle-circle where the spindle-circle is coincident with the machine base nominally-flat top surface;

d) positioning the at least three rotary spindles in locations with near-equal spacing between the respective at least three of the rotary spindles where the respective at least three spindle-tops' axes of rotation intersect the machine base spindle-circle and where the respective at least three rotary spindles are mechanically attached to the machine base;

e) aligning the at least three spindle-tops' flat surfaces so that they are co-planar with each other;

f) providing a rotatable floating abrading platen having a flat annular abrading surface where the rotatable floating abrading platen is supported by and rotationally driving the rotatable floating abrading platen about a rotatable floating abrading platen cylindrical-rotation axis located at a cylindrical-rotation center of the rotatable floating abrading platen and perpendicular to the rotatable floating abrading platen flat annular abrading surface by a spherical-action rotation device located coincident with the cylindrical-rotation axis of the rotatable floating abrading platen where the rotatable floating abrading platen spherical-action rotation device restrains the rotatable floating abrading platen in a radial direction relative to the rotatable floating abrading platen cylindrical-rotation axis where the rotatable floating abrading platen cylindrical-rotation axis is nominally concentric with and perpendicular to the machine base spindle-circle where the rotatable floating abrading platen spherical-action rotation device has a spherical center of rotation that is coincident with the rotatable floating abrading platen cylindrical-rotation axis where the rotatable floating abrading platen has a center of mass that is coincident with the rotatable floating abrading platen cylindrical-rotation axis;

g) providing the rotatable floating abrading platen as comprised of rotatable floating abrading platen components attached together and wherein the rotatable floating abrading platen flat annular abrading surface has been partially or fully coated with a wear-resistant coating;

h) providing that the rotatable floating abrading platen has rotatable floating abrading platen internal vacuum passageways and wherein the rotatable floating abrading platen flat annular abrading surface has vacuum port holes that are interconnected with the rotatable floating abrading platen internal vacuum passageways and wherein the rotatable floating abrading platen flat annular abrading surface vacuum port holes provide vacuum to the rotatable floating abrading platen flat annular abrading surface;

i) the rotatable floating abrading platen spherical-action rotation device allowing spherical motion of the rotatable floating abrading platen about the rotatable floating abrading platen spherical-action rotation device spherical center of rotation where the flat annular abrading surface of the rotatable floating abrading platen that is supported by the rotatable floating abrading platen spherical-action rotation device is nominally horizontal; and j) providing flexible abrasive disk articles having annular bands of abrasive coated surfaces where a selected flexible abrasive disk is attached in flat conformal contact with the rotatable floating abrading platen flat annular abrading surface such that the attached abrasive disk is concentric with the rotatable floating abrading platen flat annular abrading surface;

k) attaching equal-thickness workpieces having parallel opposed flat workpiece top surfaces and flat workpiece bottom surfaces to the respective at least three spindle-tops where the flat workpiece bottom surfaces are in flat-surfaced contact with the flat surfaces of the respective at least three spindle-tops;

l) moving the rotatable floating abrading platen to allow the abrasive surface of the flexible abrasive disk that is attached to the rotatable floating abrading platen flat annular abrading surface to contact the top surfaces of the workpieces that are attached to the flat surfaces of the respective at least three spindle-tops wherein the at least three rotary spindles provide at least three-point support of the rotatable floating abrading platen and wherein the rotatable floating abrading platen spherical-action rotation device allows spherical motion of the rotatable floating abrading platen about the rotatable floating abrading platen spherical-action rotation device spherical center of rotation to provide uniform abrading contact of the abrasive surface of the flexible abrasive disk with the respective workpieces;

m) providing an abrading contact force component where the abrading contact force component applies an abrading contact force to the rotatable floating abrading platen spherical-action rotation device wherein the applied abrading contact force is applied to the rotatable floating abrading platen by the rotatable floating abrading platen spherical-action rotation device and the applied abrading contact force is applied to the workpieces by the rotatable floating abrading platen;

n) applying the total rotatable floating abrading platen abrading contact force to workpieces that are attached to the respective at least three spindle-top flat surfaces by contact of the abrasive surface of the flexible abrasive disk attached to the rotatable floating abrading platen flat annular abrading surface with the top surfaces of the workpieces and controlling the rotatable floating abrading platen abrading contact force through the rotatable floating abrading platen spherical-action rotatable floating abrading platen rotation device to allow the total rotatable floating abrading platen abrading contact force to be evenly distributed to the workpieces attached to the respective at least three spindle-tops; and o) rotating the at least three spindle-tops having attached equal-thickness workpieces about the respective spindle-tops' rotation axes and rotating the rotatable floating abrading platen having the attached flexible abrasive disk about the rotatable floating abrading platen cylindrical-rotation axis to single-side abrade the workpieces that are attached to the flat surfaces of the at least three spindle-tops while the moving abrasive surface of the flexible abrasive disk that is attached to the moving rotatable floating abrading platen flat annular abrading surface is in force-controlled abrading contact with the top surfaces of the workpieces that are attached to the respective at least three spindle-tops.

19. The process of claim 18 wherein each flexible abrasive disk is attached in flat conformal contact with the rotatable floating abrading platen flat annular abrading surface by disk attachment techniques selected from the group consisting of vacuum disk attachment techniques, mechanical disk attachment techniques and adhesive disk attachment techniques.

20. The process of claim 18 wherein the at least three rotary spindles are air bearing rotary spindles.

* * * * *